United States Patent [19]

Takano

[11] Patent Number: 4,897,690

[45] Date of Patent: Jan. 30, 1990

[54] IMAGE FORMING APPARATUS

[75] Inventor: Yoshiaki Takano, Osaka, Japan

[73] Assignee: Minolta Camera Kabushiki Kaisha, Osaka, Japan

[21] Appl. No.: 250,450

[22] Filed: Sep. 28, 1988

[30] Foreign Application Priority Data

Sep. 30, 1987 [JP] Japan ..... 62-248541
Sep. 30, 1987 [JP] Japan ..... 62-248542
Sep. 30, 1987 [JP] Japan ..... 62-248543

[51] Int. Cl.[4] ..... G03G 15/01; G03G 15/08

[52] U.S. Cl. ..... 325/208; 355/246; 355/326

[58] Field of Search ..... 355/206, 208, 245, 246, 355/326, 328; 118/645, 689–691

[56] References Cited

U.S. PATENT DOCUMENTS 4,579,443 4/1986 Abuyama et al. ..... 355/326 X

*Primary Examiner*—Arthur T. Grimley
*Assistant Examiner*—J. Pendegrass
*Attorney, Agent, or Firm*—Burns, Doane, Swecker & Mathis

[57] ABSTRACT

An image forming apparatus includes first and second devices selectively operable for developing an electrostatic latent image on a photosensitive member, toner accommodating devices for accommodating developer, detecting devices for detecting toner density in each of developers, a judging device for judging whether the first and second developers have same color, a selecting device responsive to the detecting device and judging device for automatically selecting the second developing device in the case where the toner density in the first developer is less than a specified value and where the toner density in the second developer is not less than the specified value under the judgment by the judging device that the first and second developers have same color, replenishing devices for replenishing toner to each of the first and second developers, and means for activating the replenishing device so as to continuously replenish toner to the first developer until the toner density therein reaches the specified value in the case where both of the toner density in the first and second developers are less than the specified value even if the first and second developers have same color, while prohibiting an image forming operation.

11 Claims, 52 Drawing Sheets

IMAGE FORMING APPARATUS

BACKGROUND OF THE INVENTION

The present invention generally relates to an image forming apparatus in which a plurality of developing devices are arranged.

Conventionally, an image forming apparatus is known in which a plurality of developing devices selectively operable for developing electrostatic latent image are arranged at a side of an electrostatic latent image support member. In the apparatus, since toner in the developing devices is consumed by development, replenishment of toner corresponding to consumption of toner must be suitably performed.

However, when documents having much solid portion are continuously copied, amount of consumed toner per one copying operation is extremely large. Therefore, although replenishment of toner is performed, density of toner in the developer in using is lower than a required level, resulting an image on a copied paper sheet in poor quality. Furthermore, when the apparatus has such function that copying operation is stopped to wait during density of toner reaches the required level, the waiting timer period is long and it is necessary for next copying operation to wait for a long time.

SUMMARY OF THE INVENTION

Accordingly, an essential object of the present invention is to provide an image forming apparatus in which a waiting time period is less than before and many documents can be copied in a short time while keeping images of copied papers in good quality.

In accomplishing this and other objects, there is provided an image forming apparatus in which an electrostatic latent image formed on a photosensitive member is developed by a developer incorporating toner and carrier and subsequently transferred to a paper, the apparatus comprising: first and second developing means selectively operable for developing the electrostatic latent image by first and second developers, respectively; toner accommodating means for accommodating toner to be replenished to each of the developers; detecting means for detecting toner density in each of the developers; judging means for judging whether the first and second developers have same color; selecting means responsive to said detecting means and judging means for automatically selecting said second developing means in the case where the toner density in the first developer is less than a specified value and where the toner density in the second developer is not less than the specified value under the judgment by said judging means that the first and second developers have same color; replenishing means for replenishing toner to each of the first and second developers; and means for activating said replenishing means so as to continuously replenish toner to the first developer until the toner density therein reaches the specified value in the case where both of the toner density in the first and second developers are less than the specified value even if the first and second developers have same color, while prohibiting an image forming operation.

In another aspect of the present invention, an image forming apparatus in which an electrostatic latent image formed on a photosensitive member is developed by a developer incorporating toner and carrier and subsequently transferred to a paper, the apparatus comprising: first and second developing means selectively operable for developing the electrostatic latent image by first and second developers, respectively; toner accommodating means for accommodating toner to be replenished to each of the developers; detecting means for detecting toner density in each of the developers every image forming operation; first replenishing means responsive to said detecting means for replenishing a predetermined amount of toner from said respective toner accommodating means to the respective developer when the toner density detected by said detecting means is less than the specified value; means for counting the continuous number of replenishment by said first replenishing means; second replenishing means responsive to said counting means for continuously replenishing toner from said toner accommodating means to the respective developer until the toner density reaches the specified value when the continuous number of replenishment by said second replenishing means becomes a predetermined number; and means for prohibiting an image forming operation during replenishment by said second replenishing means.

In a further aspect of the present invention, an image forming apparatus in which an electrostatic latent image formed on a photosensitive member is developed by a developer incorporating toner and carrier and subsequently transferred to a paper, the apparatus comprising: first and second developing means selectively operable for developing the electrostatic latent image by first and second developers, respectively; toner accommodating means for accommodating toner to be replenished to each of the developers; detecting means for detecting toner density in each of the developers every image forming operation; first replenishing means for replenishing a first predetermined amount of toner to the respective developer when the toner density detected by said detecting means is not less than a specified value; second replenishing means responsive to said detecting means for replenishing a second predetermined amount of toner more than said first one to the respective developer when the toner density detected by said detecting means is less than the specified value; means for counting the continuous number of replenishment by said second replenishing means; third replenishing means responsive to said counting means for continuously replenishing toner to the respective developer until the toner density reaches the specified value when the continuous number of replenishment by said second replenishing means becomes a predetermined number; judging means for judging whether the first and second developers have same color; selecting means responsive to said detecting means, counting means and judging means for automatically selecting said second developing means in the case where the continuous number of replenishment to the first developer by said second replenishing means becomes the predetermined number and where the toner density in the second developer is not less than the specified value under the judgment by said judging means that the first and second developers have same color; and means responsive to said detecting means, counting means and judging means or prohibiting an image forming operation during replenishment to the first developer by said third replenishing means in the case where the continuous number of replenishment to the first developer by said second replenishing means becomes the predetermined number and where the toner density in the second developer is not less than the specified value even if the first and second developers have same color.

By the arrangement according to the present invention, in the case where documents having images with much solid portion are continuously copied, even if density of toner accommodated into the developing means in using is lower than the determined reference level, the device to be used is changed over from the developing means in using to the other developing means, so that the images are continuously developed by the other developing means having toner with the same color as that of the toner in the developing means using. Therefore, in the apparatus, a waiting time period is less than before and many documents can be copied in a short time while keeping images of copied papers in good quality.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
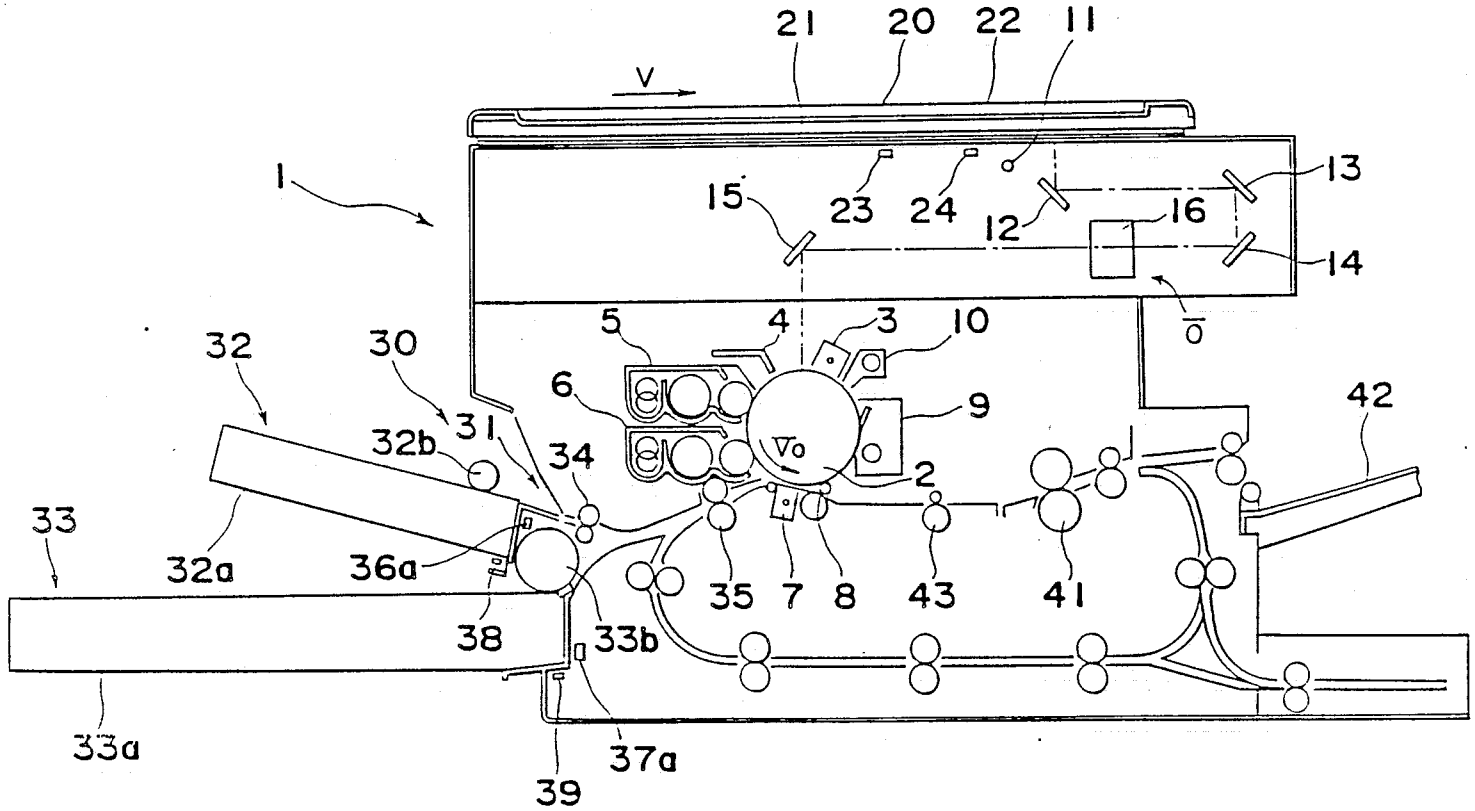
FIG. 1 is a schematic sectional view of a copying apparatus according to the present invention.

Before the description of the present invention proceeds, it is to be noted that like parts are designated by like reference numerals and symbols throughout the accompanying drawings.

I. General construction and operation

Referring now to the drawings, there is shown in FIG. 1, an image forming apparatus in the form of a movable original platform type two-color copying apparatus 1 to which the present invention may be applied. Hereinbelow, general construction and copying operation of the copying apparatus 1 are described.

Initially, in a state where a photosensitive or photoreceptor drum 2 is rotated in the direction of the arrow by a main motor (not shown), a transfer charger 7, an exposure lamp 11 of an optical system 0, etc. are turned on and the surface of the photosensitive drum 2 is electrically charged by a corona charger 3 on a precondition that electric charge of an image nonforming portion of the photosensitive drum 2 is erased by an eraser 4. It is to be noted that the image nonforming portion of the photosensitive drum 2 corresponding to an area of a glass plate 21, which is disposed forwardly of a front edge of an original document (not shown) placed on the glass plate 21 and rearwardly of a rear edge of the original document in a scanning direction of the original document, respectively.

When the photosensitive drum 2 and its peripheral devices have been set as described above, reflected light of light emitted from the exposure lamp 11 to the surface of the original document is projected onto the surface of the photosensitive drum 2 through mirrors 12, 13, 14 and 15 and a lens 16 while an original platform 20 is being displaced in the rightward direction of the arrow by a scanning motor (not shown). Thus, an electrostatic latent image corresponding to an image of the original document is formed on the surface of the photosensitive drum 2.

In response to rotation of the photosensitive drum 2, this electrostatic latent image is passed through areas confronting first and second developing devices 5 and 6. At this time, toners are supplied to the electrostatic latent image from the first and second developing devices 5 and 6 such that the electrostatic latent image is formed into a visible toner image.

Meanwhile, when the copying apparatus 1 is set to a black copying mode or a color copying mode, black toner or color toner is, respectively, supplied to the electrostatic latent image from the second developing device (black developing device) 6 or the first developing device (color developing device) 5. Meanwhile, when the copying apparatus 1 is set to a simultaneous color copying mode in which a two-color copy is obtained through changeover from the first developing device 5 to the second developing device 6 during one scanning operation, the color toner is supplied from the first developing device 5 to one portion of the electrostatic latent image, which corresponds to one portion of the original document extending from its front edge of scanning to a predetermined changeover point. Meanwhile, the black toner is supplied from the second developing device 6 to the other portion of the electrostatic latent image, which corresponding to the other portion of the original document extending from the changeover point to its rear edge.

A copy paper sheet is fed from a paper feeding mechanism 30 and is held in a waiting state at a location disposed upstream of timing rollers 35 in a paper feeding direction. The copy paper sheet in a waiting state is transported, synchronously with the image on the photosensitive drum 2, to an area where the photosensitive drum 2 and a transfer charger 7 confront each other. At this area, the toner image is transferred onto the copy paper sheet by the transfer charger 7.

The copy paper sheet having the toner image transferred thereon is separated from the surface of the photosensitive drum 2 by a separating belt 8 and is further conveyed by transport rollers 43 to a fixing device 41 where the toner image of the copy paper sheet is fixed, through fusion thereof, on the copy sheet. Finally, the copy paper sheet having the fixed toner image is ejected to a paper discharge portion 42.

Meanwhile, residual toner on the surface of the photosensitive drum 2 is removed by a cleaning device 9 so as to be collected into the cleaning device 9. Meanwhile, residual electric charge on the surface of the photosensitive drum 2 is erased by a main eraser 10 which is held in the ON state during drive of the main motor.

II. Various devices

Hereinbelow, the various devices constituting the copying apparatus are described in more detail.

(1) Optical system (0)

The optical system 0 is constituted by the exposure lamp 11 of slit exposure type, the mirrors 12 to 15 and the lens 16 which are secured in position as shown. Reflected light of light emitted from the exposure lamp 11 to the original platform 20 proceeds in a path shown by the one-dot chain lines so as to be projected, between the corona charger 3 and the eraser 4, onto the surface of the photosensitive drum 2.

(2) Original platform (20)

Figure 2:
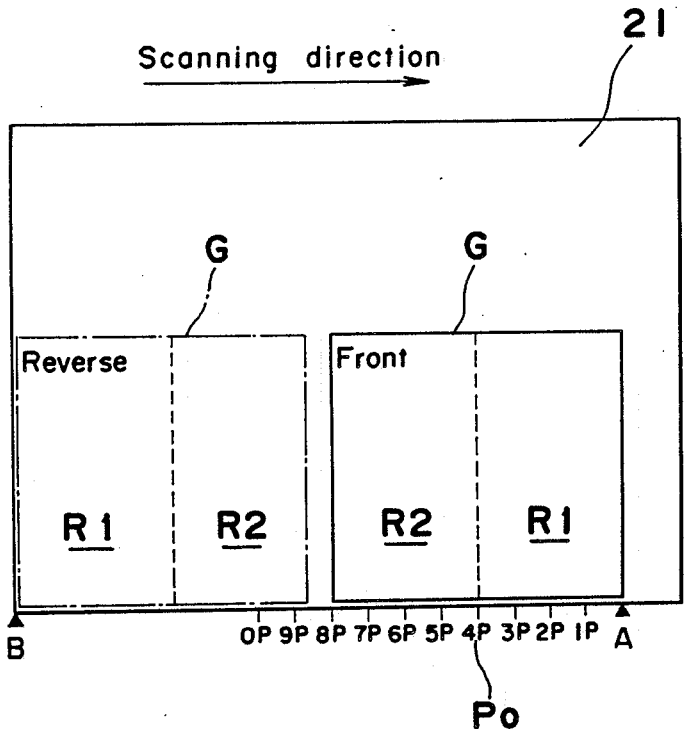
FIG. 2 is a top plan view of an original platform of the copying apparatus.

The original platform 20 is constituted by the glass plate 21 and an original holding plate 22 which can be opened or closed relative to the surface of the glass plate 21. The original platform 20 is displaced, for scanning, in the direction of the arrow at a speed V. Assuming that characters Vo and m denote a peripheral speed of the photosensitive drum 2 and a copying magnification, respectively, the following relation is established. $V = Vo/m$ As shown in FIG. 2, a starting-point mark A and point marks 1P to 0P are provided at intervals of 30 mm at one side of the glass plate 21, which is disposed at an operator's side. These marks A and 1P to 0P are used for designating the changeover point of the developing colors in the simultaneous color copying mode. Meanwhile, character B denotes a reference point for positioning an original document G at the time of actual copying of the original document G.

A positioning switch 23 and a register switch 24 are provided below the original platform 20. When scanning is not being performed, i.e. the copying apparatus 1 is at a stop, the original platform 20 is brought into contact with the positioning switch 23 so as to output a positioning signal to a first CPU (central processing unit) 200 to be described later. At the time when the glass 21 has been displaced, for scanning, through a predetermined distance, the original platform 20 is brought into contact with the register switch 24 so as to output to the first CPU 200 a register signal not only for actuating the timing rollers 35 but for effecting changeover between the first and second developing devices 5 and 6 at the time of simultaneous color copying.

Meanwhile, setting of the changeover point of the developing colors is performed as follows. As shown in FIG. 2, the original document G is placed on the glass plate 21 by orienting the front face of the original document G upwardly such that the right end of the original document G coincides with the starting-point mark A. Then, a desired changeover point Po of the developing colors is set.

For example, in the case where regions R1 and R2 of the original document G, which occupy right and left portions of the original document G separated from each other by the broken line, are developed in the color and black, the point mark 4P coinciding with the broken line is set as the changeover point Po by operating a color selection switch 121 and then keys 106 to 115 in a method to be described in detail later.

Subsequently, the original document G is turned over such that the front face of the original document G, which has an image thereon, is oriented downwardly and the left end of the original document G coincides with a reference point B as shown by the left one-dot chain line.

(3) Paper feeding mechanism (30)

The paper feeding mechanism 30 includes a manual paper feeding portion 31, a first paper feeding portion 32 having a cassette **32*a* and a second paper feeding portion 33 having a cassette 33*a*. A copy paper sheet inserted from the manual paper feeding portion 31 is transported, via intermediate rollers 34, to the timing rollers 35. Meanwhile, copy paper sheets in the cassette 32*a* loaded into the first paper feeding portion 32 are conveyed to the timing rollers 35 through a first paper feeding roller 32*b* and the intermediate rollers 34, while copy paper sheets in the cassette 33*a* loaded into the second paper feeding portion 33 are carried to the timing rollers 35 by way of a second paper feeding roller 33*b***.

The above described rollers **32*b*, 33*b*, 34 and 35 are detachably coupled with a drive unit of the main motor through clutches (not shown), respectively. By turning on the clutches of the respective rollers, the rollers are coupled with the drive unit so as to be driven for rotation thereof by the main motor. In the vicinity of the cassette 32*a*, there are provided a size sensor 36*a* for detecting size of the copy paper sheets contained in the cassette 32***a* and a cassette empty sensor 38 for detecting a state that all the copy paper sheets in the cassette 32*a* have been consumed. Likewise, in the vicinity of the cassette 33*a*, a size sensor 37*a* and a cassette empty sensor 39 are provided.

(4) Operating panel

Figure 3:
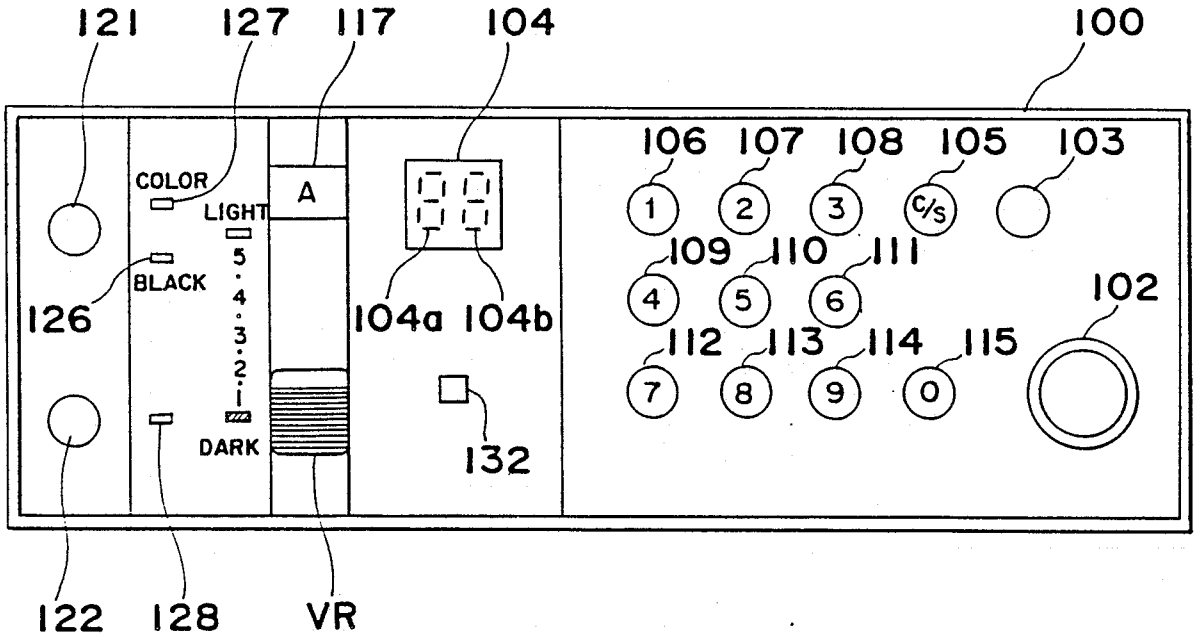
FIG. 3 is a top plan view of an operating panel of the copying apparatus.

At an upper portion of the copying apparatus 1, an operating panel 100 shown in FIG. 3 is provided. The operating pane 100 includes a print switch 102 for commanding start of copying, an automatic reset key 103 and a clear/stop key 105 not only for suspending copying immediately after start of copying or in the course of multi-copying for continuous copying an identical original document into a plurality of copies but for reinstating to a standard mode "1" the number of copies set at a copy quantity display portion 104 composed of groups of LEDs by clearing the number of copies set at the cop quantity display portion 104. The operating panel 100 further includes the ten keys 106 to 115 for setting the number of copies in the copy quantity display portion 104, an exposure volume VR for manually increasing or decreasing exposure amount from the exposure lamp 11, a selection switch 117 for selecting an automatic exposure mode in which an optimum exposure amount is automatically set for an original document, a selection key (not shown) for selecting one of the first and second paper feeding portions 32 and 33, an LED (not shown) for displaying size of the copy paper sheets fed from the selected one of the first and second paper feeding portions 32 and 33, a color selection key 121 for selecting one of the first and second developing devices 5 and 6 and LEDs 127 and 126 for displaying the selected one of the first and second developing devices 5 and 6, respectively.

Furthermore, the operating panel 100 includes an LED 132 for displaying a state that the selected one of toner replenishment bottles 81 and 91 mounted on the first and second developing devices 5 and 6 is empty, a selection key 122 for selecting a book division mode and an LED 128 for displaying a state that the book division mode is selected. Although not specifically shown, the operating panel 100 includes a switch for starting drying of the photosensitive drum 2 and a switch for starting forcible replenishment of the toner.

(5) Developing device

Figure 4:
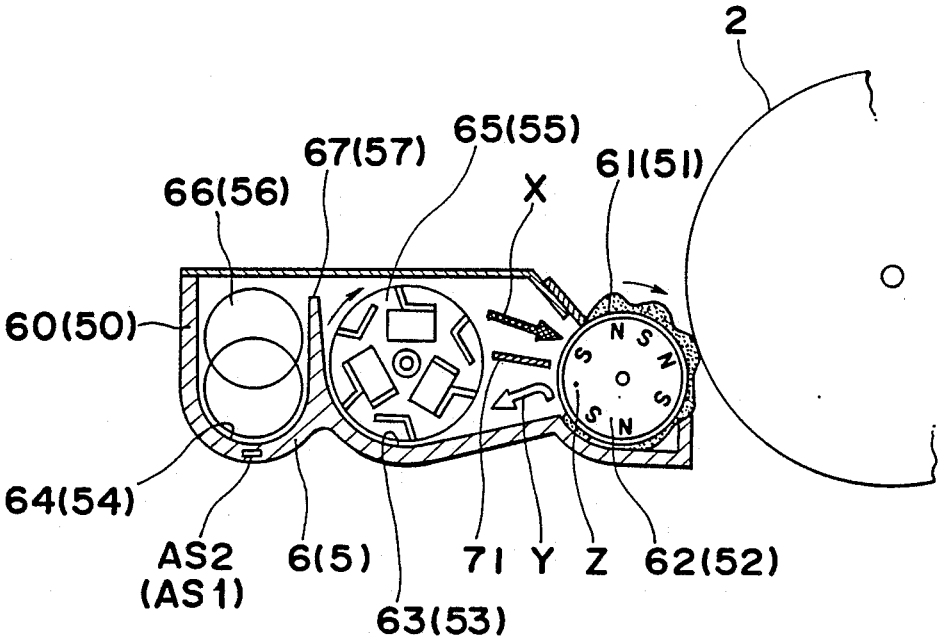
FIGS. 4 and 5 are sectional views of a developing device of the copying apparatus.
Figure 5:
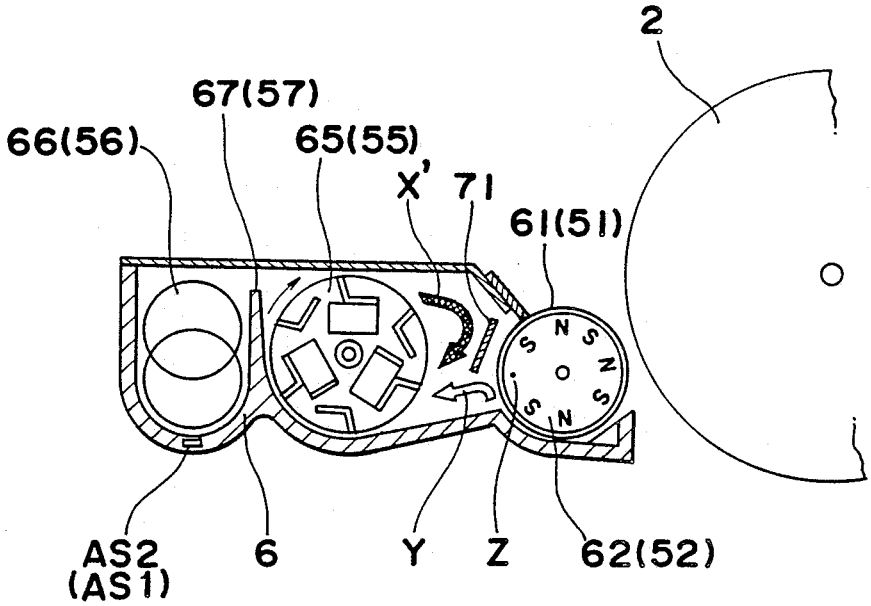

The developing devices 5 and 6 are of a type employing two-component developer composed of toner and carrier. Initially, the second developing device 6 disposed at the downstream side in the rotational direction of the photosensitive drum 2 is described with reference to FIGS. 4 and 5, hereinbelow. It is to be noted that numerals in parentheses in FIGS. 4 and 5 represent components of the first developing device 5.

(a) Construction of the second developing device (6)

In the second developing device 6, a developing sleeve 61 is rotatably provided at a front portion of a casing 60 so as to confront the photosensitive drum 2. A developing bias voltage of −150V is applied to the developing sleeve 61. A magnetic roller 62 is fixedly provided in the developing sleeve 61. In the magnetic roller 62, a plurality of magnets having axially extending magnetic poles S and N are arranged as shown. At an outer peripheral portion of the magnetic roller 62 opposite to the photosensitive drum 2, two S-poles are provided adjacent to each other so as to form a magnetized portion Z having two neighboring magnetic poles of an identical polarity.

At a rear portion of the developing sleeve 61, transport passages 63 and 64 are formed and a bucket roller 65 and a transport roller 66 are rotatably provided at the transport passages 63 and 64, respectively. The transport passages 63 and 64 are partially separated from each other by a partition wall 67 upwardly extending from the casing 60. However, although not specifically shown, the transport passages 63 and 64 are communicated with each other through openings formed at far and near sides of the partition wall 67 as observed in a direction perpendicular to the sheet of FIGS. 4 and 5.

Meanwhile, at a bottom portion of the rear transport passage 64, a toner density sensor AS2 for detecting, as change of permeability, density of the toner in the two-component developer composed of the toner and the carrier (referred to as an "ATDC (automatic toner density control) sensor", hereinbelow) is provided such that its detection face is brought into contact with the developer in the transport passage 64. An output signal of the ATDC sensor AS2 is applied to the first CPU 200 of a control circuit to be described later.

Meanwhile, in the copying apparatus 1 in which a plurality of the developing devices 5 and 6 are provided around the photosensitive drum 2, the following problems may arise. Namely, if the developer of the second developing device 6 is held in contact with the photosensitive drum 2 in the case where development is performed by using the first developing device 5, the toner image formed on the surface of the photosensitive drum 2 by the first developing device 5 is disturbed by the developer of the second developing device 6. Meanwhile, if the developer of the first developing device 5 is held in contact with the photosensitive drum 2 in the case where development is performed by using the second developing device 6, the electrostatic latent image on the photosensitive drum 2 is initially developed by the first developing device 5, thereby resulting in mixing of colors.

Therefore, as a first countermeasure for preventing such mixing of colors, a bristle shutter 71 is provided between the developing sleeve 61 and the bucket roller 65 in the second developing device 6. When development is performed by using the first developing device 5, the developer held on the surface of the developing sleeve (second developing device) 61 is removed therefrom by using the bristle shutter 71. The bristle shutter 71 can be changed over the states of FIGS. 4 and 5 by a changeover means 70 shown in FIG. 7.

(b) Changeover means (70)

Figure 7:
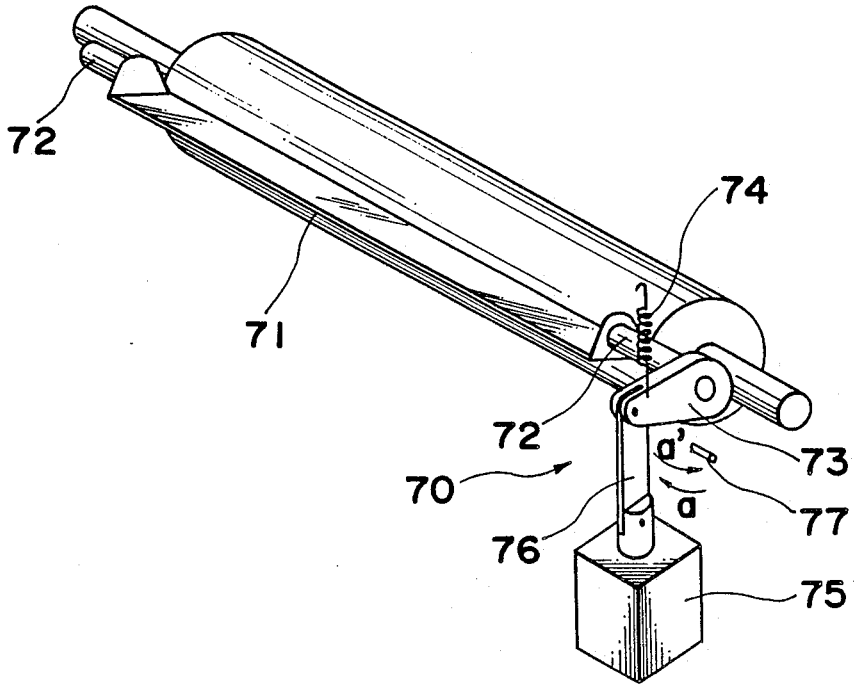
FIG. 7 is a perspective view of a bristle regulating mechanism of the copying apparatus of FIG. 1.

As shown in FIG. 7, the bristle shutter 71 is rotatably attached to the casing 60 through a pair of support shafts 72 and 72 secured to opposite ends of the bristle shutter 71. A lever 73 is secured to one of the support shafts 72 and 72. A spring 74 having one end attached to the casing 60 is fitted to a distal end portion of the lever 73 so as to urge the lever 73 in the direction of the arrow a. Meanwhile, a plunger 76 of a solenoid is rotatably coupled with the lever 73 such that the lever 73 is held in a stable state. Reference numeral 77 denotes a stopper.

Therefore, when the solenoid 75 is in the OFF state, the bristle shutter 71 is urged by the spring 74 into the OFF state of FIG. 4. On the other hand, when the solenoid 75 is turned on, the lever 73 is rotated in the direction of the arrow a′ against the urging force of the spring 74 so as to be brought into contact with the stopper 77, so that the bristle shutter 71 is set to the ON state of FIG. 5.

(c) First developing device (5)

The first developing device 5 is substantially identical, in construction, with the second developing device 6 and numerals in parentheses in FIGS. 4 and 5 represent components of the second developing device 6. Namely, as in the second developing device 6, transport passages 53 and 54 separated from each other by a partition wall 57 are formed in a casing 50. Furthermore, a developing sleeve 51, a magnetic roller 52, a bucket roller 55 and a transport roller 56 are accommodated in the casing 50 as shown. In addition, an ATDC sensor ASl is secured in the transport passage 54.

However, the first developing device 5 is different from the second developing device 6 in that in the first developing device 5, the bristle shutter 71 is not provided and a developing bias voltage (first developing bias voltage) (not shown), serving as a second countermeasure for preventing the mixing of colors, applied to the first developing sleeve 51 can be changed over to two stages of −150V and −300V. Hence, the first developing device 5 is not provided with the changeover means 70 for the bristle shutter 71.

Meanwhile, the first and second developing devices 5 and 6 are coupled, for drive thereof, with the main motor (not shown) such that the driving force of the main motor is selectively transmitted to only one of the developing devices 5 and 6 by a sleeve solenoid (not shown).

Namely, when the main motor is coupled, for drive thereof, with the first developing sleeve 51, the driving force of the main motor is not transmitted to the second developing sleeve 61. On the contrary, when the main motor is coupled, for drive thereof, with the second developing sleeve 61, the driving force of the main motor is not transmitted to the first developing sleeve 51.

Furthermore, although it is constructed such that the developing devices 5 and 6 are selectively changed over by the sleeve solenoid as described above, a drive means such as motor can be provided in the first and second developing devices 5 and 6, respectively, so that each device is independently driven.

(d) Toner replenishment mechanism and toner color detection mechanism

Figure 6:
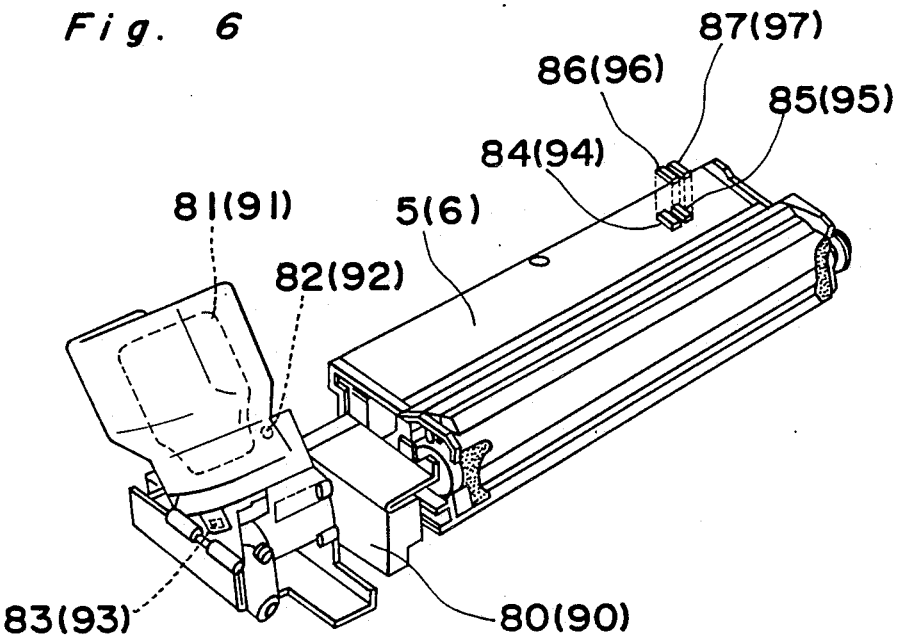
FIG. 6 is a perspective view of a toner replenishment mechanism of the copying apparatus.

FIG. 6 shows a toner replenishment mechanism for replenishing the first developing device 5 with toner. Since a toner replenishment mechanism for replenishing the second developing device 6 with toner is identical, in construction, with the toner replenishment mechanism for replenishing the first developing device 5 with toner, numerals in parentheses represent the toner replenishing mechanism for the second developing device 6.

A bracket 80 is mounted on one end of the developing device 5. The toner replenishment bottle 81 for replenishing toner to the rear transport passage 54 in the developing device 5 is detachably mounted on the bracket 80 so as to replenish the toner while being rotated by a replenishment motor (not shown).

In the vicinity of the toner replenishment bottle 81, a sensor 82 for detecting presence and absence of the toner replenishment bottle 81 is provided such that presence and absence of the bottle 81 are judged by ON and OFF signals of the sensor 82. A toner empty sensor 83 for detecting presence and absence of the toner in the bottle 81 is provided at a mouth of the bottle 81. Magnets 84 and 85 for detecting color of toner contained in the casing 50 are attached, side by side, to an upper portion of the developing device 5.

Meanwhile, first and second reed switches 86 and 87 are provided at the copying apparatus so as to confront the magnets 84 and 85, respectively, in a state where the first developing device 5 is mounted on the copying apparatus. As shown in Table 1 below, the color of the toner contained in the first developing device 5 is judged by combination of ON and OFF signals of the first and second reed switches 86 and 87.

TABLE 1

| First switch (86) | Second switch (87) | Toner |
|---|---|---|
| ON | ON | Black |
| ON | OFF | Red |
| OFF | ON | Yellow |
| OFF | OFF | Blue |

If the first developing device 5 contains red toner, only the magnet 84 corresponding to the first reed switch 86 is attached to the first developing device 5 and the magnet 85 corresponding to the reed switch 87 is not attached to the first developing device 5 so that only the first reed switch 86 is turned on.

(e) Developing operation

In the developing devices 5 and 6 of the above described arrangement, the two-component developer composed of the toner and the carrier is contained in the casings 50 and 60, respectively. Namely, the color toner and the black toner are, respectively, contained in the first and second developing devices 5 and 6. The developer is transported, for its circulation, through the transport passages 54 and 53 upon rotation of the transport roller 56 and the bucket roller 55 in the first developing device 5 and through the transport passages 64 and 63 upon rotation of the transport roller 66 and the bucket roller 65 in the second developing device 6. At this time, the toner and the carrier are mixed with each other into the two-component developer of uniform concentration and the toner is electrically charged through frictional contact between the toner and the carrier.

Meanwhile, in the course of transport of the developer, a portion of the developer is supplied to the surface of the developing sleeve 51 or 61 and is held in a state of the magnetic brush along lines of magnetic force generated from the magnetic roller 52 or 62.

The developer held on the surface of the developing sleeve 51 or 61 is transported in a state of a magnetic brush in the direction of the arrow through rotation of the developing sleeve 51 or 61 and the magnetic brush is brought into sliding contact with the surface of the photosensitive drum 2 at an area confronting the photosensitive drum 2. Thus, on the basis of difference between surface potential of the photosensitive drum 2 and the developing bias voltage applied to the developing device 5 or 6, the magnetic brush is transferred to the electrostatic latent image formed on the surface of the photosensitive drum 2 so as to develop the electrostatic latent image into the visible toner image.

The developer having passed through the area confronting the photosensitive drum 2 is successively conveyed in the direction of the arrow through rotation of the developing sleeve 51 or 61. When the developer on the developing sleeve 51 or 61 reaches an area confronting the bucket roller 55 or 65, the developer is separated from the surface of the developing sleeve 51 or 61 by action of a repulsive magnetic field formed by the magnetized portion Z having two neighboring magnetic poles of an identical polarity and is mixed into the developer into the transport passage 53 or 63.

Meanwhile, the bristle shutter 71 is provided in the second developing device 6. Thus, if the developing device 6 is driven when the bristle shutter 71 is in the OFF state of FIG. 4, the developer discharged from the bucket roller 65 towards the developing sleeve 61 is guided by the bristle shutter 71 so as to proceed in the direction of the arrow X such that the developer is supplied to the surface of the developing sleeve 61. On the other hand, the developer separated from the developing sleeve 61 is carried below the bristle shutter 71 so as to be collected from the direction of the arrow Y into the transport passage 63.

However, even if the developing device 5 is driven in the ON state of the bristle shutter 71 shown in FIG. 5, the developer discharged from the bucket roller 65 towards the developing sleeve 61 is blocked by the bristle shutter 71 so as to return in the direction of the arrow X', so that the developer is not supplied to the surface of the developer sleeve 61. Meanwhile, the developer held on the surface of the developing sleeve 61 is collected into the transport passage 63 in the same way as the above-described and thus, substantially no developer is present on the developing sleeve 61. Therefore, when development is performed in this state by using the first developing device 5, such a phenomenon does not take place that the toner image formed by the first developing device 5 is disturbed by the developer of the second developing device 6.

By repetition of the above described developing operation in the developing devices 5 and 6, the toners in the developing devices 5 and 6 are gradually consumed, thereby resulting in drop of density of the toners.

When it is detected from a signal outputted from the ATDC sensor AS1 or AS2 to a microcomputer to be described later that the above described toner density has dropped lower than a predetermined control level, the toner is replenished from the toner replenishment bottle 81 or 91 to the transport passage 54 or 64 in response to a signal from the microcomputer. This newly replenished toner is conveyed through the transport passages 54 and 53 by the transport roller 56 and the bucket roller 55 in the first developing device 5 and through the transport passages 64 and 63 by the transport roller 66 and the bucket roller 65 in the second developing device 6 so as to be mixed with the carrier such that the two-component developer is adjusted.

(6) Circuit configuration

Figure 8:
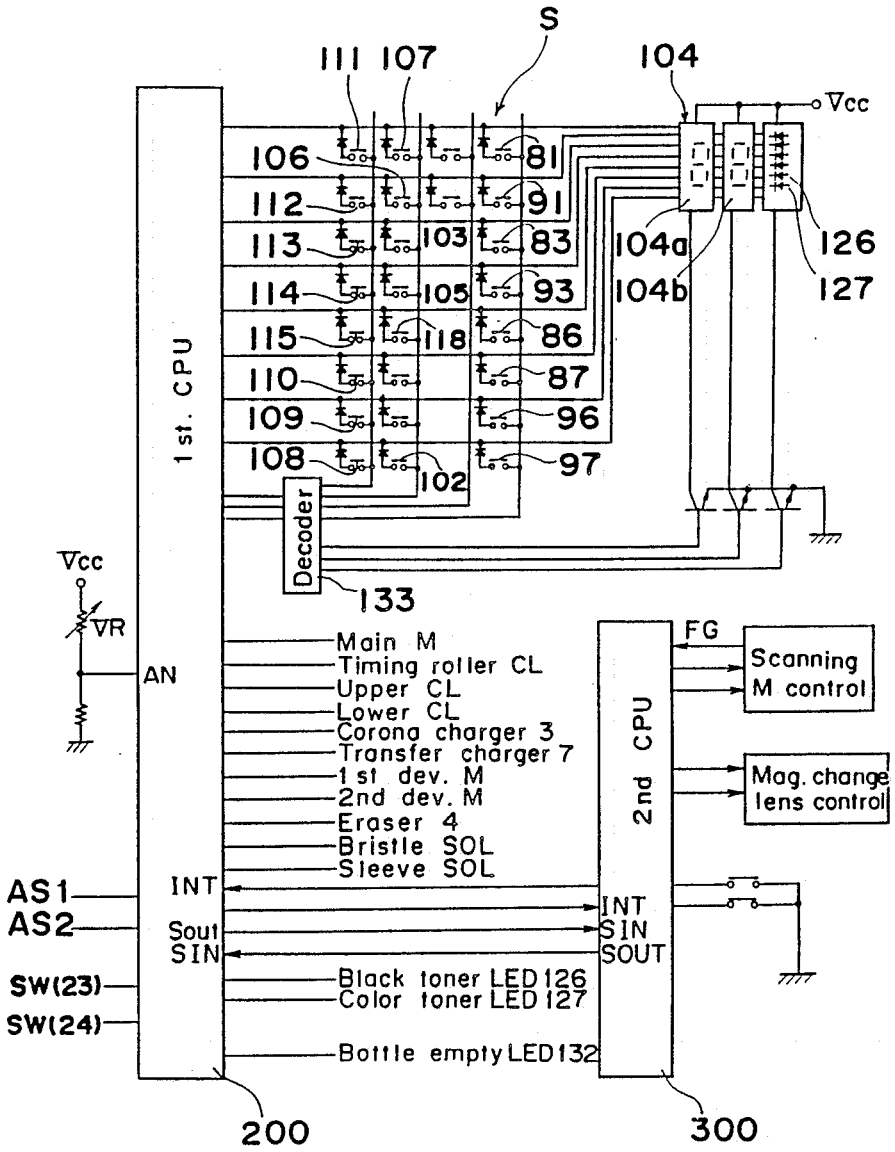
FIG. 8 is a circuit diagram of control of the copying apparatus of FIG. 1.

The copying apparatus 1 incorporates the microcomputer (not shown) and the microcomputer has such a circuit configuration as shown in FIG. 8. In FIG. 8, the microcomputer includes the first CPU 200 and a second CPU 300. A key matrix S including the various keys on the operating panel 100, the first and second toner empty sensors 83 and 93, the first and second bottle empty sensors 82 and 92, the reed switches 84, 85, 94 and 95, etc. arranged in a pattern of a matrix, the ATDC sensors AS1 and AS2, the positioning switch 23 and the register switch 24 are connected to the first CPU 200. The main motor, the various roller clutches, etc. are operated and controlled by the first CPU 200 upon operation of the various keys and actuation of the various sensors and the various LEDs including the copy quantity display portion 104 having display portions 104*a* and 104*b* are turned on and off by the first CPU 200 through a decoder 133.

On the other hand, the positioning switch 23, the register switch 24, etc. are connected to the second CPU 300. The second CPU 300 is mainly used or operating and controlling the optical system 0. In order to synchronize the first and second CPUs 200 and 300 with each other, the first and second CPUs 200 and 300 are connected to each other. III. Control Hereinbelow, control procedures of the copying apparatus 1 are described with reference to the accompanying flow charts.

Figure 15:
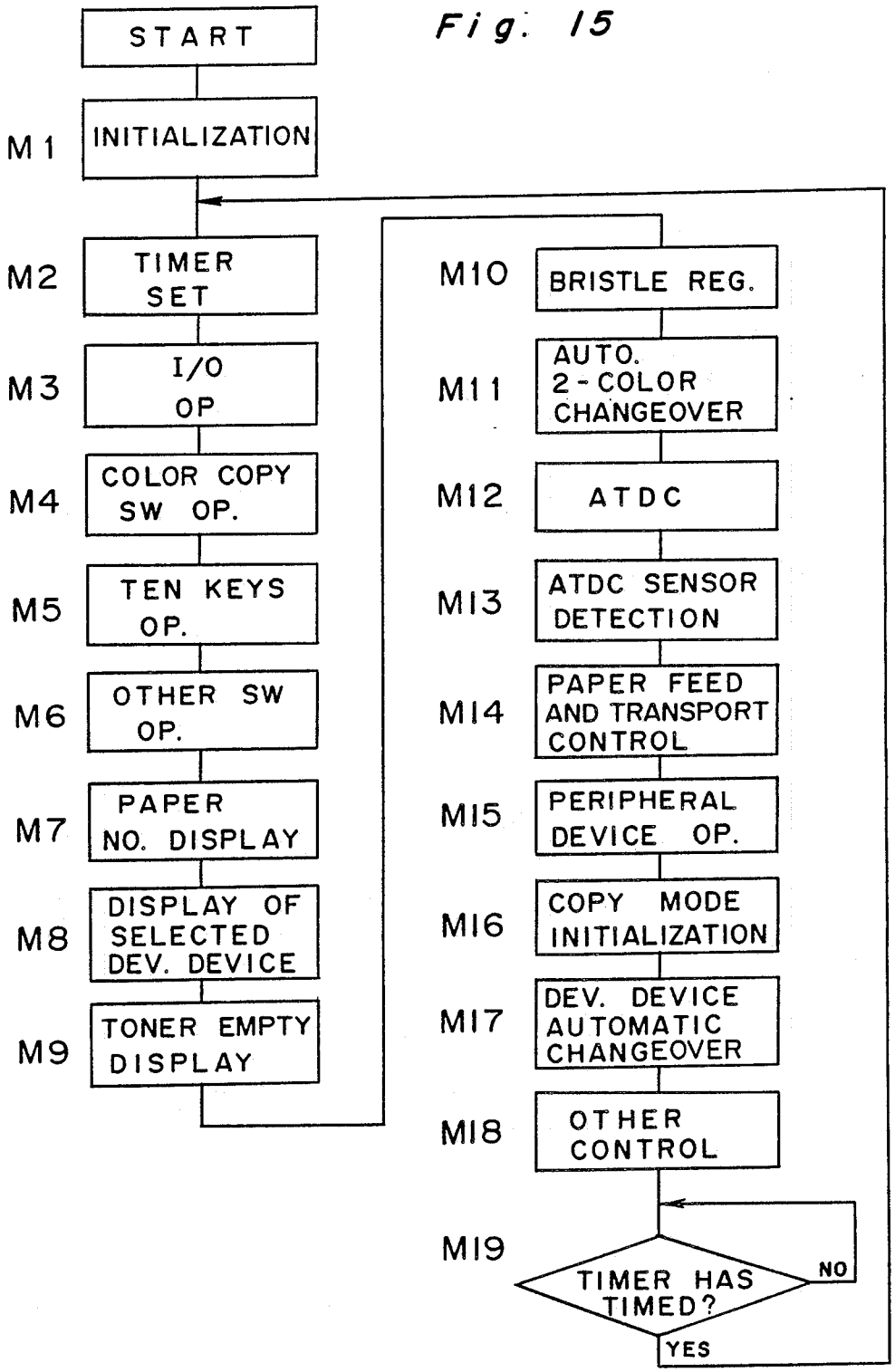
FIG. 15 is a flow chart of a main routine of processing sequences of operation of the copying apparatus of FIG. 1.

(1) Main routine (FIG. 15)

In a main routine of the control procedures of the copying apparatus 1, when operation of the microcomputer is started by turning on a power source of the copying apparatus 1, initial values of various parameters are set at step M1. At step M2, an internal timer is started. This internal timer is reset at the preceding step M1 and is used for determining a time period for executing one routine of the main routine. Various timers to be described in the following subroutines decide lapse of their preset time periods by the numbers of counts in one routine of the internal timer.

Then, each of subroutines of steps M3 to M18 is sequentially called. When proceeding of all the subroutines has been completed, lapse of the preset time period of the internal timer is waited for at step M19 and then, the program flow returns to step S2. Meanwhile, the steps M3 to M6 are subroutines for processing signals inputted from the various keys of the operating panel 100. Namely, the step M3 is a subroutine for processing input and output signals, the step M4 is a subroutine for processing a signal from the color selection key 121, the step M5 is a subroutine for processing a signal inputted from the ten keys 106 to 115 and the step M6 is a subroutine for processing signals of other switches.

Steps M7 to M9 are a process for controlling display of the operating panel 100. Namely, the step M7 is a subroutine for displaying, at the display portion 104 of the operating panel 100, the changeover point Po in the simultaneously color copying mode or the number of copies. The step M8 is a subroutine for displaying the developing device to be used in accordance with the copying modes. The step M9 is a subroutine for displaying a toner empty state.

Steps M10 to M13 are subroutines for controlling operation of the developing devices 5 and 6. Namely, the step M10 is a subroutine for processing the bristle shutter 71. The step M11 is a subroutine for effecting changeover of drive of the developing devices 5 and 6 in the simultaneous color copying mode. The steps M12 and M13 are subroutines for controlling density of the toners in the developing devices 5 and 6.

Step M14 is a subroutine for controlling transport of copy paper sheets of the paper feeding mechanism 30, etc. Step M15 is a subroutine for controlling the photosensitive drum 2 and its peripheral devices. Step M16 is a subroutine for initializing copying mode of the copying apparatus. Step M17 is a subroutine for effecting changeover of use of other developing device in the state where though usual toner replenishment is performed, the value of toner density is not over the predetermined value. Step M18 is a subroutine for processing other controls.

Hereinbelow, the subroutines for controlling operation the copying apparatus according to the present invention are described.

(2) Subroutines

Hereinbelow, the subroutines for controlling operation of the copying apparatus 1 are described. Meanwhile, the relation between copying mode flags FCOLOR and F2COLOR and black, color and simultaneous color copying mode used in the following subroutines is set as shown in Table 2 below. At the time the power source of the copying apparatus 1 has been turned on, the copying mode flags FCOLOR and F2COLOR are set to 0 at the initialization subroutine (step M1) of the main routine so as to set to the black copying mode.

TABLE 2

| Copying mode | FCOLOR | F2COLOR |
|---|---|---|
| Black | 0 | 0 |
| Color | 1 | 0 |
| Simultaneous color | 1 | 1 |

(A) Bristle regulating subroutine (step M10)

Figure 10:
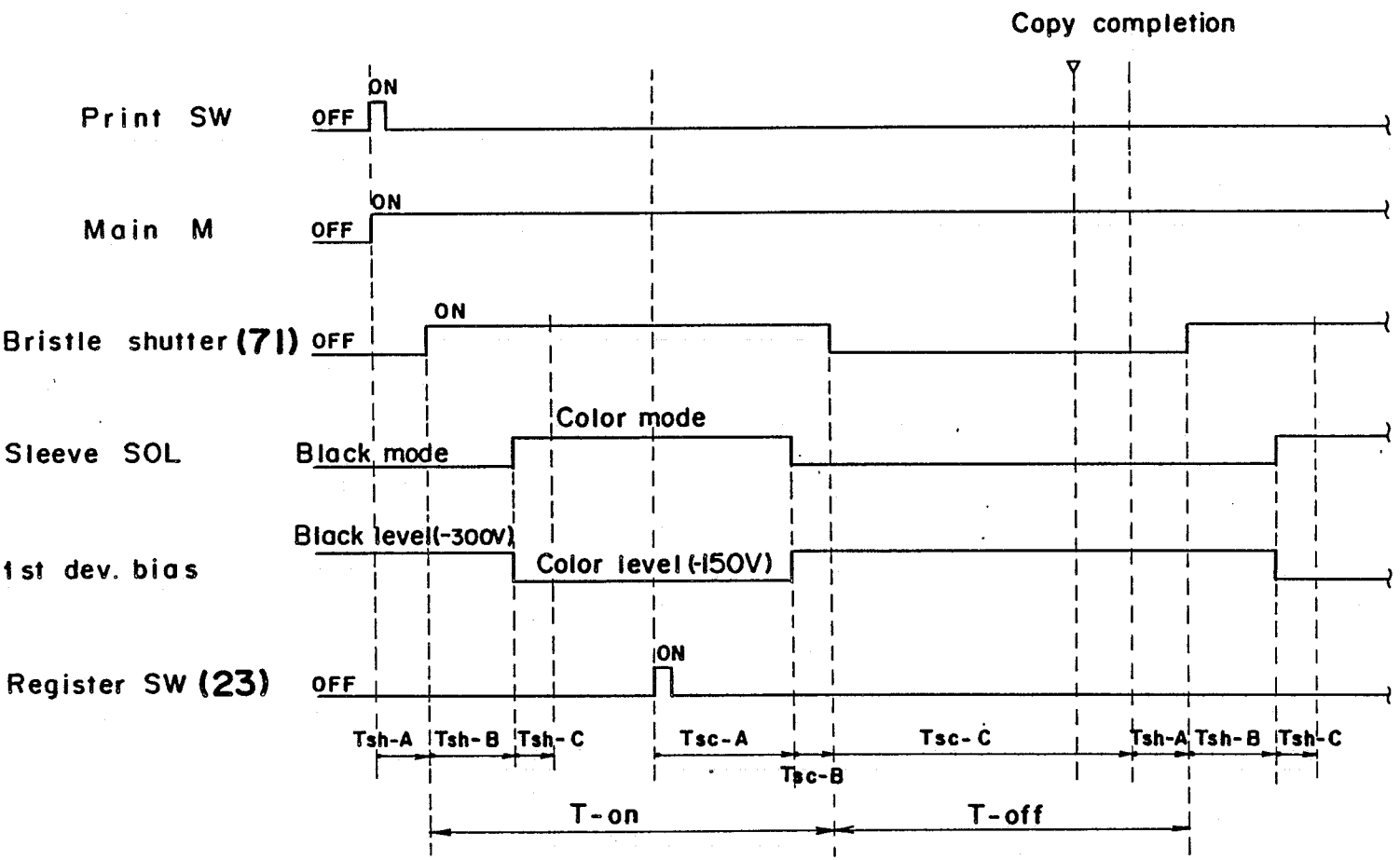
FIGS. 10, 11 and 12 are timing charts indicative of operation of a bristle regulating shutter, etc. at the time of simultaneous color copying, color copying and black copying in the copying apparatus of FIG. 1, respectively.
Figure 11:
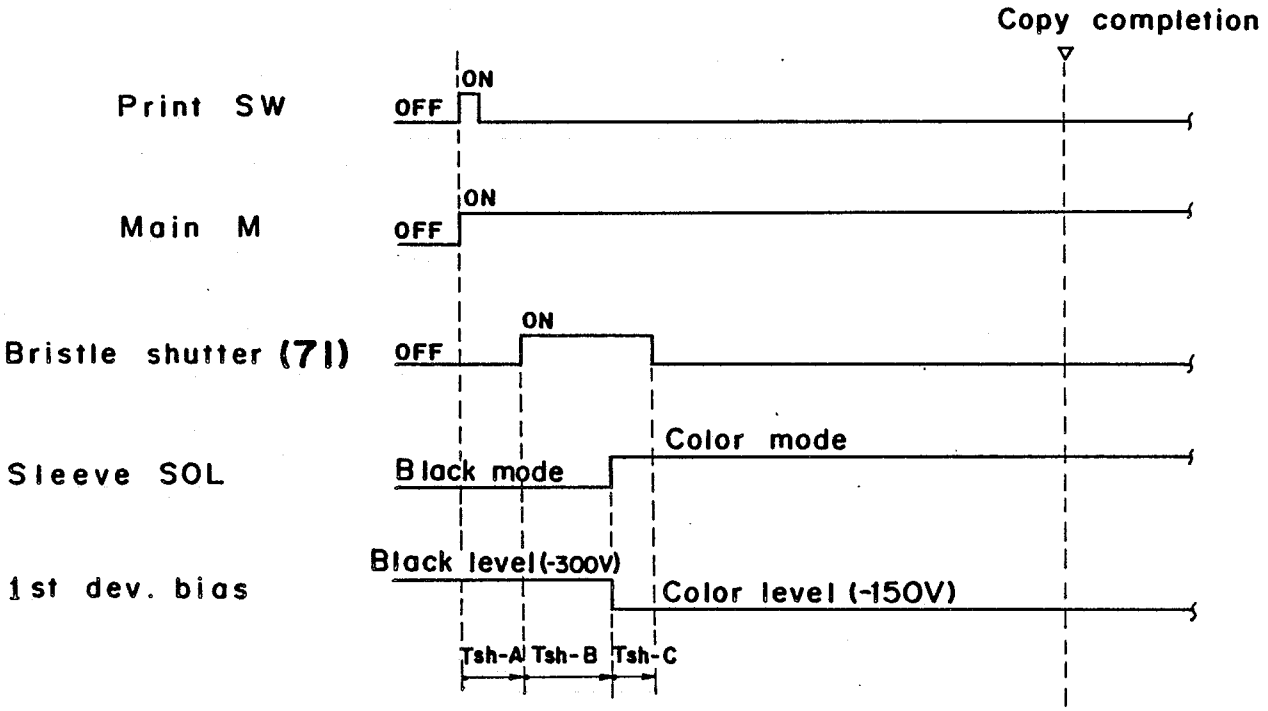
Figure 12:
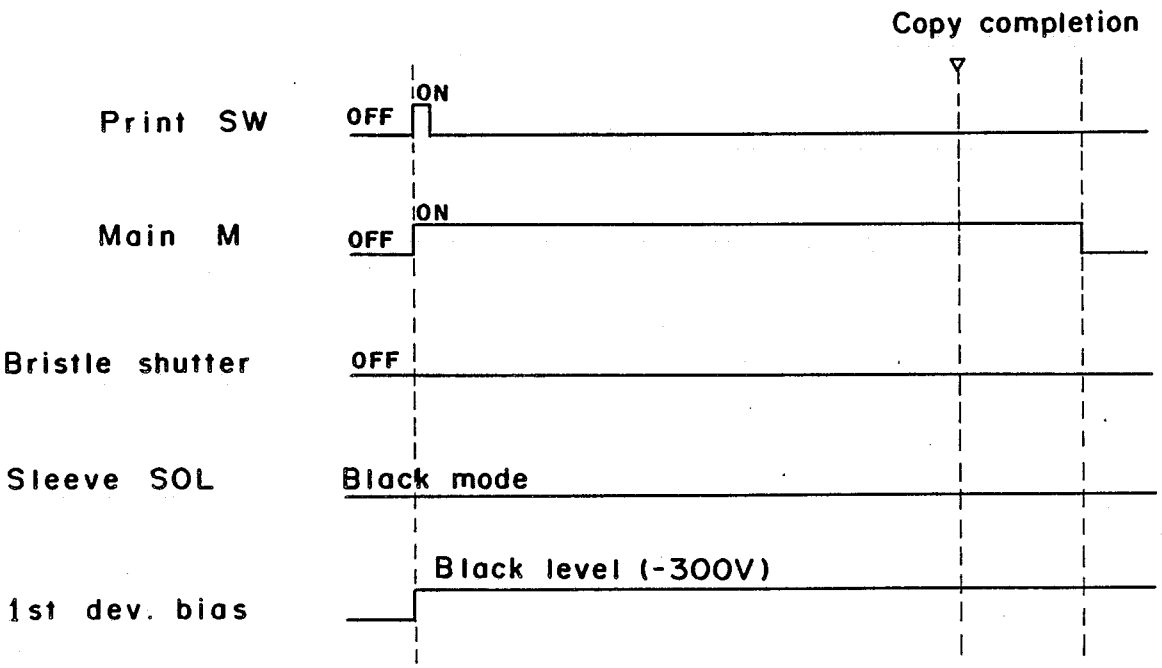
Figure 13:
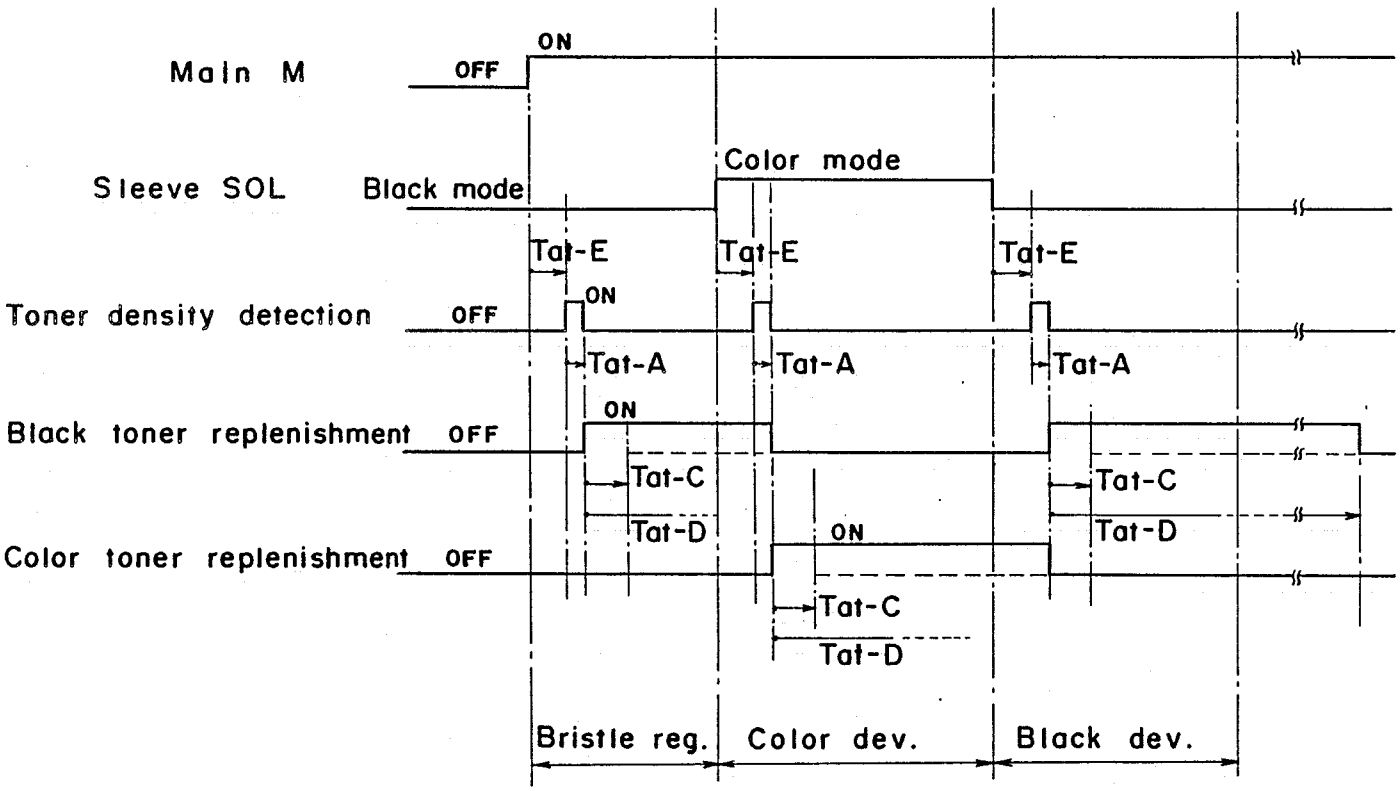
FIGS. 13 and 14 are timing charts indicative of control of replenishment at the time of simultaneous color copying, color copying and black copying.
Figure 14:
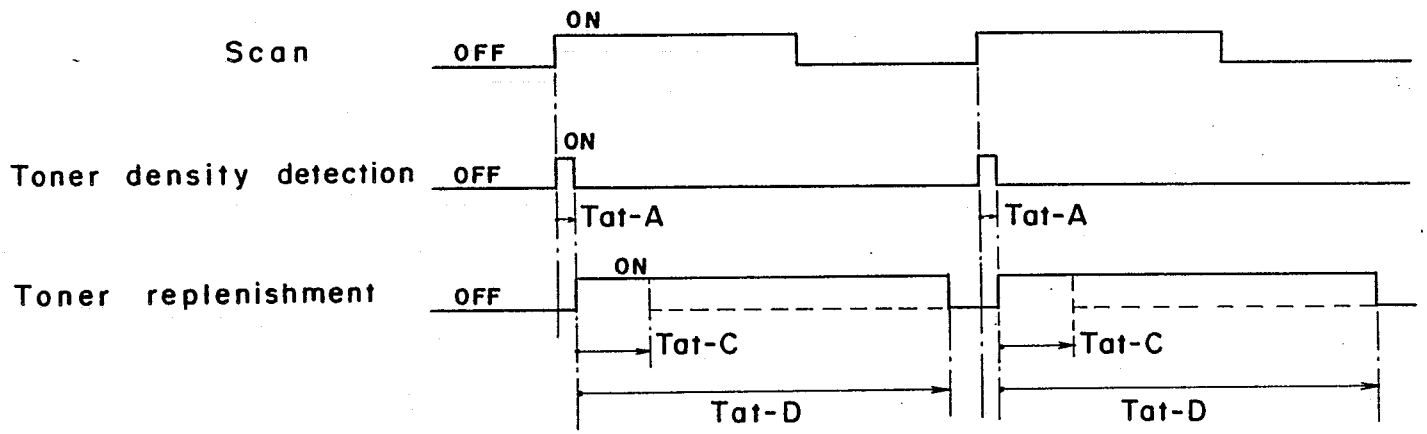

For this bristle regulating subroutine, reference should be made to flow charts of FIGS. 16 to 27 and timing charts of FIGS. 10 to 12. In this bristle regulating subroutine, changeover among the bristle shutter 71 of the second developing device 6, the drive units of the first and second developing devices 5 and 6 and the first developing bias voltage is performed in accordance with conditions at each point of time.

Figure 16:
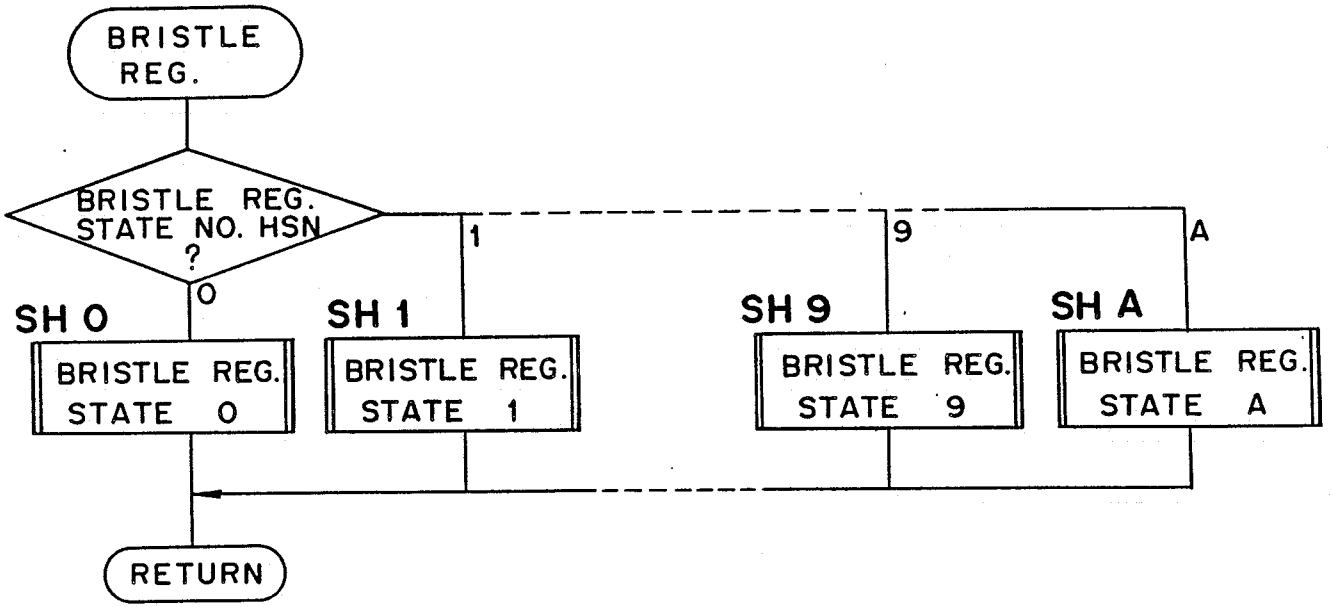
FIG. 16 is a flow chart of a subroutine for bristle regulation in the copying apparatus of FIG. 1.

In the bristle regulating subroutine, a bristle regulation state No. HSN is judged in accordance with the flow chart of FIG. 16. On the basis of values of the bristle regulation state No. HSN, the program flow proceeds to steps SH0 to SHA for predetermined bristle regulation states 0 to A, respectively. Meanwhile, when the power source of the copying apparatus 1 has been turned on, the bristle regulation state No. HSN is set to 0 at the initialization subroutine M1 of the main routine and thus, the program starts from the bristle regulation state 0.

Figure 17:
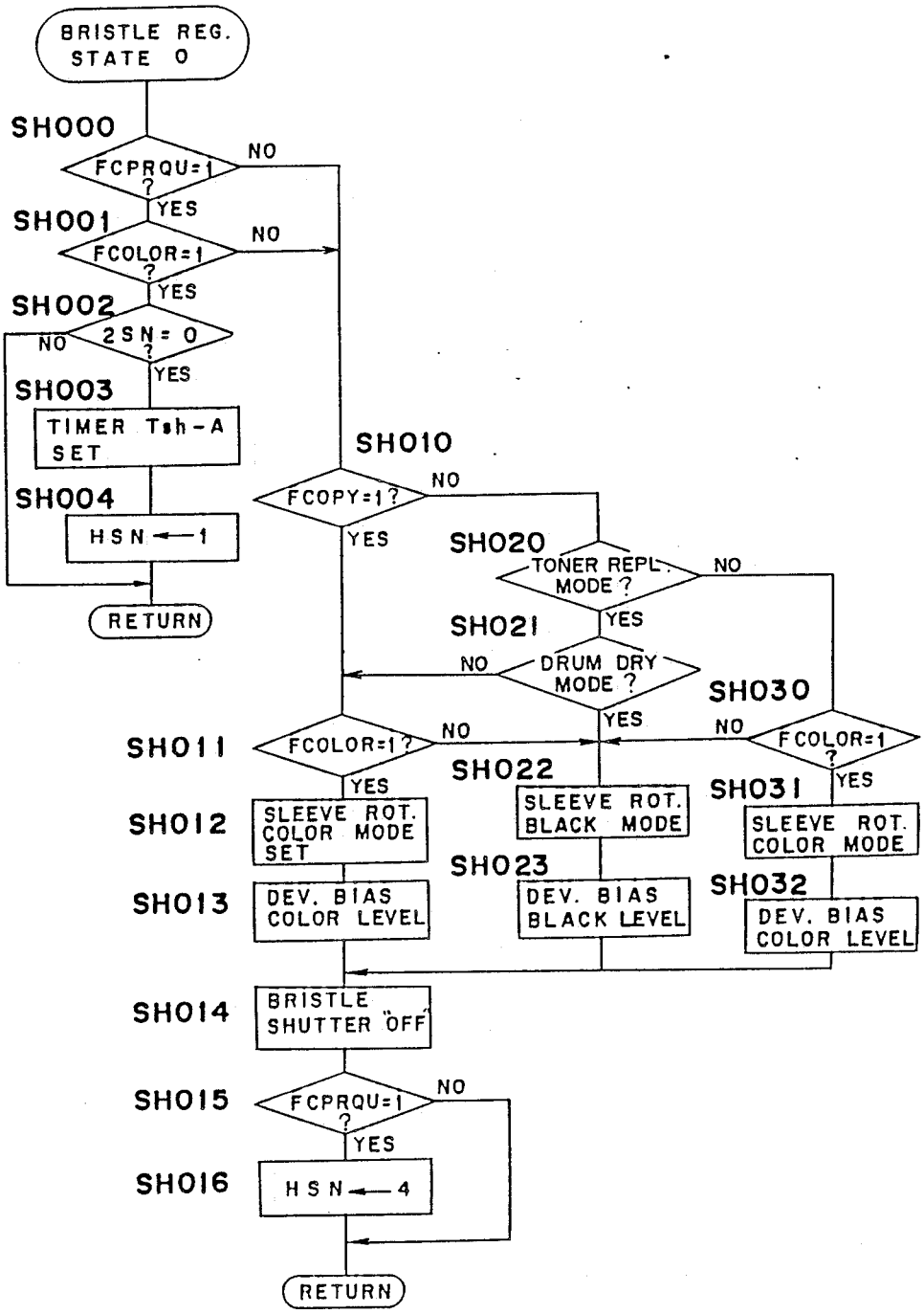
FIGS. 17 to 27 are flow charts showing bristle regulating states in the copying apparatus of FIG. 1.

Bristle regulation state 0 (FIG. 17)

In the bristle regulation state 0, it is found at step SH000 that a flag FCPRQU, which is set by through turning-on of the print switch 102, indicating that there is a demand for copying is 1. If it is detected that the flag FCPRQU is 1, the main motor has been turned on. Then, at step SH001, a decision is made as to whether either the simultaneous color copying mode or the color copying mode is selected or the black copying mode is selected. If either the simultaneous color copying mode or the color copying mode is selected, the program flow proceeds to steps SH002 to SH004. If the black copying mode is selected, the program flow proceeds to step SH010.

Then, in the case of the simultaneous color copying mode r the color copying mode, a decision is made at step SH002 as to whether or not a 2-color state No. 2SN set in an automatic 2-color changeover subroutine to be described later is set to 0. In the case of "YES" at step SH002, a timer Tsh-A for delaying turning on of the bristle shutter 71 is set at step SH003 and the bristle regulation state No. HSN is set to 1 at step SH004 and then, the program flow returns. Reference should be made to a time chart of the simultaneous color copying mode of FIG. 10 and a time chart of the color copy mode of FIG. 11. This timer Tsh-A is used for starting bristle regulation after the developing sleeve 61 of the second developing device 6 has been fully rotated.

When the copying apparatus 1 is in a waiting state (FCPRQU=0) or the black copying mode (FCOLOR=0) is selected, the program flow proceeds to step SH010 at which a decision is made as to whether or not a flag FCOPY indicating that copying is being performed is set to 1.

Subsequently, in the case of the "NO" (FCOPY=0) at step SH010, a decision is made at step SH020 as to whether or not a toner replenishment mode is selected and then, a decision is made at step SH021 as to whether or not a drum dry mode for drying the photosensitive drum 2 is selected. Furthermore, the copying mode is judged at steps SH011 and SH030. In accordance with the selected copying modes, the drive units of the developing devices and the developing bias voltages are set to predetermined states in the subsequent steps SH012 to SH014, SH022, SH023, SH031 and SH033.

Namely, if the black copying mode is selected, at steps SH022 and SH023, the main motor is coupled with the second developing device 6 for drive thereof so as to be set to a black mode, while the first and second developing bias voltages are set to a black level, i.e. −300V and −150V, respectively. Reference should be made to a time chart of the black copying mode of FIG. 12.

On the other hand, if the color copying mode or the simultaneous color copying mode is selected, the main motor is coupled with the first developing device 5 for drive thereof so as to be set to a color mode, while the first and second developing bias voltages are set to a color level, i.e. −150V. If the toner replenishment mode is selected at steps SH020 and SH021 and the drum dry mode is selected, in spite of the copying mode, the units of the developing device is set to the black copying mode and the developing bias voltage is set to the black level.

Subsequently, at step SH014, the bristle shutter 71 is turned off and then, at step SH015, a decision is made as to whether or not there is a demand for copying. If it is found at step SH015 that the flag FCPRQU is 1, the bristle regulation state No. HSN is set to 4 so as to execute the black copy at step SH016 and then, the program flow returns such that changeover of rotation of the developing sleeves, the developing bias voltages and the bristle shutter 71 is prohibited during the subsequent copying. Meanwhile, if the flag FCPRQE is 0, the program flow returns so as to be in a waiting state.

Figure 18:
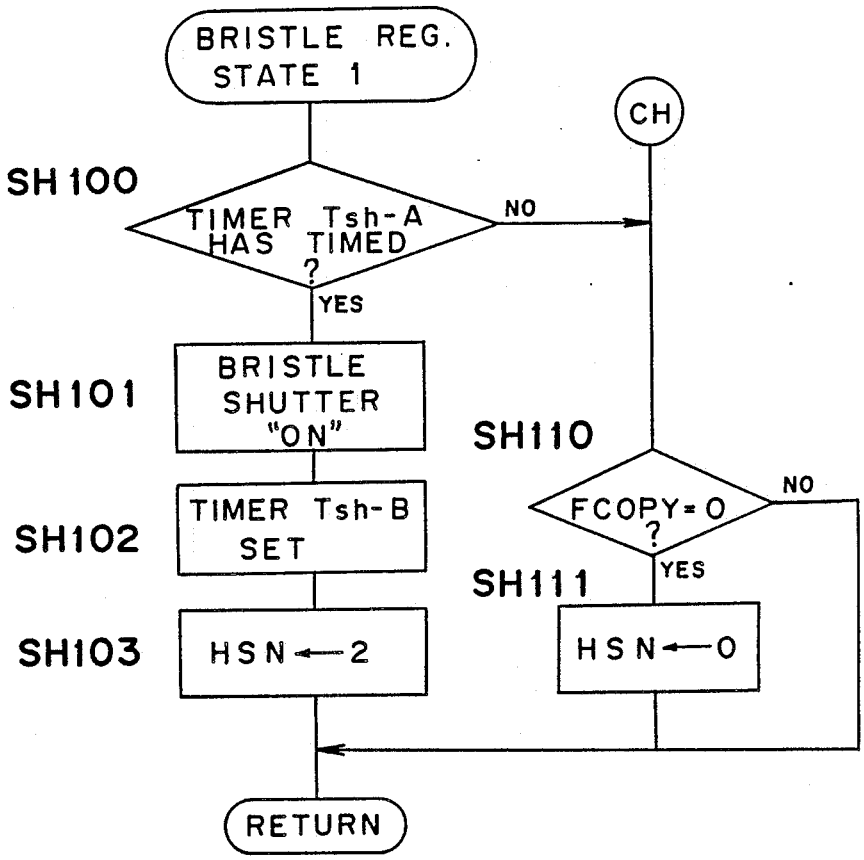

Bristle regulation state 1 (FIG. 18)

In the bristle regulation state 1, a decision is made at step SH100 as to whether or not the timer Tsh-A set at the above described step SH003 has timed. In the case of "YES" at step SH100, the bristle shutter 71 is set to the ON state of FIG. 5 at step SH101, a timer Tsh-B for removing the black toner is. set at step SH102 and the bristle regulation state No. HSN is set to 2 at step SH103 and then, the program flow returns. Meanwhile, the timer Tsh-B is used for removing the developer from the surface of the second developing sleeve 61 by the bristle shutter 71 prior to start of color developing, so that the color toner image formed by the first developing device 5 is not disturbed at an area confronting the second developing device 6. On the other hand, if the timer Tsh-A is counting a preset time period, a decision is made at step SH110 as to whether or not copying is being performed. If copying is being performed, copying operation is continued. If copying is not performed since copying is interrupted by the clear/stop key 105, etc., the bristle regulation state No. HSN is set to 0 at step SH111 and the program flow returns.

Figure 19:
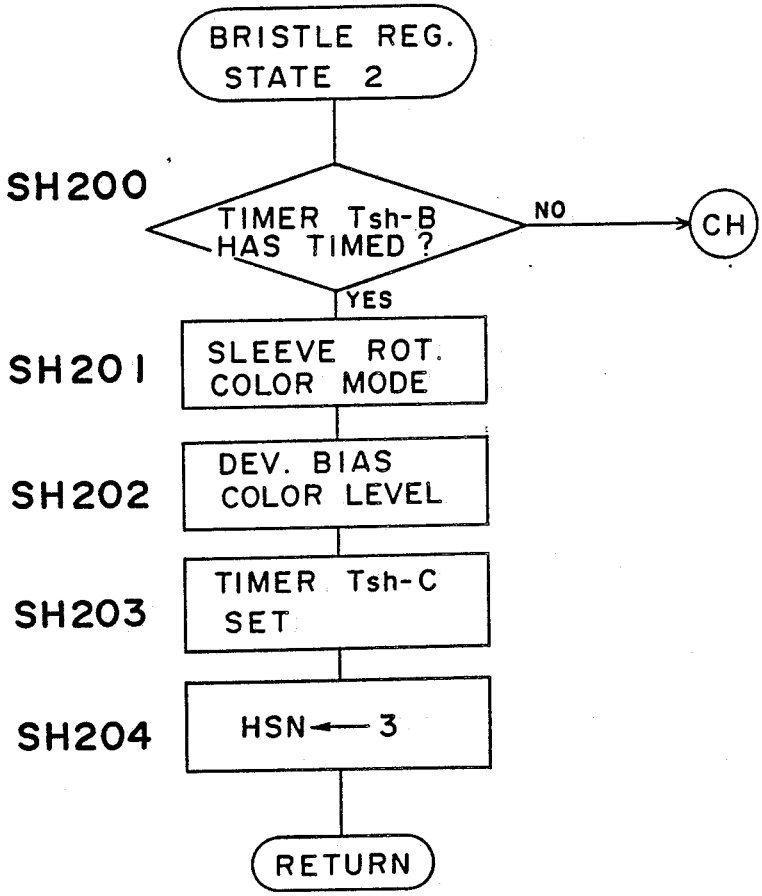

Bristle regulation state 2 (FIG. 19)

In the bristle regulation state 2, a decision is made at step SH200 as to whether or not the timer Tsh-B has timed. If the timer Tsh-B is counting a preset time period, the program flow proceeds to step SH110 and SHlll so as to remain in a waiting state. On the other hand, when the developer on the second (black) developing sleeve 61 has been removed after completion of counting of the timer Tsh-B, steps SH201 to SH204 are executed and the program flow returns.

Meanwhile, at step SH201, rotation of the developing sleeve is changed over to the color copying mode such that the developing sleeve 51 of the first developing device 5 is started, while the second developing device 6 is stopped. At step SH202, the first developing bias voltage is changed from the black level of −300V to the color level of −150V. At step SH203, a timer Tsh-C for delaying turning off of the bristle shutter 71 is set and the bristle regulation state No. HSN is set to 3 at step SH204 such that the copying apparatus 1 is set to a state enabling color copying.

Figure 20:
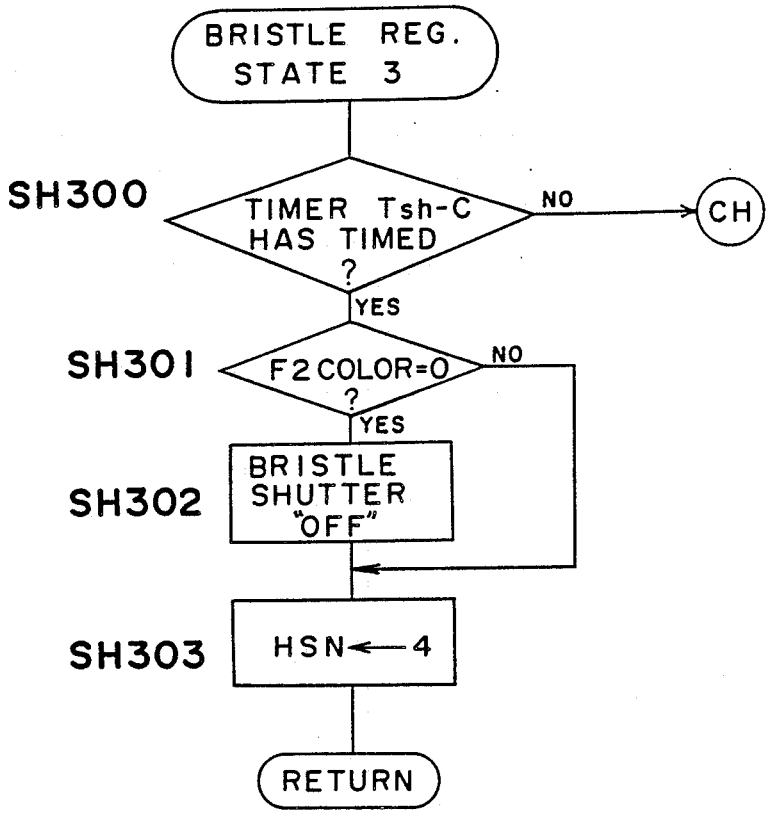

Bristle regulation state 3 (FIG. 20)

In the bristle regulation state 3, if the timer Tsh-C is counting a present time period, the program flow proceeds to step SH110 and SH111 so as to remain in a waiting state at step SH300. If the timer Tsh-C has timed at step SH300, a decision is made at step SH301 as to whether or not the simultaneous color copying mode is selected. In the case of "YES" at step SH301, the program flow skips step SH302 for turning off the bristle shutter 71 so as to proceed to step SH303 at which the bristle regulation state No. HSN is set to 4.

Namely, if it is found at step SH301 that the simultaneous color copying mode is selected, the bristle shutter 71 is set in the ON state of FIG. 5 until black development is started by the second developing device 6.

In the case of the color copying mode, the program flow proceeds from step SH301 to step SH302 at which the bristle shutter 71 is turned off, as shown in a time chart of FIG. 11. Then, at step SH303, the bristle regulation state No. HSN is set to 4 at step SH303 and the program flow proceeds to the bristle regulation state 4. This program schema is employed on the following ground. Namely, in the color copying mode, etc., if the developer has been removed from the surface of the second developing sleeve 61 by turning on the bristle shutter 71, the black developer is not supplied onto the second developing sleeve 61 subsequently, so that color copying can be continued without any problem. Then, upon lapse of a preset time period of a timer Tsc-C to be described later, the bristle shutter 71 is changed over to the OFF state.

Figure 21:
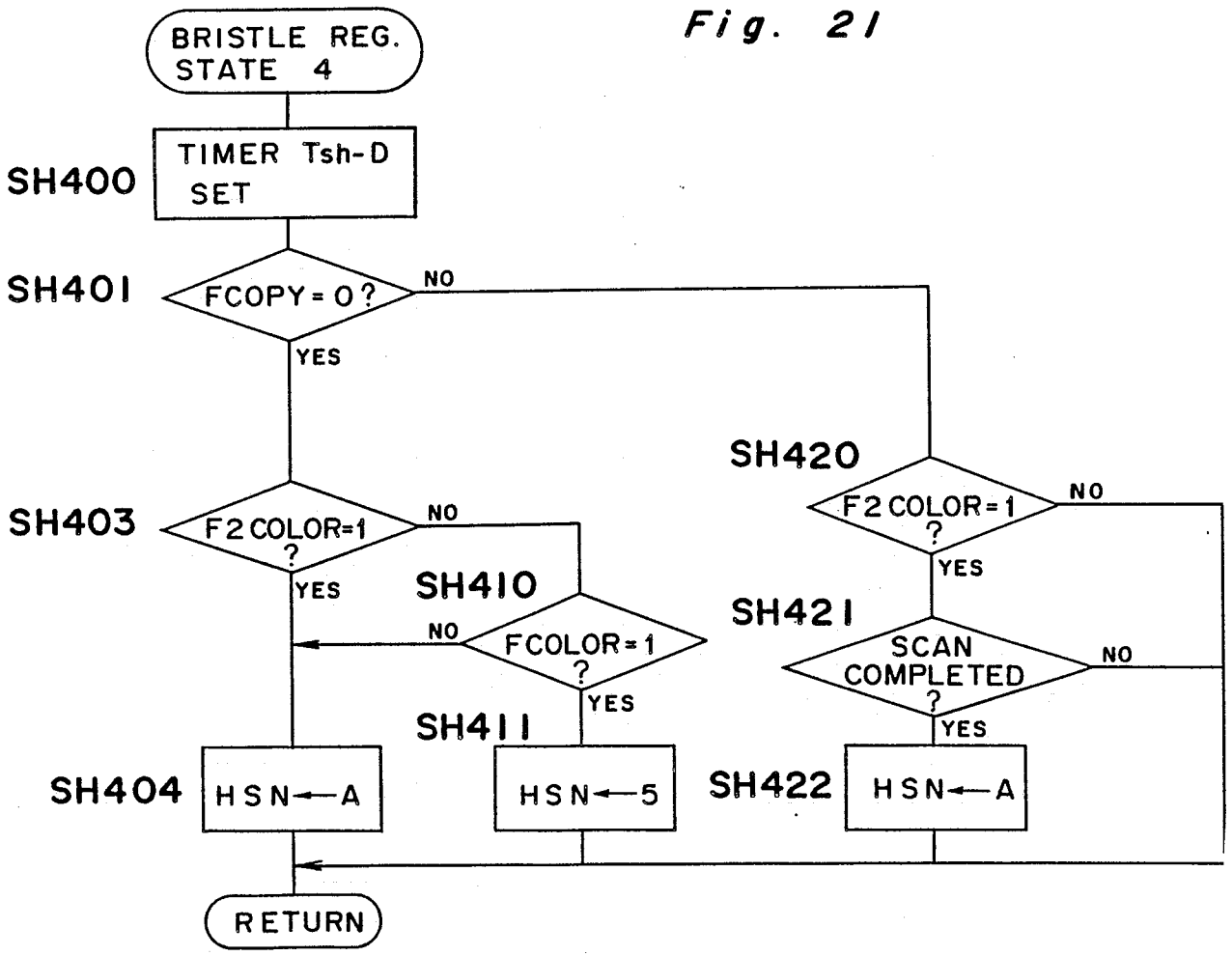

Bristle regulation state 4 (FIG. 21)

In the bristle regulation state 4, a timer Tsh-D for delaying permission of mode change is set at step SH400. Then, at step SH401, a decision is made as to whether or not copying is being performed. In the case of "NO" at step SH401, a decision is made at step SH420 as to whether or not the flag F2COLOR is 1 and then, a decision is made at step SH421 as to whether or not scanning has been completed. If not only the simultaneous color copying mode is selected but scanning is being performed, the bristle regulation state No. HSN is set to A at step SH422 and then, the program flow returns.

Meanwhile, in the case of "NO" at least either one of steps SH420 and SH421, the program flow returns. In the case of the simultaneous color copying mode, bristle regulation and changeover of the sleeve solenoid and the developing bias voltage in the waiting state are controlled in an automatic 2-color control subroutine to be described later. In the case of the color copying mode, the bristle regulation state 4 is maintained until completion of copying.

Meanwhile, in the waiting state, a timer Tsh-D is repeatedly set at step SH400. However, since there is no step for judging whether or not the timer Tsh-D has timed during execution of the bristle regulation state 4, a series of operations are not controlled by the timer Tsh-D.

If it is found at step SH401 that the copy flag FCOPY is 0, namely copying has been completed, the copying mode is judged at steps SH403 and SH410. If the simultaneous color copying mode or the black copying mode is selected, the bristle regulation state No. HSN is set to A at step SH404 and the program flow returns. Meanwhile, if the color copying mode is selected, the bristle regulation state No. HSN is set to 5 at step SH411 and the program flow returns.

Meanwhile, if changeover of the developing bias voltage and rotation of the developing sleeve are performed immediately when changeover of the copying mode has been performed, for example, the color copying mode has been changed over to the black copying mode immediately after completion of copying, the black toner adheres to a trailing edge portion of the color copy. In order to prevent such a phenomenon, the timer Tsh-D is used for prohibiting change over of the copying mode until a point on the photosensitive drum 2 has passed through at least an interval from the exposure position to an area confronting the developing device 6.

Figure 22:
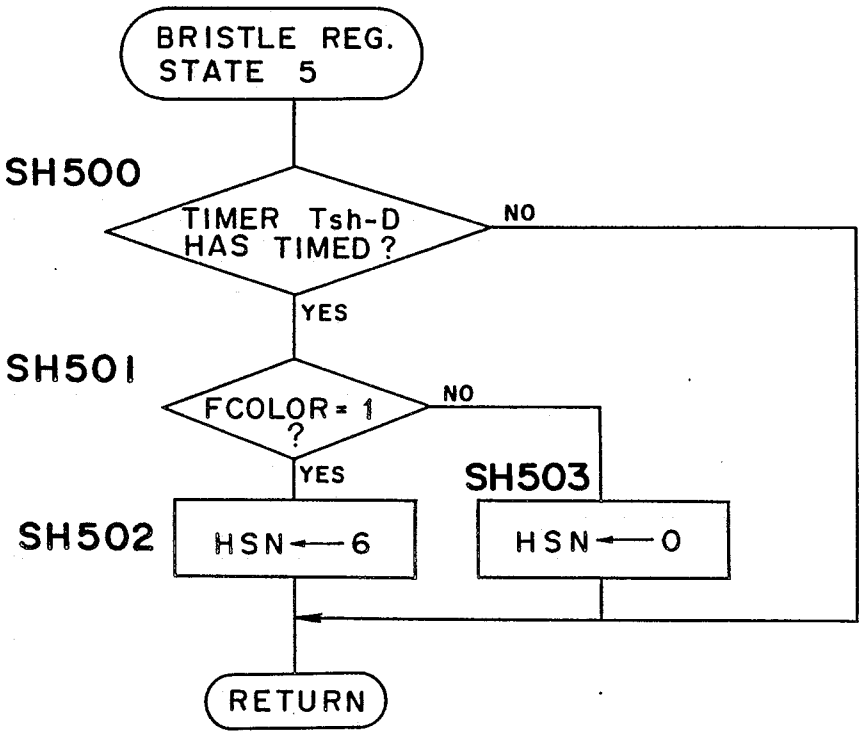

Bristle regulation state 5 (FIG. 22)

The bristle regulation state 5 is designed to perform processing after copying. At step SH500, a decision is made as to whether or not the timer Tsh-D has timed. In the case of "YES" at step SH500, a decision is made as to whether or not the flag FCOLOR is 1. In the case of "YES" at step SH501, namely if the color copying mode or the simultaneous color copying mode is selected, the bristle regulation state No. HSN is set to 6 at step SH502 such that bristle regulation is not performed again when the next copying is performed in the color copying mode.

On the other hand, if the flag FCOLOR is 0, namely the black copying mode is selected, the bristle regulation state No. HSN is set to 0 at step SH503 such that preparation for immediately starting black copying is made.

Figure 23:
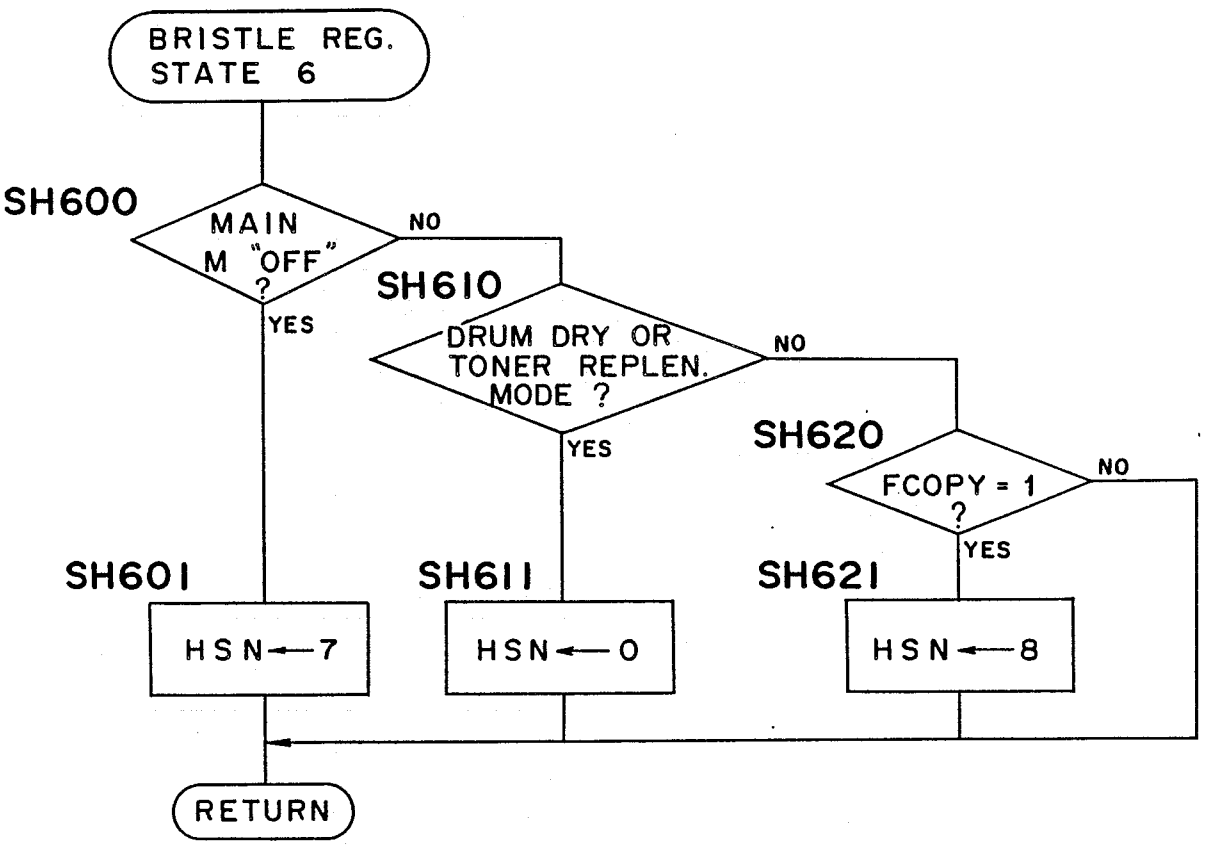

Bristle regulation state 6 (FIG. 23)

In the bristle regulation state 6, a decision is made at step SH600 as to whether or not the main motor is in the OFF state. In the case of "YES" at step SH600, the bristle regulation state No. HSN is set to 7 at step SH601. Meanwhile, if it is found at step SH610 that a drum dry mode for drying the photosensitive drum 2 or a toner replenishment mode is started prior to stop of the main motor, the bristle regulation state No. HSN is set to 0 at step SH611. In the case of "NO" at step SH610, the program flow proceeds to step SH620.

At step SH620, a decision is made as to whether or not the copy flag FCOPY is 1. If copying is restarted prior to stop of the main motor, the bristle regulation state No. HSN is set to 8 at step SH621. Namely, if copying is started successively after completion of copying, the program flow proceeds to the bristle regulation state 8.

Figure 24:
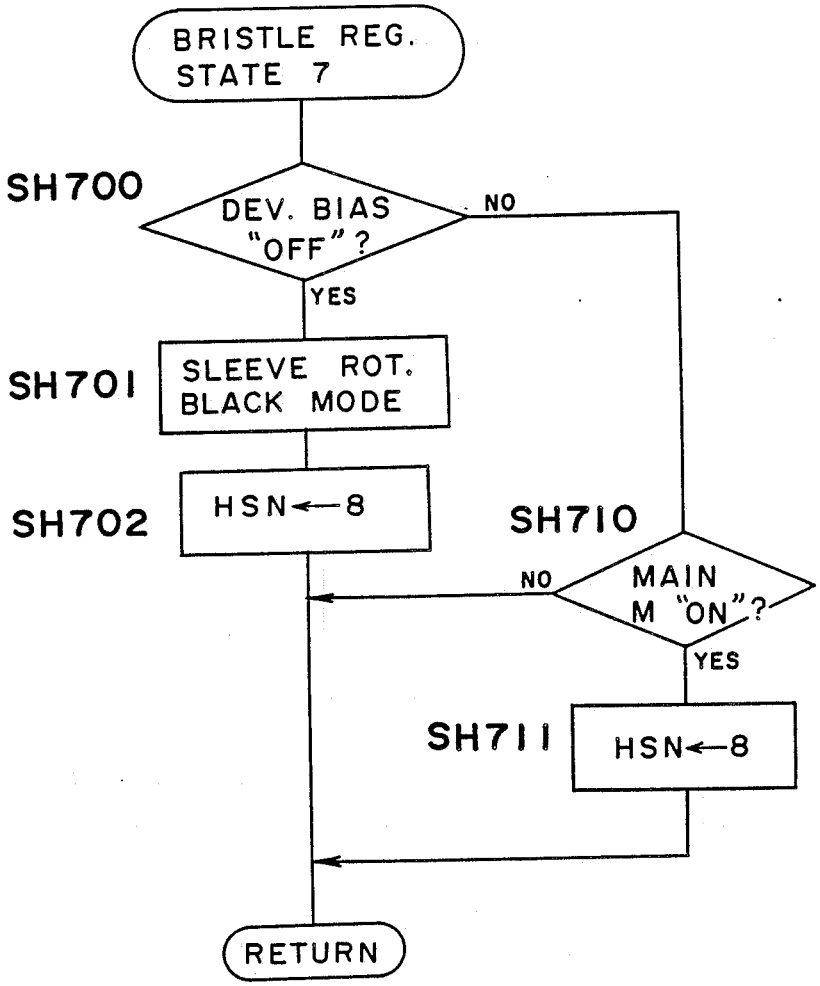

Bristle regulation state 7 (FIG. 24)

In the bristle regulation state 7, a decision is made at step SH700 as to whether or not the developing bias voltage is in the OFF state. In the case of "NO" at step SH700, a decision is made at step SH710 as to whether or not the main motor is in the ON state. When the main motor is driven for starting copying, drying of the photosensitive drum 2, fored replenishment of the toner, etc., the bristle regulation state No. HSN is set to 8 at step SH711. In the case of "NO" at step SH710, the program flow returns.

Meanwhile, in the case of "YES" at step SH700, rotation of the developing sleeve is set to the black mode at step SH701 and the bristle regulation state No. HSN is set to 8 at step SH702.

Namely, if the developing bias voltage is not turned off prior to complete stop of rotation of the main motor, the toner adheres from the developing sleeve to the photosensitive drum 2 while the main motor is rotating by its inertia, thereby resulting in wasteful consumption of the toner. This bristle regulation state 7 is provided for preventing such waste of the toner.

Figure 25:
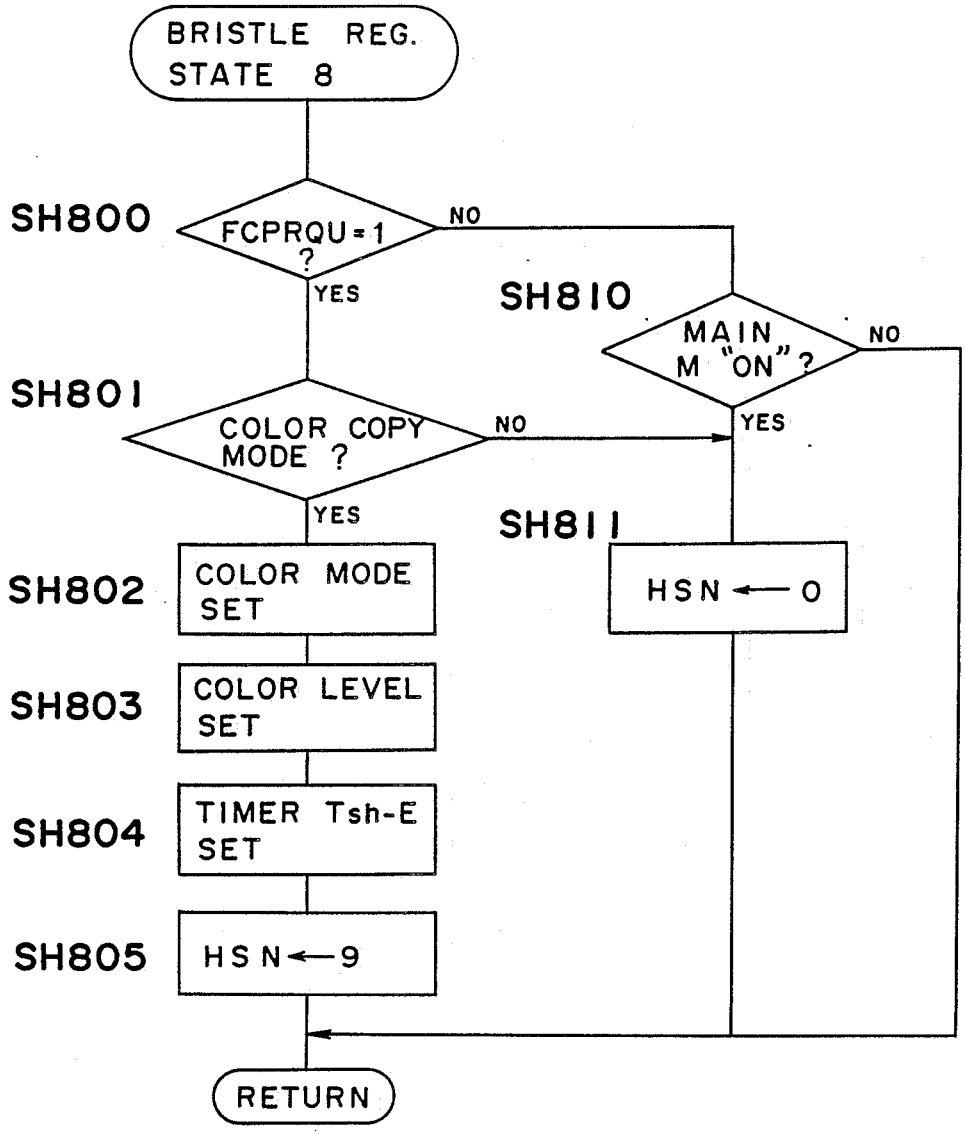

Bristle regulation state 8 (FIG. 25)

In the bristle regulation state 8, a decision is made at step SH800 as to whether or not the print switch has been depressed again. In the case of "YES" at step SH800, a decision is made at step SH801 as to whether or not the color copying is selected. In the case of "YES" at step SH801, steps SH802 to SH805 are successively executed. Namely, at step SH802, rotation of the developing sleeve is set to the color copying mode and drive is charged over to the first (color) developing device 5. Then, at step SH803, the first developing bias voltage is set to the color level of −150V and at step SH804, a timer Tsh-E is set. Then, at step SH805, the bristle regulation state No. HSN is set to 9.

If changeover of the drive unit set hitherto to the black developing device 6 in the simultaneous color copying mode in view of power consumption, etc. and start of the main motor are performed at the same time, the developing sleeve 61 of the black (second) developing device 6 containing the black toner rotates slightly due to difference in response time therebetween, so that the black toner is supplied to the surface of the photosensitive drum 2. In order to prevent such a phenomenon, the timer Tsh-E is used for driving the main motor after the drive unit has been changed over to the color (first) developing device 5.

On the other hand, if a signal from the print switch is not inputted, the program flow proceeds from step SH800 to step SH810 at which a decision is made as to whether or not the main motor is in the ON state. In the case of "YES" at step 810, the bristle regulation state No. HSN is set to 0 at step SH811. On the other hand, if the main motor is at a stop, the program flow returns.

Meanwhile, if it is found at step SH801 that the copying mode other than the color copying mode is selected, the bristle regulation state No. HSN is set to 0 at step SH811 and the program flow returns.

Figure 26:
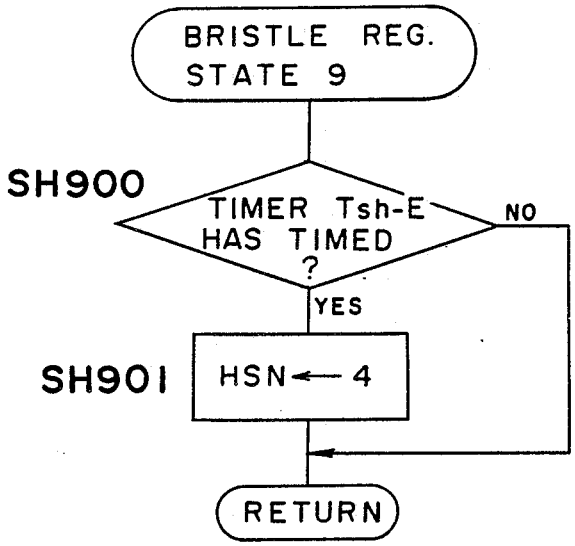

Bristle regulation state 9 (FIG. 26)

In the bristle regulation state 9, a decision is made at step SH900 as to whether or not the timer Tsh-E has timed. In the case of "YES" at step SH900, the bristle regulation state No. HSN is set to 4 at step SH901 and the program flow returns.

Figure 27:
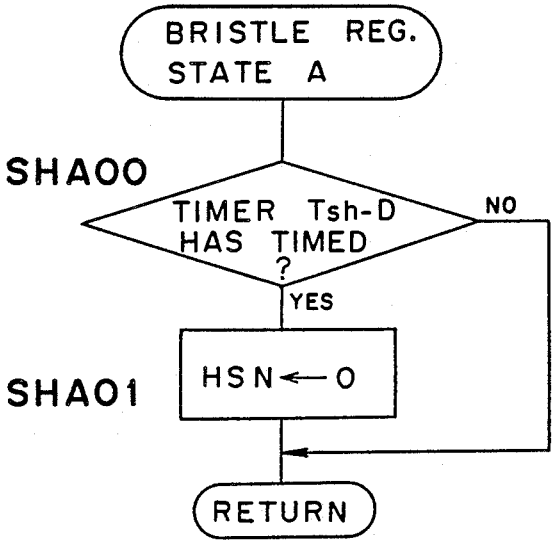
Figure 28:
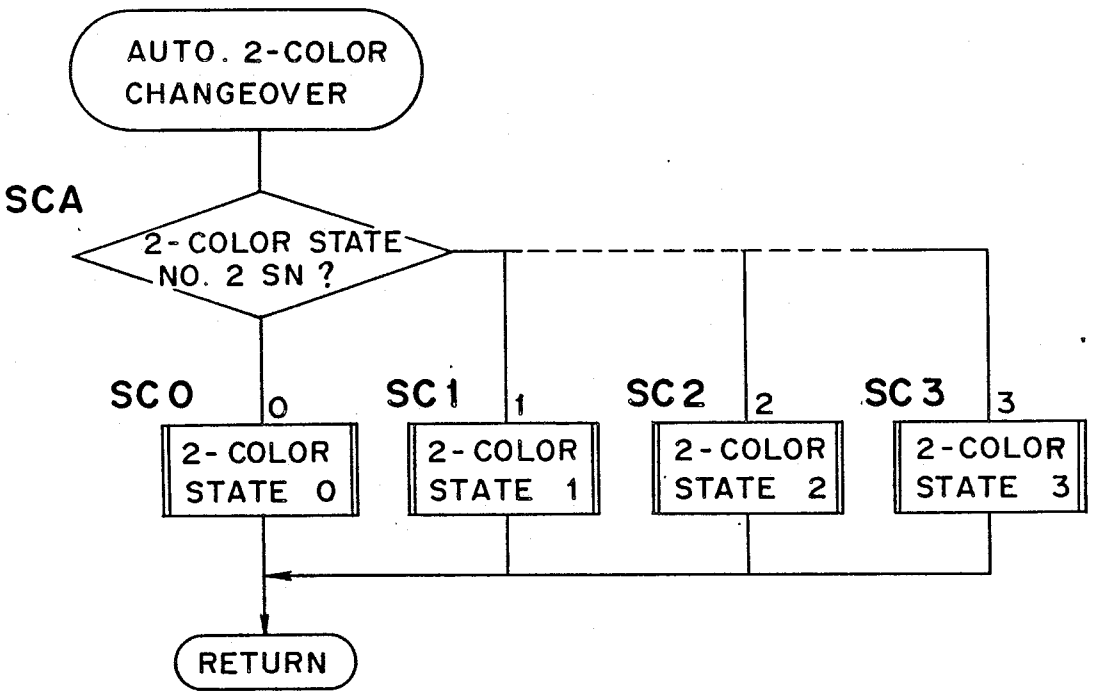
FIG. 28 is a flow chart of a subroutine for automatic two-color changeover in the copying apparatus of FIG. 1.

Bristle regulation state A (FIG. 27)

In the bristle regulation state A, a decision is made at step SHA00 as to whether or not the timer Tsh-D has timed. In the case of "YES" at step SHA00, the bristle regulation state No. HSN is set to 0 at step SHA01 and the program flow returns. This timer Tsh-D is set in the bristle regulation state 4.

(B) Automatic 2-color changeover subroutine

Hereinbelow, the automatic 2-color changeover subroutines described with reference to FIGS. 28 to 32 and FIG. 10. This automatic 2-color changeover subroutine is directed to control of changeover of drive between the developing devices 5 and 6, changeover of the first developing bias voltage and changeover of the bristle shutter 71 in accordance with the color changeover point Po in the simultaneous color copying mode. On the basis of the values of a 2-color state No. 2SN judged at step SCA, the program flow proceeds to steps SC0 to SC3 for 2-color state to 3, respectively. Meanwhile, at the time when the copying apparatus 1 has been initialized, the 2-color state No. 2SN is set to 0.

Figure 29:
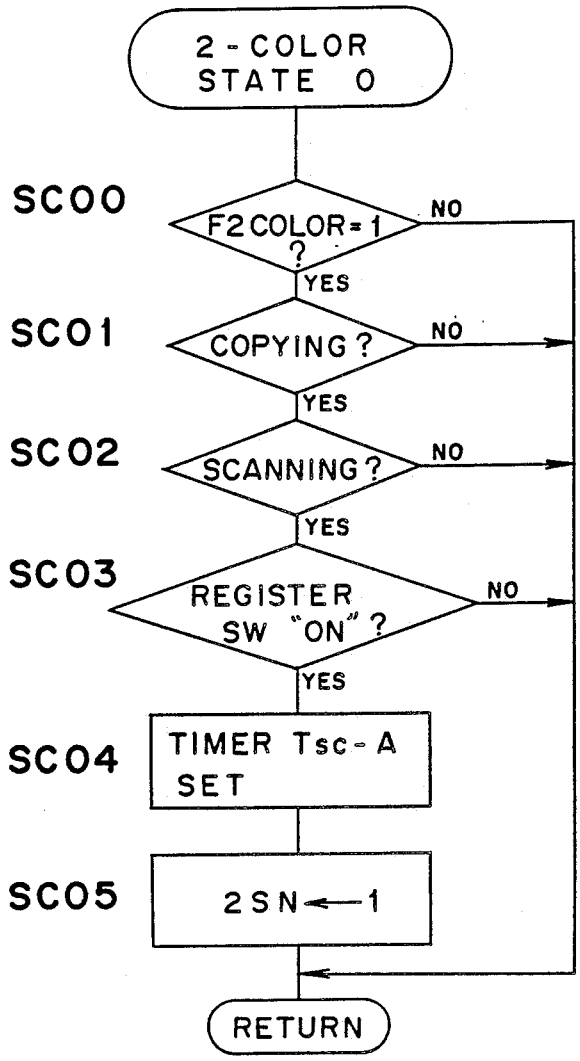
FIGS. 29 to 32 are flow charts showing two-color states in the copying apparatus of FIG. 1.

2-color state 0 (FIG. 29)

In the 2-color state 0, a decision is made at steps SC00 to SC02 as to whether or not scanning of the simultaneously color copying mode is being performed. If the scanning is being performed, the program flow remains in a waiting state until it is found at step SC03 that the register switch is in the ON state.

When the original platform 20 has turned on the register switch 24 through depression thereof while being displaced for scanning, a timer Tsc-A for delaying actuation of the sleeve solenoid is set at step SC04 and the 2-color state No. 2SN is set to 1 at step SC05 and then, the program flow returns.

A preset time period of the timer Tsc-A changes according to a distance from the distal end of the original document to the color changeover point Po and is automatically calculated and set by the microcomputer from data of the color changeover point Po inputted by manipulation of the keys of the operating panel 100. The preset time period of the timer Tsc-A is set such that at the time when the timer Tsc-A has timed, a point of the electrostatic latent image, which corresponds to the changeover point Po of the regions R1 and R2 of the original document G, is just going to pass through an area confronting the first developing sleeve 51.

Figure 9:
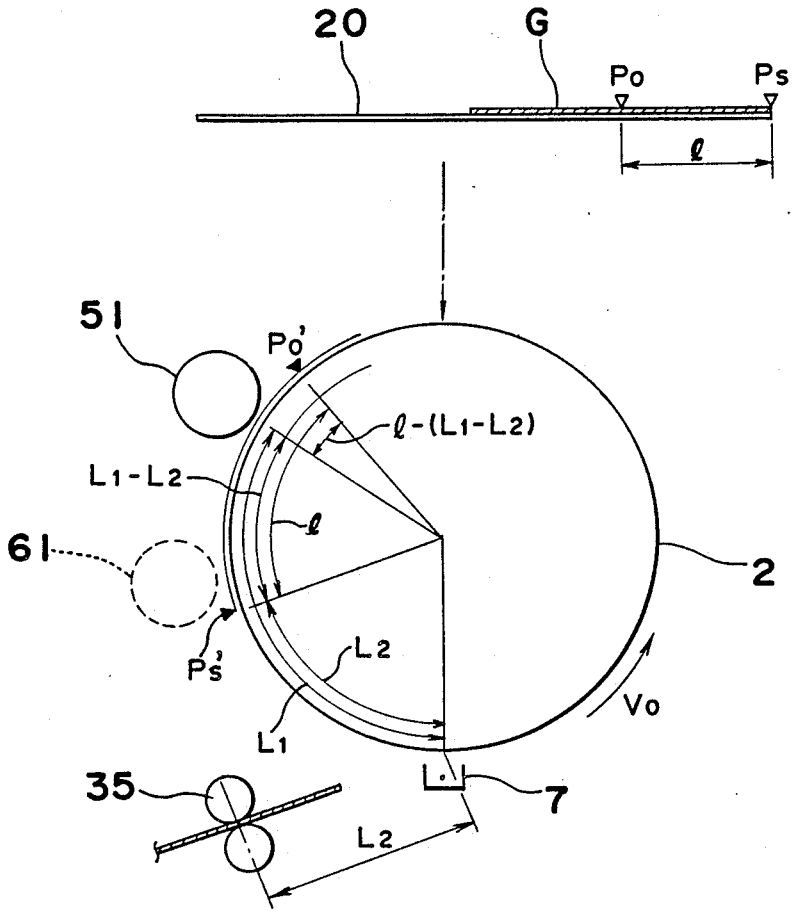
FIG. 9 is an explanatory view of time setting of a timer in the copying apparatus of FIG. 1.

More specifically, it is assumed in the copying apparatus 1 that Characters L1 and L2 denote a distance from the transfer charger 7 to the first developing sleeve 51 and a distance from the transfer charger 7 to the timing rollers 35, respectively as shown in FIG. 9. Supposing that the distance L1 is larger than the distance L2, a front edge Ps' of the electrostatic latent image, which corresponds to a front edge Ps of the image of the original document, is disposed at a position spaced about a distance of (L1-L2) in the direction of the arrow from an area confronting the first developing sleeve 51 at the time when the register switch 23 has been turned on.

Therefore, on the supposition that character l denotes a distance from the front edge Ps of the original document at a scanning start side to the color changeover point Po, a point Po' of the electrostatic latent image, which corresponds to the color changeover point Po, is disposed at a point spaced a distance of [l-(L1-L2)] at an upstream side from the area confronting the first developing sleeve 51. Thus, assuming that character Vo denotes a peripheral speed of the photosensitive drum 2, the preset time period TA of the timer Tsc-A is given by the following equation. The time period TA denotes a period in which the color changeover point Po is just passing through the area confronting the first developing sleeve 51 from a point at that time when the register switch 23 has been turned on.

$$TA=[l-(L1-L2)]/Vo$$

One concrete example is shown in table 3 below on such conditions as L1=81 mm, L2=55 mm and Vo=111 mm/sec.

TABLE 3

| Changeover point | l (mm) | TA (msec.) |
|---|---|---|
| 1P | 30 | 30 |
| 2P | 60 | 300 |
| 3P | 90 | 570 |
| 4P | 120 | 840 |
| 5P | 150 | 1110 |
| 6P | 180 | 1380 |
| 7P | 210 | 1650 |
| 8P | 240 | 1920 |
| 9P | 270 | 2190 |
| 0P | 300 | 2460 |

Figure 30:
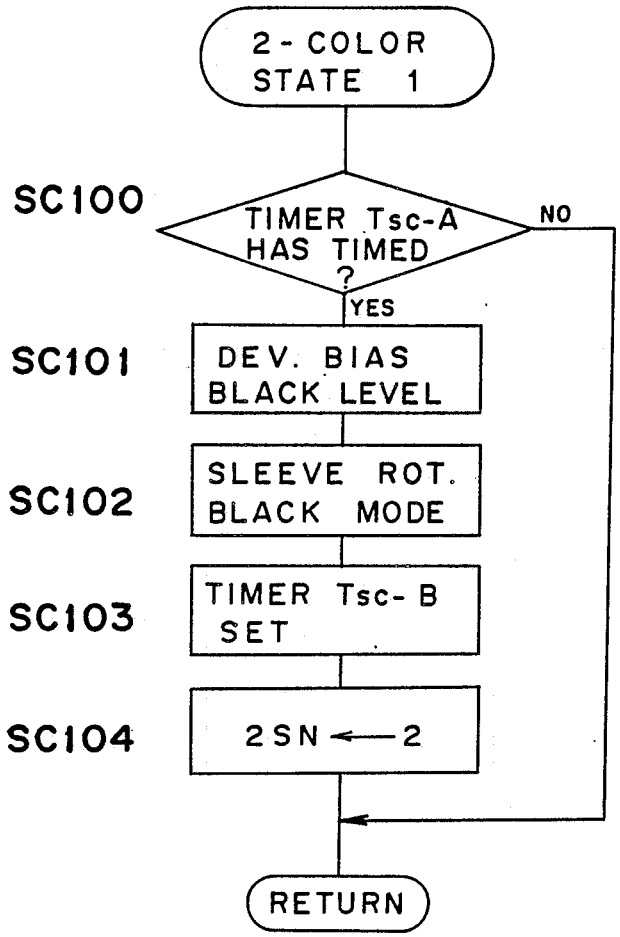

2-color state 1 (FIG. 30)

In the 2-color state 1, the program flow remains in a waiting state until the timer Tsc-A has timed. When the point Po' on the electrostatic latent image, which corresponds to the changeover point Po, is just passing through the area confronting the first developing sleeve 51 upon lapse of the preset time period of the timer Tsc-A, the first developing bias voltage is changed from the color level of −150V to the black level of −300V at step SC101 and the sleeve solenoid is changed over to the black mode at step SC102 such that the driving force of the main motor is transmitted to the second developing device 6.

Then, at step SC103, a timer Tsc-B for delaying actuation of the bristle shutter 71 is set. Subsequently, at step SC 104, the 2-color state No. 2SN is set to 2 and the program flow returns.

Meanwhile, at the time when the point Po' on the electrostatic latent image, which corresponds to the color changeover point Po, has passed through the area confronting the first developing sleeve 51, a rear edge portion of the color toner image developed at the first developing device 5 does not yet reach an area confronting the second developing device 6. Therefore, if the bristle shutter 71 is turned off concurrently with lapse of the present time period of the timer Tsc-A, the color toner image is disturbed by the magnetic brush formed by the second developing sleeve 61. Thus, in order to prevent such a phenomenon, the timer Tsc-B is provided for delaying actuation of the bristle shutter 71. More concretely, supposing that characters T3, T4 and T5 denote a time period during which a point on the photosensitive drum 2 proceeds from the first developing device 5 to the second developing device 6, a time period during which a point on the developing sleeve 61 proceeds from the bristle shutter 71 to an area confronting the photosensitive drum 2 and a time period during which the bristle shutter 71 changes from the ON state to the OFF state, respectively, a preset time period TB of the timer Tsc-B is set as follows.

$$TB=T3-T4-T5$$

Figure 31:
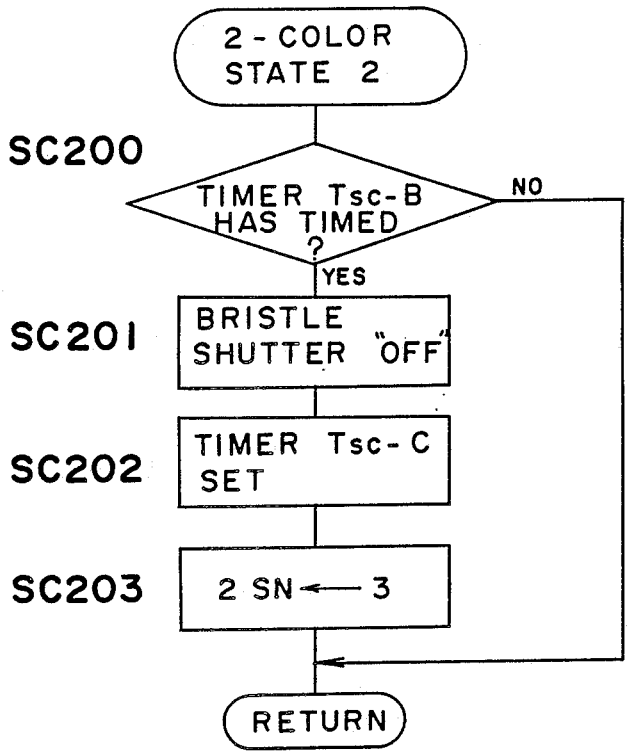

2-color state 2 (FIG. 31)

In the 2-color state 2, if it is found at step SC200 that the timer Tsc-B has timed, the bristle shutter 71 is turned off at step SC201 such that development can be performed by the second developing device 6. Subsequently, at step SC202, a timer Tsc-C for delaying turning-off of the bristle shutter 71 is set. Then, the 2-color state No. 2SN is set to 3 at step SC203 and the program flow returns.

A preset time period TC of the timer Tsc-C changes according to the position of the color changeover point Po and is concretely set as shown in Table 4 below. The preset time period TC is determined such that not only the bristle shutter 71 is held in the OFF state at least until the next development of the region R2 by the second developing device 6 is completed but a time period of the OFF state of the solenoid 75 for driving the bristle shutter 71 is set larger than that of the ON state of the solenoid 75 in order to maintain normal operational characteristics of the solenoid 75 through restriction of production of heat in the solenoid 75.

Namely, in the copying apparatus 1 of this embodiment, the solenoid 75 for driving the bristle shutter 71 is made small in size so as to make the apparatus compact.

Therefore, in case where continuous multiple copying is executed, cumulated time period of the ON state of the solenoid 75 increases quantity of heat produced in the solenoid 75 to raise the temperature and thereby causes reduced performance. As a result, the solenoid 75 cannot bear resisting load of the toner impinging on the bristle shutter 71 and thus, becomes unable to maintain normal operational characteristics.

Therefore, as shown in FIG. 10, in order to secure a cooling-off period of the solenoid 75, the preset time period TC is set such that the solenoid 75 is held at a stop by setting a ratio (duty ratio) R of the time period Ton to the time period Toff as follows.

$$R=Ton/Toff<0.5$$

TABLE 4

| Changeover point | TC (msec.) |
|---|---|
| 1P | 5790 |
| 2P | 6090 |
| 3P | 6330 |
| 4P | 6600 |
| 5P | 6870 |
| 6P | 7140 |
| 7P | 7410 |
| 8P | 7680 |
| 9P | 7950 |
| 0P | 8220 |

Figure 32:
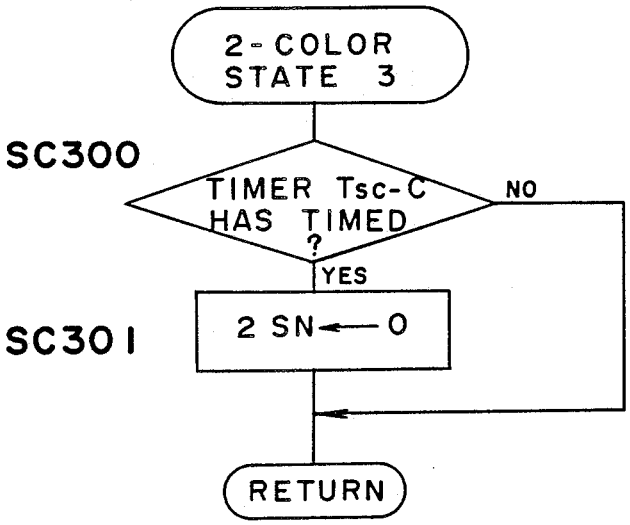
Figure 33:
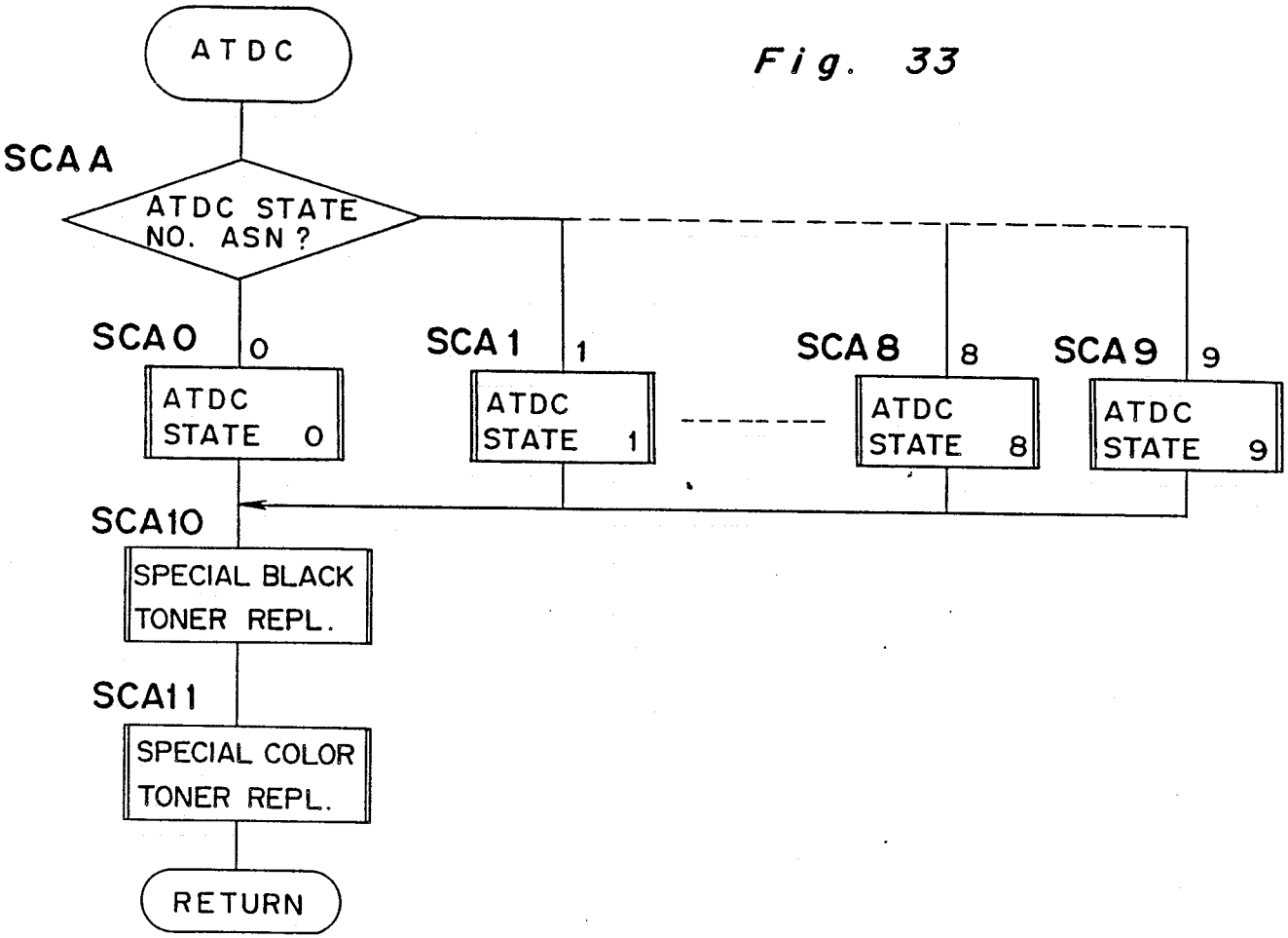
FIG. 33 is a flow chart of a subroutine for automatic toner density control (ATDC) in the copying apparatus of FIG. 1.

2-color state 3 (FIG. 32)

In the 2-color state 3, the program flow remains in a waiting state until the timer Tsc-C has timed. If it is found at step SC300 that the timer Tsc-C has timed such that the bristle shutter 71 can be turned on, the 2-color state No. 2SN is set to 0 at step SC301 and the program flow returns.

(C) ATDC subroutine

Hereinbelow, the ATDC subroutine is described with reference to FIGS. 33 to 42 and FIGS. 13 and 14. This subroutine is provided for controlling second replenishment of the toner to the developing devices 5 and 6. At step SCAA, an ATDC state No. ASN is judged. On the basis of a value of the ATDC state No. ASN, the program flow proceeds to one of steps SCA0 to SCA9 for ATDC states 0 to 9, respectively. Meanwhile, at the time when the power source of the copying apparatus 1 has been turned on, the ATDC state No. ASN is set to 0 in the initialization subroutine (step MI)

of the main routine of FIG. 15. Hence, the program flow initially starts from the ATDC state 0.

In the case where the black copying mode or the color copying mode is selected in this subroutine, processing is performed by the ATDC states 0, 1 and 9. Meanwhile, in the case where the simultaneous color copying mode is selected, processing is performed by the ATDC states 0 and 2 to 8.

Subsequently, after the above-described processing of each state has completed, a special black toner replenishment subroutine is performed at step SCA10 and a special color toner replenishment subroutine is performed at step SCA11.

Figure 34:
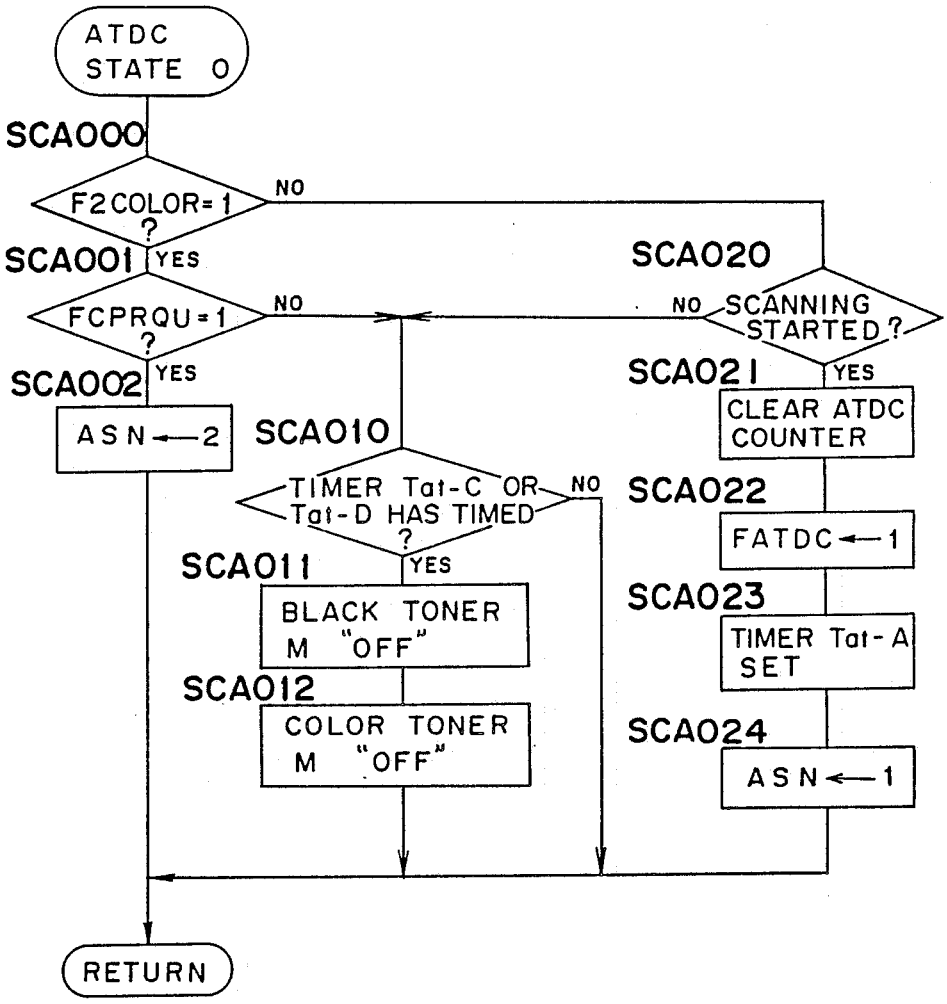
FIGS. 34 to 42 are flow charts showing ATDC states in the copying apparatus of FIG. 1.

ATDC state 0 (FIG. 34)

In the ATDC state 0, a decision is made at step SCA000 as to whether or not the simultaneous color copying mode is selected. If it is found at step SCA001 that a demand for copying has been detected in the simultaneous color copying mode, the ATDC state No. ASN is set to 2 at step SCA002 and the program flow returns. In the case of "NO" at step SCA001 in the simultaneous color copying mode, the program flow proceeds to step SCA010.

On the other hand, in the case where the copying mode other than the simultaneous color copying mode, i.e. the black copying mode or the color copying mode is selected, a decision is made at step SCA020 as to whether or not scanning has been started. In the case of "YES" at step SCA020, steps SCA021 to SCA024 are executed and the program flow returns. In the case of "NO" at step SCA020, the program flow proceeds to step SCA010.

Meanwhile, at step SCA021, an ATDC counter is cleared for its initialization and at step SCA022, an ATDC detection timing flag FATDC is set to 1 so as to start an ATDC detection subroutine to be described later. Subsequently, at step SCA023, an ATDC detection timer Tat-A for receiving output signals from the ATDC sensors AS1 and AS2 mounted on the developing devices 5 and 6, respectively is set. Therefore, during a preset time period T-A of the timer Tat-A, the output signals from the ATDC sensors AS1 and AS2 are read and the toner density of the developing devices 5 and 6 is judged as an average of the output signals of the ATDC sensors AS1 and AS2. Reference should be made to a timing chart of FIG. 14.

Meanwhile, at step SCA010, a decision is made as to whether or not a timer Tat-C or Tat-D for counting a time period for replenishment of the toner, which is set in the ATDC state 1 to be described later, has timed. In the case of "YES" at step SCA010, a black toner replenishment motor for replenishing the black toner to the developing device 6 from the toner replenishment bottle 91 is turned off at step SCA011 and a color toner replenishment motor for replenishing the color toner to the developing device 5 from the toner replenishment bottle 81 turned off at step SCA012.

Figure 35:
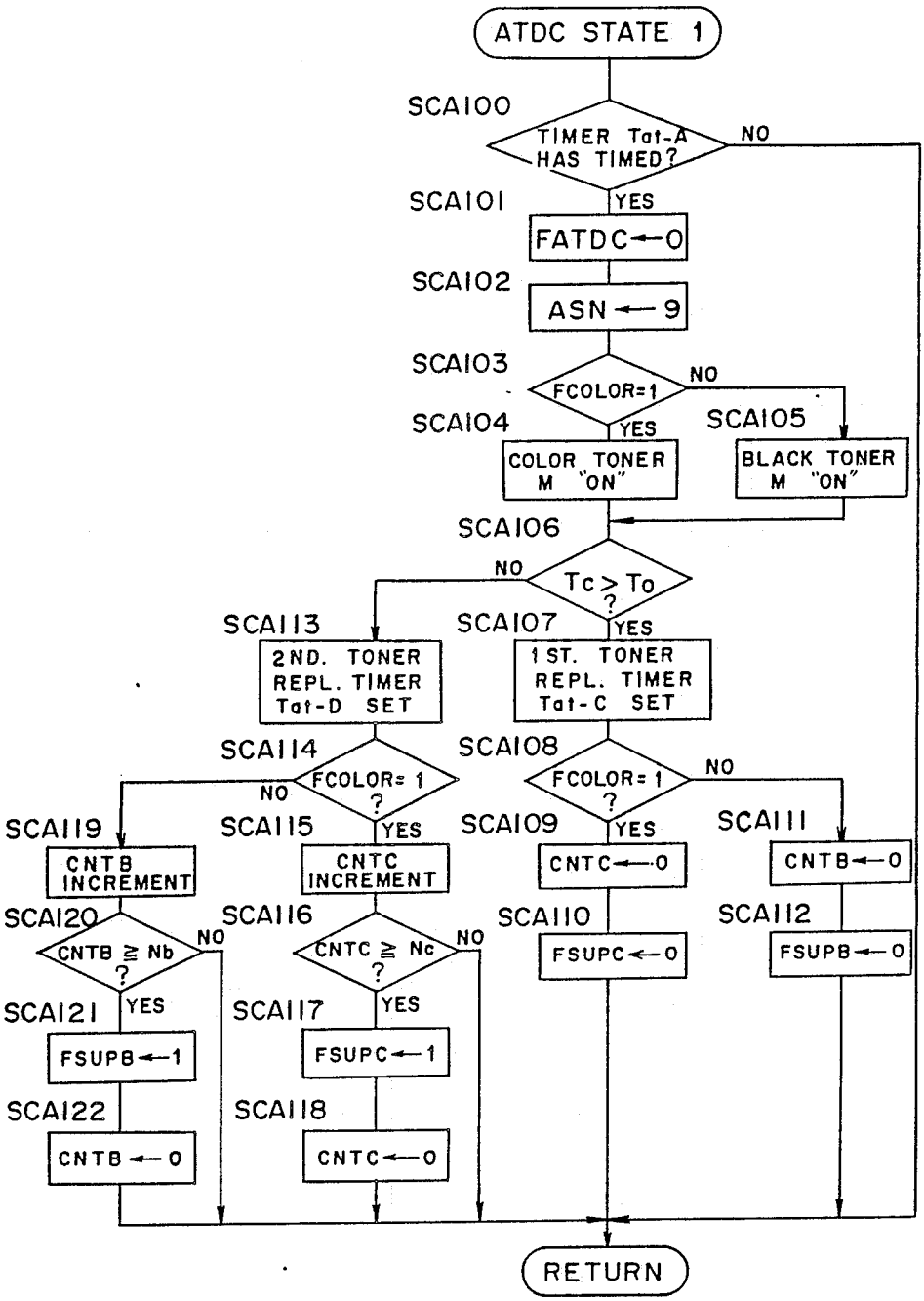

ATDC state 1 (FIG. 35)

The ATDC state 1 is provided for starting second replenishment of the toner in the black copying mode and the color copying mode. At step SCA100, a decision is made as to whether or not the above described timer Tat-A has timed. In the case of "NO" at step SCA100, program flow returns. In the case of "YES" at step SCA100, the ATDC detection timing flag FATDC is set to 0 at step SCA101 so as to detect the toner density and the ATDC state No. ASN is set to 9 at step SCA102.

Then, at step SCA103, a decision is made as to whether the black copying mode or the color copying mode is selected. In the case where the color copying mode is selected, the color toner replenishment motor is turned on at step SCA104 so as to supply the color toner to the first developing device 5. Meanwhile, in the case where the black copying mode is selected, the black toner replenishment motor is turned on at step SCA105 so as to supply the black toner to the second developing device 6.

Subsequently, at step SCA106, a decision is made as to whether or not a toner density Tc of each of the developing devices 5 and 6, which has been detected in the ATDC sensor detection subroutine during the preset time period T-A of the timer Tat-A, is larger than a predetermined reference level To. In the case of "YES" at step SCA106, a first toner replenishment timer Tat-C having a preset time period T-C of 180 msec. is set at step SCA107 such that a predetermined amount of the toner is replenished, that is, first toner replenishment is performed, during the preset time period T-C as shown by the broken lines in FIG. 14. At step SCA108, a decision is made as to whether or not the copying mode flag FCOLOR is 1. If the flag FCOLOR is 1 at step SCA108, namely, when the color copying mode is selected, a counter flag CNTC is reset to 0 at step SCA109 and a special color toner replenishment flag FSUPC is reset to 0 at step SCA110. If the copying mode flag FCOLOR is 0 at step SCA108, a counter flag CNTB is reset to 0 at step SCA111 and a special black toner replenishment flag FSUPB is reset to 0 at step SCA112.

Meanwhile, the counter flags CNTC and CNTB are, respectively, provided for counting how many times a toner density detection value detected at each one routine time is successively lager than the predetermined reference level, that is, how many times the second replenishment to be described later is successively performed. The counter CNTC corresponds to the first (color) developing device 5 and the counter CNTB corresponds to the second (black) developing device 6.

The special color toner replenishment flag FSUPC and the special black toner replenishment flag FSUPB respectively are provided for controlling a special (third) toner replenishment operation performing in an extreme lot of toner consumption of the first (color) developing device 5 and the second (black) developing device 6.

Meanwhile, in the case of "NO" at step SCA106, a second tone replenishment timer Tat-D having a preset time period T-D of 3,990 msec. is set at step SCA113 such that ATDC (second) replenishment of the toner, whose amount is larger than the amount of the first toner replenishment, is performed during the preset time period T-D.

Then, a decision is made at step SCA114 as to whether or not the copying mode flag FCOLOR is 1.

If the flag FCOLOR is 1 at step SCA114, count of the counter CNTC is increased at step SCA115. Subsequently, at step SCA116, a decision is made as to whether or not a counted number of the counter CNTC is lager than a predetermined reference value Nc. If the case of "YES" at step SCA116, the special color toner replenishment flag FSUPC is set to 1 at step SCA117 and the counter flag CNTC is reset to 0 at step SCA118. Namely, in the case where the toner density does not reach the reference level To in spite of usual performance of the second toner replenishment, that is, when consumption of toner is extremely large, the operation is changed over from the second toner replenishment state to the third toner replenishment state.

If the case of "NO" at step SCA114, count of the counter CNTB is increased at step SCA119. Subsequently, at step SCA120, a decision is made as to whether or not a counted number of the counter CNTB is lager than a predetermined reference value Nb. If the case of "YES" at step SCA120, the special black toner replenishment flag FSUPB is set to 1 at step SCA121 and the counter flag CNTB is reset to 0 at step SCA122.

Figure 36:
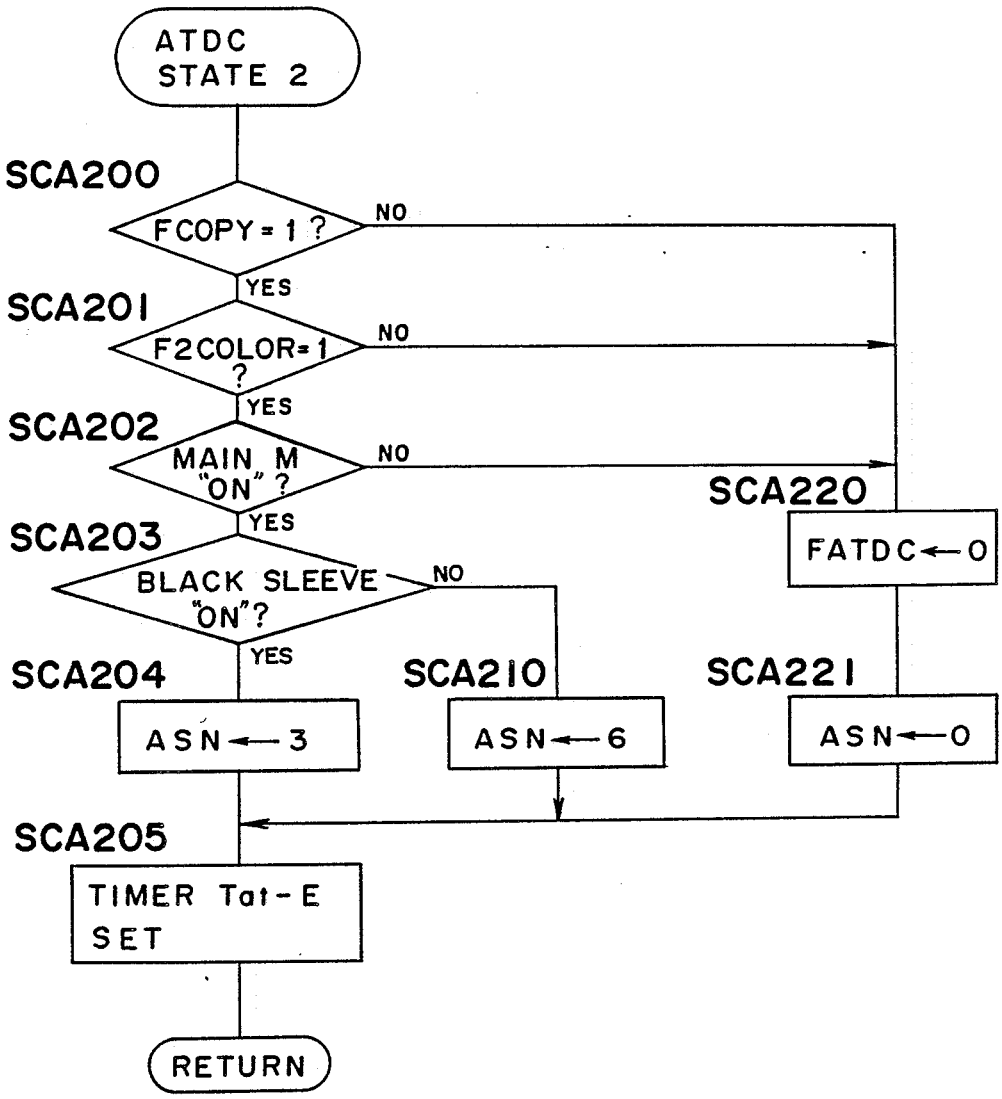

ATDC state 2 (FIG. 36)

The ATDC state 2 is a subroutine to be executed in the case where it has been judged in the ATDC state 0 that the simultaneous color copying mode is selected. At step SCA200, a decision is made as to whether or not copying is being performed. In the case of "YES" at step SCA200, a decision is made at step SCA201 as to whether or not the simultaneous color copying mode is selected and a decision is made at step SCA202 as to whether or not the main motor is in the ON state. In the case of "YES" at not only step SCA201 but step SCA202, the program flow proceeds to step SCA203. Meanwhile, in the case of "NO" at one of steps SCA200 to SCA202, the program flow proceeds to steps SCA220 and SCA221.

Meanwhile, if not only the simultaneous color copying mode is selected but also the main motor is in the ON state, a decision is made at step SCA 203 as to whether or not the second (black) developing sleeve 61 is in operation. In the case of "YES" at step SCA203, the ATDC state No. ASN is set to 3 at step SCA204. In the case of "NO" at step SCA203, namely when the first (color) developing sleeve 51 is in operation, the ATDC state No. ASN is set to 6 at step SCA210.

Meanwhile, in the case of "NO" at one of steps SCA200 to SCA202, the ATDC detection timing flag FATDC is set to 0 at step SCA200 and the ATDC state No. ASN is set to 0 at step SCA221.

Subsequently, at step SCA205, a timer Tat-E is set at step SCA205 and the program flow returns. This timer Tat-E is used for delaying detection of the toner density until the developer is fully mixed in the developer 5 or 6 after start of operation of the developing device 5 or 6.

Figure 37:
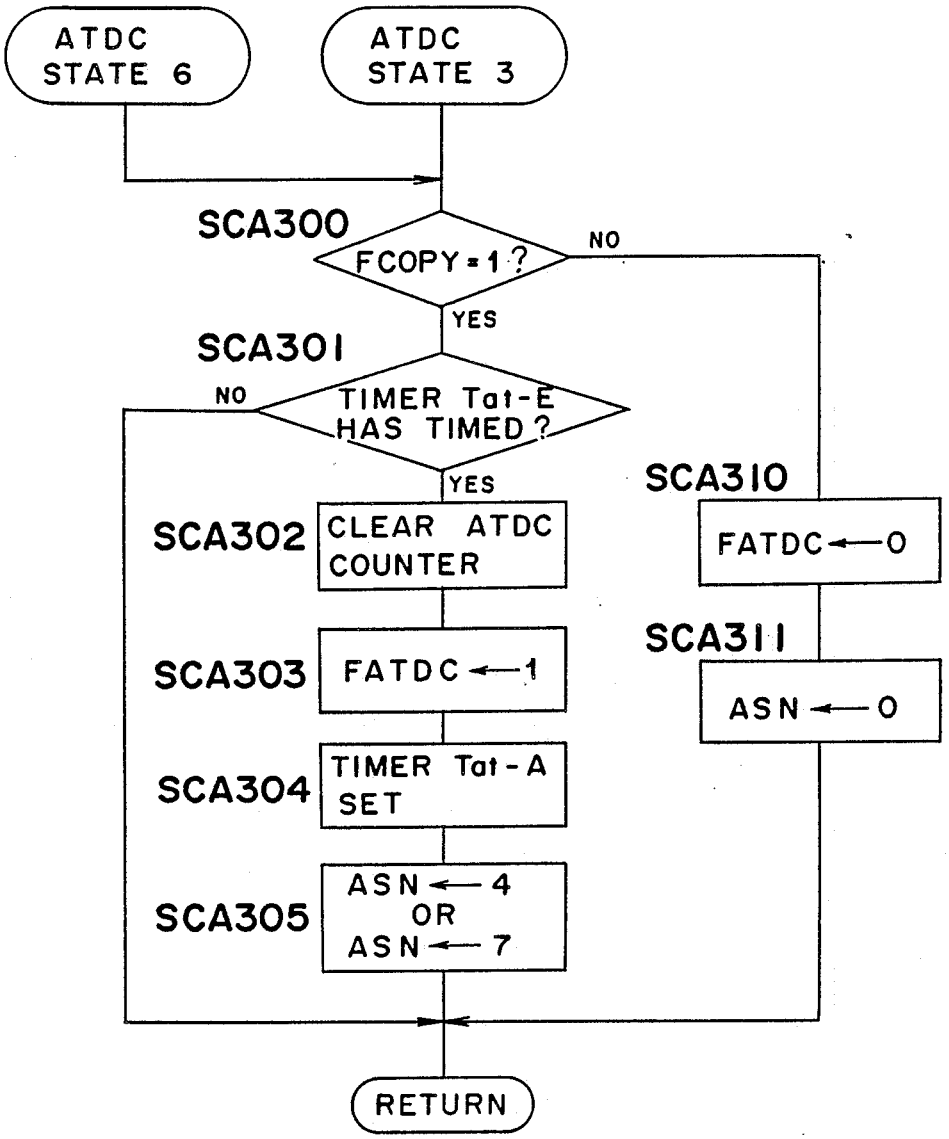

ATDC states 3 and 6 (FIG. 37)

In the ATDC states 3 and 6, a decision is made at step SCA300 as to whether or not copying is being performed. In the case of "NO" at step SCA300, the ATDC detection timing flag FATDC is set to 0 at step SC310 and the ATDC state No. ASN is set to 0 at step SCA311 and then, the program flow returns.

Meanwhile, in the case of "YES" at step SCA300, a decision is made at step SCA301 as to whether or not the timer Tat-E has timed. In the case of "NO" at step SCA301, the program flow returns. In the case of "YES" at step SCA301, steps SCA302 to SCA305 are executed and the program flow returns. At step SCA302, the ATDC counter is cleared and the ATDC detection timing flag FATDC is set to 1 at step SCA303. Thereafter, at step SCA304, the timer Tat-A is set. Furthermore, at step SCA305, the ATDC state No. ASN is reset to 4 and 7 if the ATDC state No. ASN is 3 and 6, respectively.

Figure 38:
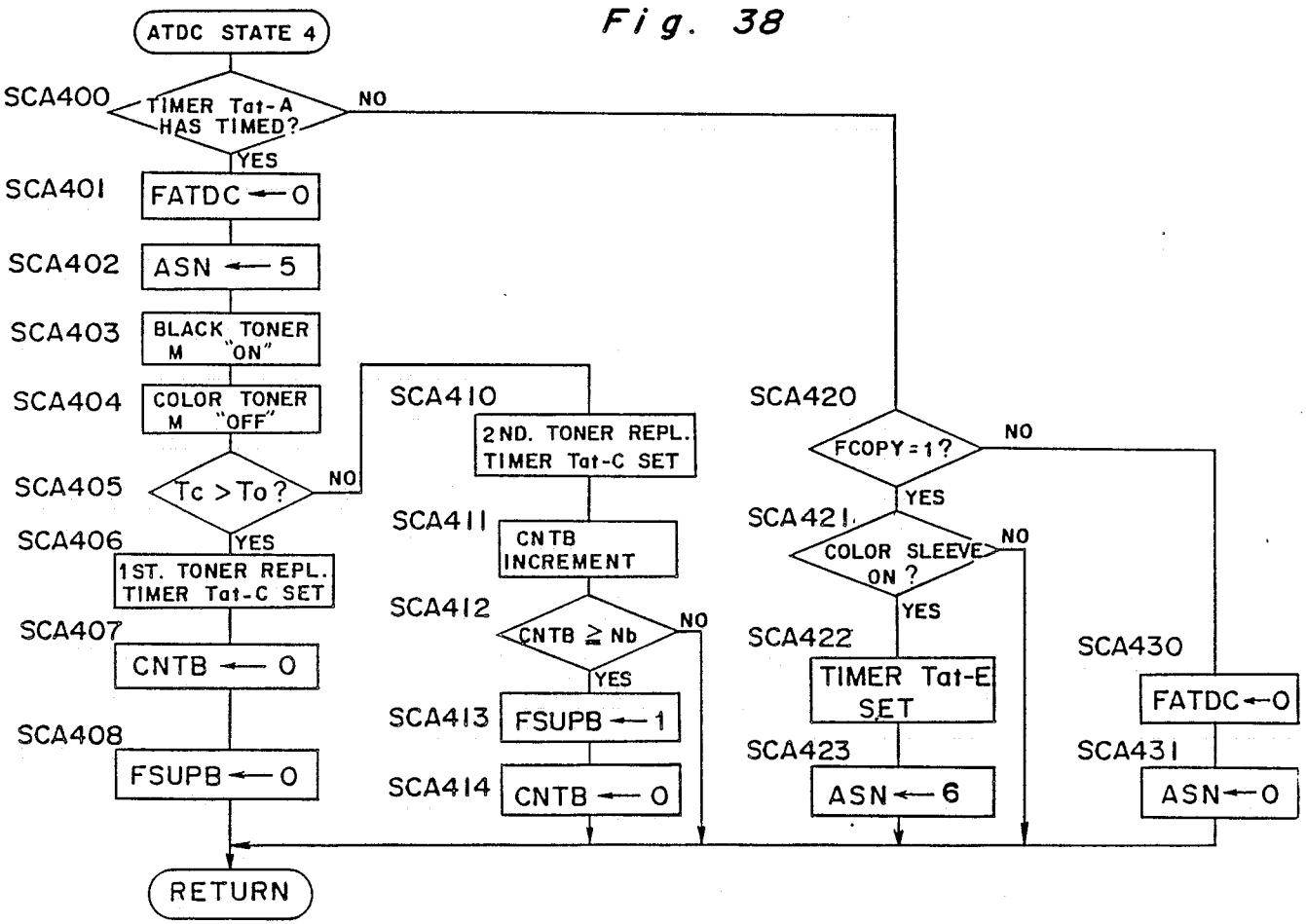

ATDC state 4 (FIG. 38)

This ATDC state 4 is provided for replenishing the black toner to the second (black) developing device 6 during development of the second developing device 6 in the simultaneous color copying mode. At step SCA400, a decision is made as to whether or not the above described timer Tat-A has timed. In the case of "YES" at step SCA400, the program flow proceeds to step SCA401 at which the ATDC detection timing flag FATDC is set to 0. Then, at step SCA402, the ATDC state No. ASN is set to 5. Subsequently, the black toner replenishment motor is turned on at step SCA403 and the color toner replenishment motor is turned off at step SCA404. Thereafter, at step SCA405, a decision is made as to whether or not the toner density Tc in the second (black) developing device 6 is larger than the predetermined reference level To. In the case of "YES" at step SCA405, the first toner replenishment timer Tat-C having the preset time period T-C of 180 msec. is started at step SCA406. Subsequently, the counter flag CNTB is reset to 0 at step SCA407 and the special black toner replenishment flag FSUPB is reset to 0 at step SCA408. Meanwhile, in the case of "NO" at step SCA405, the second toner replenishment timer Tat-D having the preset time period T-D of 3,990 msec. is started such that the second toner replenishment is started. Subsequently, the count of the counter CNTB is increased at step SCA411 and a decision is made at step SCA412 as to whether or not the counted number of the counter CNTB is lager than the predetermined reference value Nb. If the case of "YES" at step SCA412, namely when the consumption of toner is extremely large, the special black toner replenishment flag FSUPB is set to 1 at step SCA413 and the counter CNTB is cleared at step SCA414.

During counting of the timer Tat-A at step SCA400, the program flow proceeds to step SCA420 at which a decision is made as to whether or not copying is being performed. In the case of "NO" at step SCA420, the ATDC detection timing flag FATDC is set to 0 at step SCA430 and the ATDC state No. ASN is set to 0 at step SCA431 and the program flow returns. On the other hand, in the case of "YES" at step SCA420, a decision is made at step SCA421 as to whether or not the first (color) developing sleeve 51 is in the ON state, namely the black toner has been changed over to the color toner during copying. In the case of "YES" at step SCA421, the timer Tat-E is set again at step SCA422 and the ATDC state No. ASN is set to 6 at step SCA423 and the program flow returns.

Figure 39:
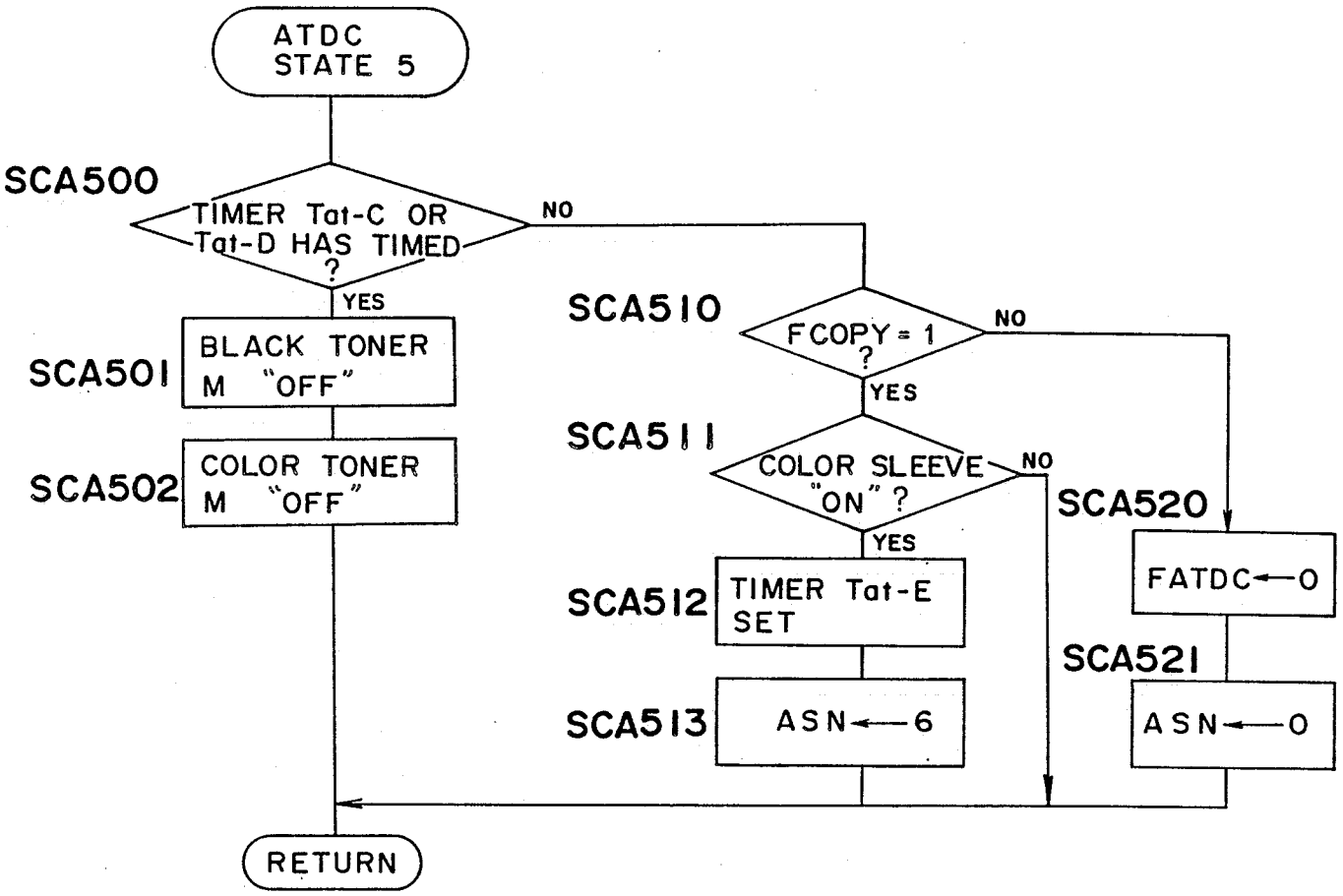

ATDC state 5 (FIG. 39)

In the ATDC state 5, at step SCA500, a decision is made as to whether or not the timer Tat-C or Tat-D set in the above described ATDC state 4 has timed. In the case of "YES" at step SCA500, the black toner replenishment motor and the color toner replenishment motor are, respectively, turned off at steps SCA501 and SCA502 and the program flow returns such that subsequent processing is controlled by other subroutines.

On the other hand, in the case of "NO" at step SCA500, a decision is made at step SCA510 as to whether or not copying is being performed. In the case of "NO" at step SCA510, the ATDC detection timing flag FATDC is set to 0 at step SCA520 and the ATDC state No. ASN is set to 0 at step SCA521 and the program flow returns. Meanwhile, in the case of "YES" at step SCA510, a decision is made at step 511 as to whether or not the color developing sleeve 51 is in the ON state, namely drive has been changed over from the black developing sleeve 61 to the color developing sleeve 51. In the case of "YES" at step SCA511, the timer Tat-E is set at step SCA512 and the ATDC state No. ASN is set to 6 at step SCA513 and the program flow returns.

Figure 40:
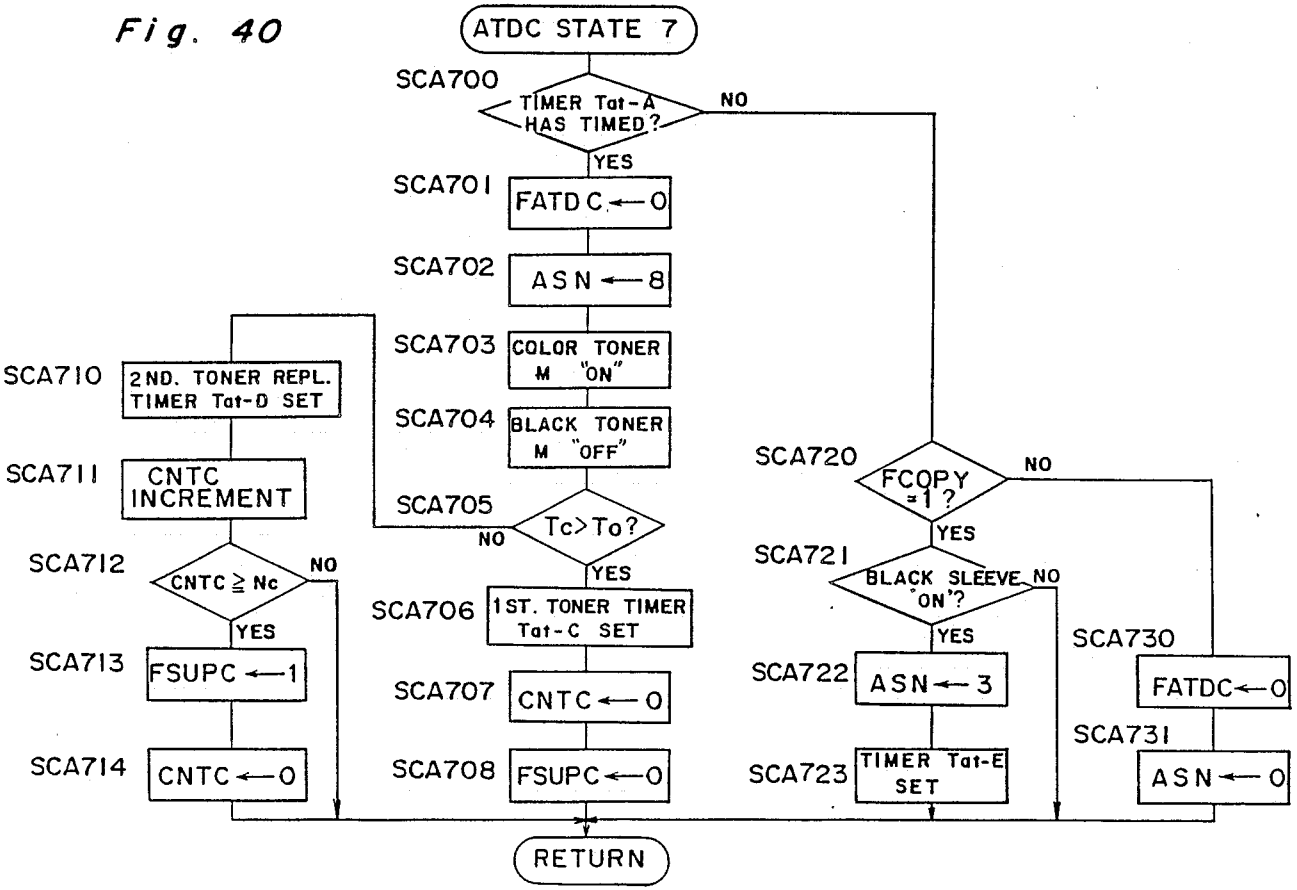

ATDC state 7 (FIG. 40)

The ATDC state 7 is provided for replenishing the color toner during development of the first (color) developing device 5. At step SCA700, a decision is made as to whether or not the timer Tat-A set in the ATDC state 6 has timed. In the case of "YES" at step SCA700, the program flow proceeds to step SCA701.

At step SCA701, the ATDC detection timing flag FATDC is set to 0 and at step SCA702, the ATDC state No. ASN is set to 8. Subsequently, the color toner replenishment motor is turned on at step SCA703 and the black toner replenishment motor is turned off at step SCA704. Thereafter, at step SCA705, a decision is made as to whether or not the toner density Tc in the first (color) developing device 5 is lager than the predetermined reference level To. In the case of "YES" at step SCA705, the first toner replenishment timer Tat-C having the preset time period T-C of 180 msec. is started at step SCA706. Subsequently, the counter flag CNTC is reset to 0 at step SCA707 and the special color toner replenishment flag FSUPC is reset to 0 at step SCA708. On the other hand, in the case of "NO" at step SCA705, the second toner replenishment timer Tat-D having the preset time period T-D of 3,990 msec. is started at step SCA710. Subsequently, the count of the counter CNTC is increased at step SCA711 and a decision is made at step SCA712 as to whether or not the counted number of the counter CNTC is lager than the predetermined reference value Nc. If the case of "YES" at step SCA712, namely when the consumption of toner is extremely large, the special color toner replenishment flag FSUPC is set to 1 at step SCA713 and the counter CNTC is cleared at step SCA714.

Meanwhile, in the case of "NO" at step SCA700, the program flow proceeds to step SCA72 at which a decision is made as to whether or not copying is being performed. In the case of "NO" at step SCA720, the ATDC detection timing flag FATDC is set to 0 at step SCA730 and the ATDC state No. ASN is set to 0 at step SCA731 and the program flow returns. In the case of "YES" at step SCA720, a decision is made at step SCA721 as to whether or not the second (black) developing sleeve 61 is in the ON state. In the case of "YES" at step SCA721, the ATDC state No. ASN is set to 3 at step SCA722 and the timer Tat-E is set at step SCA723 and the program flow returns.

Figure 41:
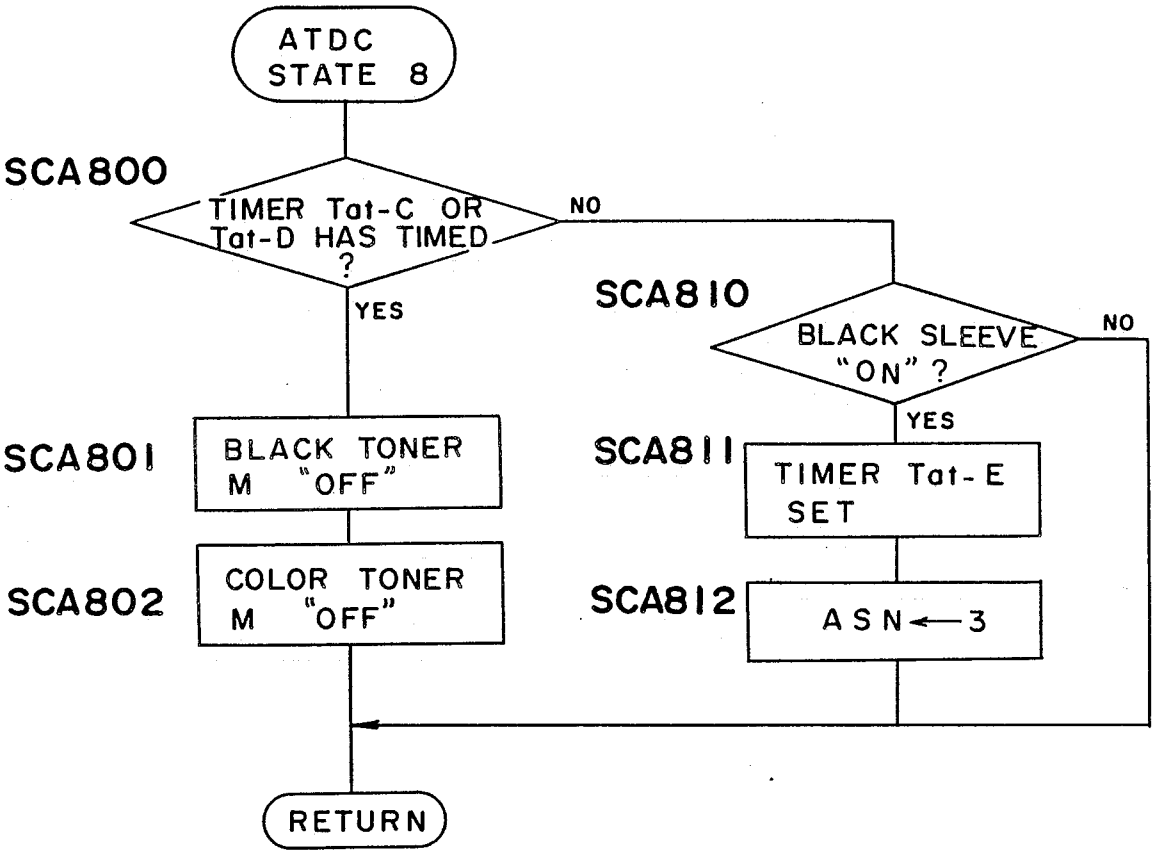

ATDC state 8 (FIG. 41)

In the ATDC state 8, a decision is made at step SCA800 as to whether or not the toner replenishment timer Tat-C or Tat-D set in the above described ATDC state 7 has timed. In the case of "YES" at step SCA800, the black toner replenishment motor and the color toner replenishment motor are, respectively, turned off at steps SCA801 and SCA802 and the program flow returns. On the other hand, in the case of "NO" at step SCA800, a decision is made at step SCA810 as to whether or not the second (black) developing sleeve 61 is in the ON state. In the case of "YES" at step SCA810, the timer Tat-E is set at step SCA811 and the ATDC state No. ASN is set to 3 at step SCA812 and the program flow returns.

Figure 42A:
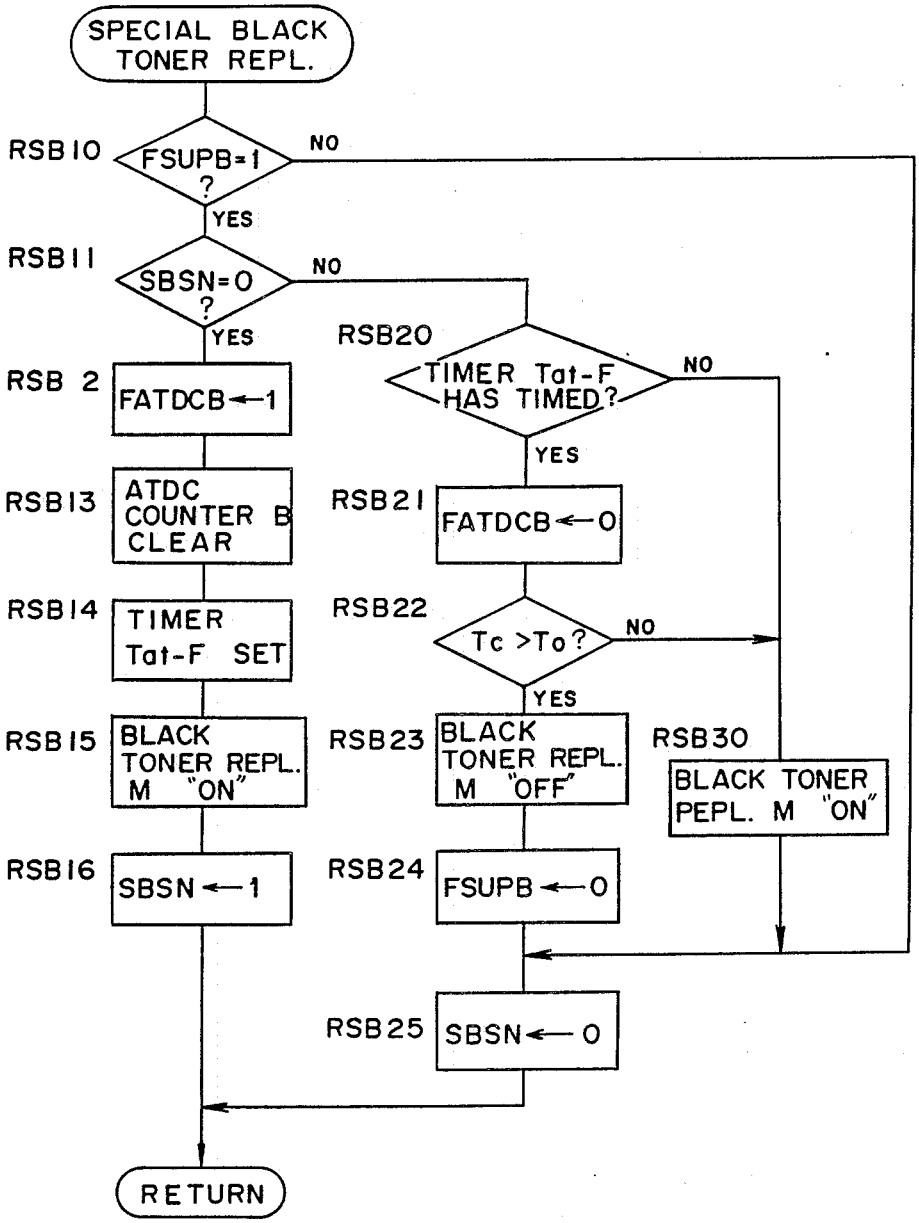
FIG. 42A is a flow chart of a subroutine for special black toner replenishment in the copying apparatus of FIG. 1.
Figure 42B:
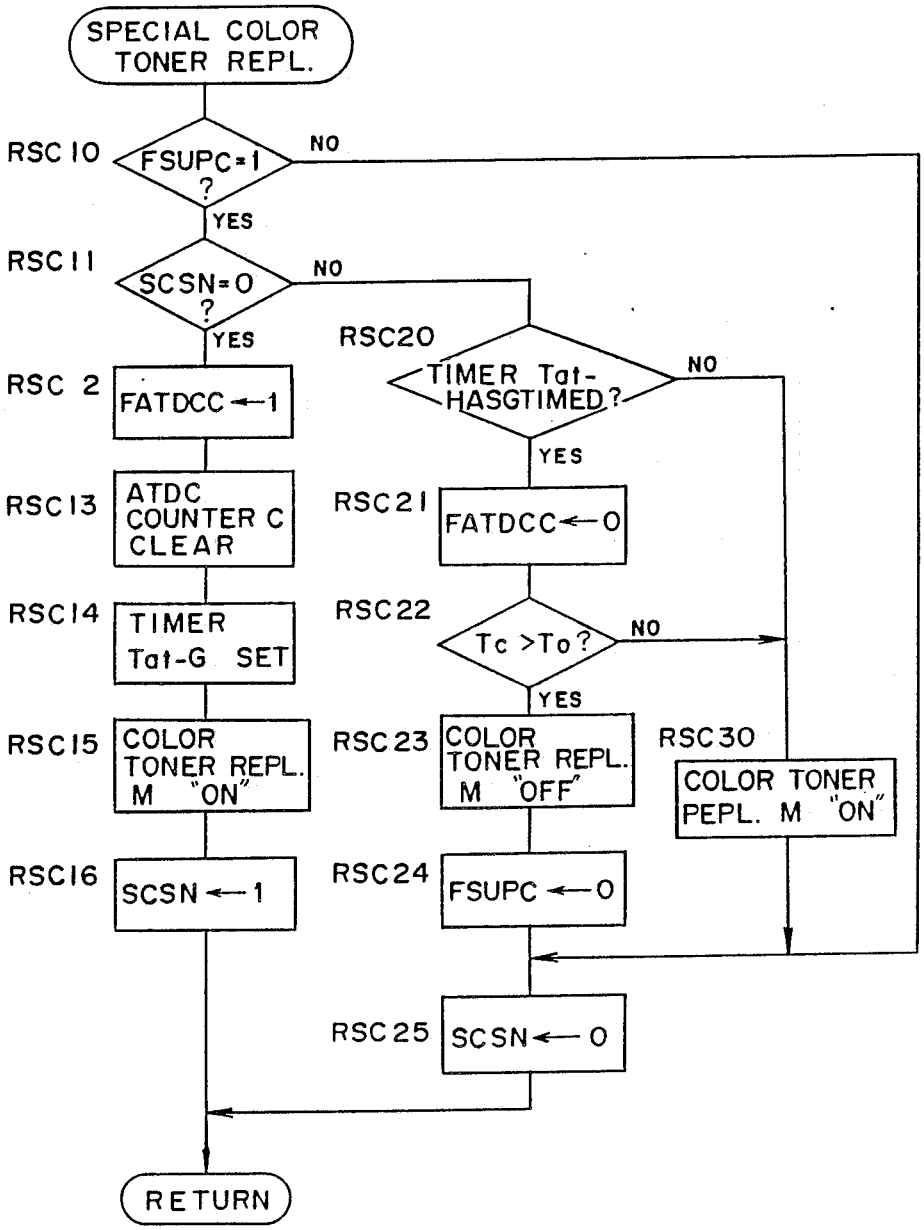
FIG. 42B is a flow chart of a subroutine for special color toner replenishment in the copying apparatus of FIG. 1.
Figure 42:
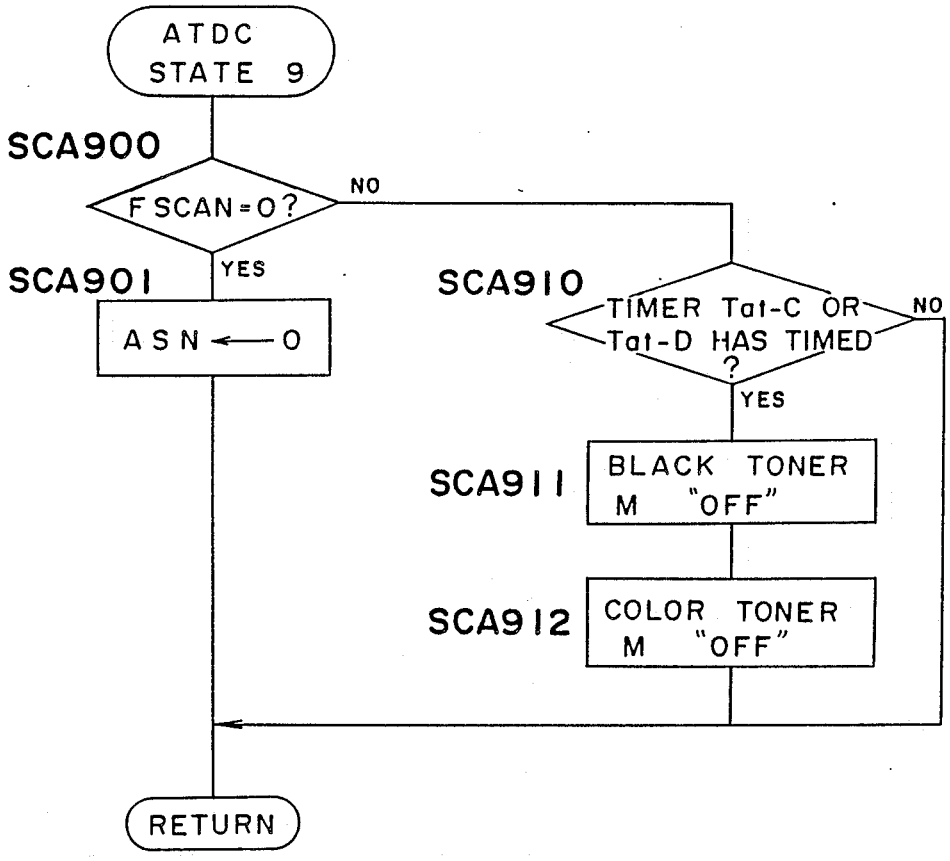
Figure 44:
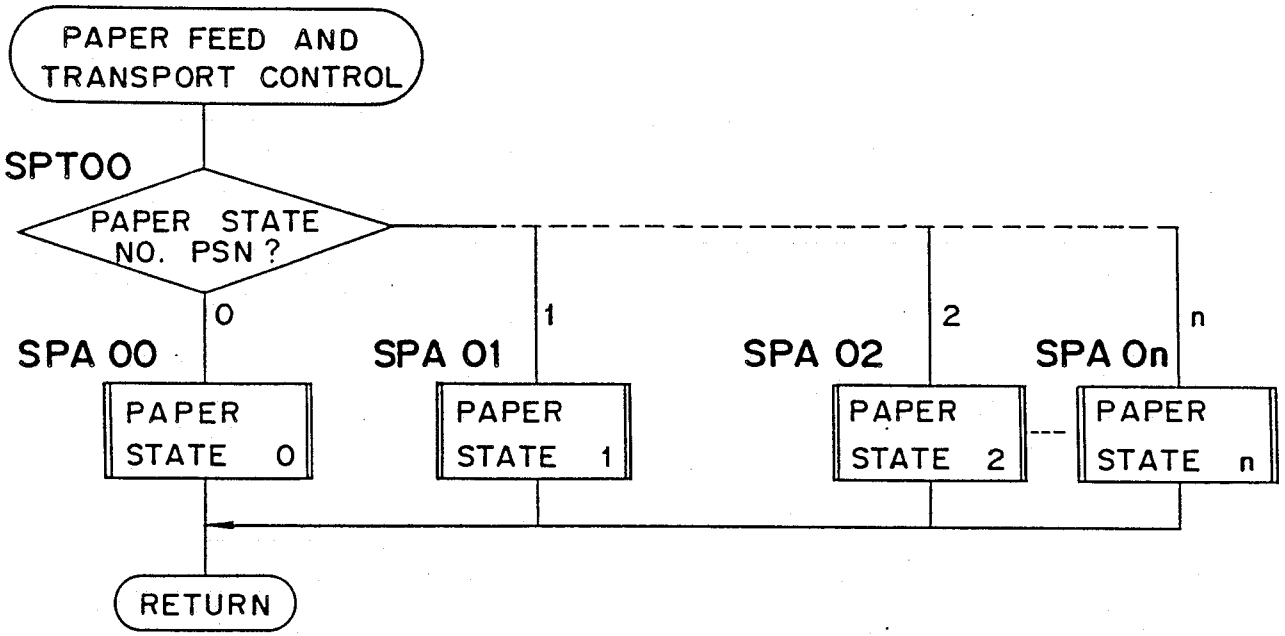
FIG. 44 is a flow chart of a subroutine for paper feed control in the copying apparatus of FIG. 1.

ATDC state 9 (FIG. 42)

In the ATDC state 9, a decision is made at step SCA900 as to whether or not scanning has been completed. In the case of "YES" at step SCA900, the ATDC state No. ASN is set to 0 at step SCA901 and the program flow returns.

On the other hand, in the case of "NO" at step SCA900, a decision is made at step SCA910 as to whether or not the timer Tat-C or Tat-D has timed In the case of "YES" at step SCA910, the black toner replenishment motor and the color toner replenishment motor are, respectively, turned off at steps SCA911 and SCA912.

Special toner replenishment subroutine

A special black toner replenishment subroutine and a special color toner replenishment subroutine are, respectively, provided for specially replenishing toner to the developing device in the case where the number counted how many times the toner density Tc, of the developing device, detected at each one routine time in the second toner replenishment performance is larger than the predetermined reference level To reaches the predetermined value Nb or Nc, namely when it is judged that the consumption of toner is extremely large, in the above-described ATDC state 1, 4 and 7.

(I) Special black toner replenishment subroutine (FIG. 42A)

In the special black toner replenishment subroutine, a decision is made at step RSB10 as to whether or not the special black toner replenishment flag FSUPB is 1. If the case of "YES" at step RSB10, program flow proceeds to step RSB11. If the case of "NO" at step RSB10, program flow returns. The special black toner replenishment flag FSUPB is set to 1 in the case where consumption of black toner is extremely large as described above.

Subsequently, at step RSB11, a decision is made as to whether or not a state No. SBSN is 0. The state No. SBSN is set to 0 in the case where the power source of the copying apparatus is turned on. If the state No. SBSN is 0 at step RSB11, after a FATDCB flag FATDCB is set to 1 at step RSB2 so that the signal of the ATDC sensor AS2 is inputted to the microcomputer, a ATDC counter B for judging a toner density in the special black toner replenishment is cleared at step RSB13. Then, a timer Tat-F for defining an input time period (number of times) of the ATDC sensor AS2 is started at step RSB14. Drive of the black toner replenishment motor is started at step RSB15 so as to start replenishing toner to the second developing device 6. After that, the state No. SBSN is set to 1 at step RSB16.

Meanwhile, if the state No. SBSN is not 0 at step RSB11, program flow proceeds to step RSB20 and a decision is made at step RSB20 as to whether or not the timer Tat-F started at step RSB14 has timed. If the case of "NO" at step RSB20, the black toner replenishment is continued to replenish at step RSB30. If the case of "YES" at step RSB20, the FATDCB flag FATDCB is reset to 0 at step RSB21 so that a signal from the ATDC sensor AS2 is not inputted to the microcomputer. Then, a decision is made at step RSB22 as to whether or not the toner density Tc is large than the predetermined reference level To. If the case of "NO" at step RSB22, the black toner replenishment is continued to replenish at step RSB30. Namely, if the timer Tat-F has timed, the black toner replenishment is continued to replenish until the toner density Tc is large than the reference level To. If the case of "YES" at step RSB22, the toner replenishment is stopped at step RSB23, the special black toner replenishment flag FSUPB is reset to 0 at step RSB24 and the state No. SBSN is reset to 0 at step RSB25. Then, program flow returns.

(II) Special color toner replenishment subroutine (FIG. 42)

In this special color toner replenishment subroutine, a decision is made at step RSC10 as to whether or not the special color toner replenishment flag FSUPC is 1. If the case of "YES" at step RSC10, program flow proceeds to step RSC11. If the case of "NO" at step RSC10, program flow returns. The special color toner replenishment flag FSUPC is set to 1 in the case where consumption of color toner is extremely large as described above.

Subsequently, at step RSC11, a decision is made as to whether or not a state No. SCSN is 0. The state No. SCSN is set to 0 in the case where the power source of the copying apparatus is turned on. If the state No. SCSN is 0 at step RSC11, after a FATDCC flag FATDCC is set to 1 at step RSC2 so that the signal of the ATDC sensor AS1 is inputted to the microcomputer, a ATDC counter C for judging a toner density in the special color toner replenishment is cleared at step RSC13. Then, a timer Tat-G for defining an input time period (number of times) of the ATDC sensor AS1 is started at step RSC14. Drive of the color toner replenishment motor is started at step RSC15 so as to start replenishing toner to the first developing device 5. After that, the state No. SCSN is set to 1 at step RSC16.

Meanwhile, if the state No. SCSN is not 0 at step RSCll, program flow proceeds to step RSC20 and a decision is made at step RSC20 as to whether or not the timer Tat-G started at step RSC14 has timed. If the case of "NO" at step RSC20, the color toner replenishment is continued to replenish at step RSC30. If the case of "YES" at step RSC20, the FATDCC flag FATDCC is reset to 0 at step RSC21 so that a signal from the ATDC sensor AS1 is not inputted to the microcomputer. Then, a decision is made at step RSC22 as to whether or not the toner density Tc is large than the predetermined reference level To. If the case of "NO" at step RSC22, the color toner replenishment is continued to replenish at step RSC30. Namely, if the timer Tat-G has timed, the color toner replenishment is continued to replenish until the toner density Tc is large than the reference level To. If the case of "YES" at step RSC22, the toner replenishment is stopped at step RSC23, the special color toner replenishment flag FSUPC is reset to 0 at step RSC24 and the state No. SCSN is reset to 0 at step RSC25. Then, program flow returns.

(D) ATDC sensor detection subroutine

Figure 43:
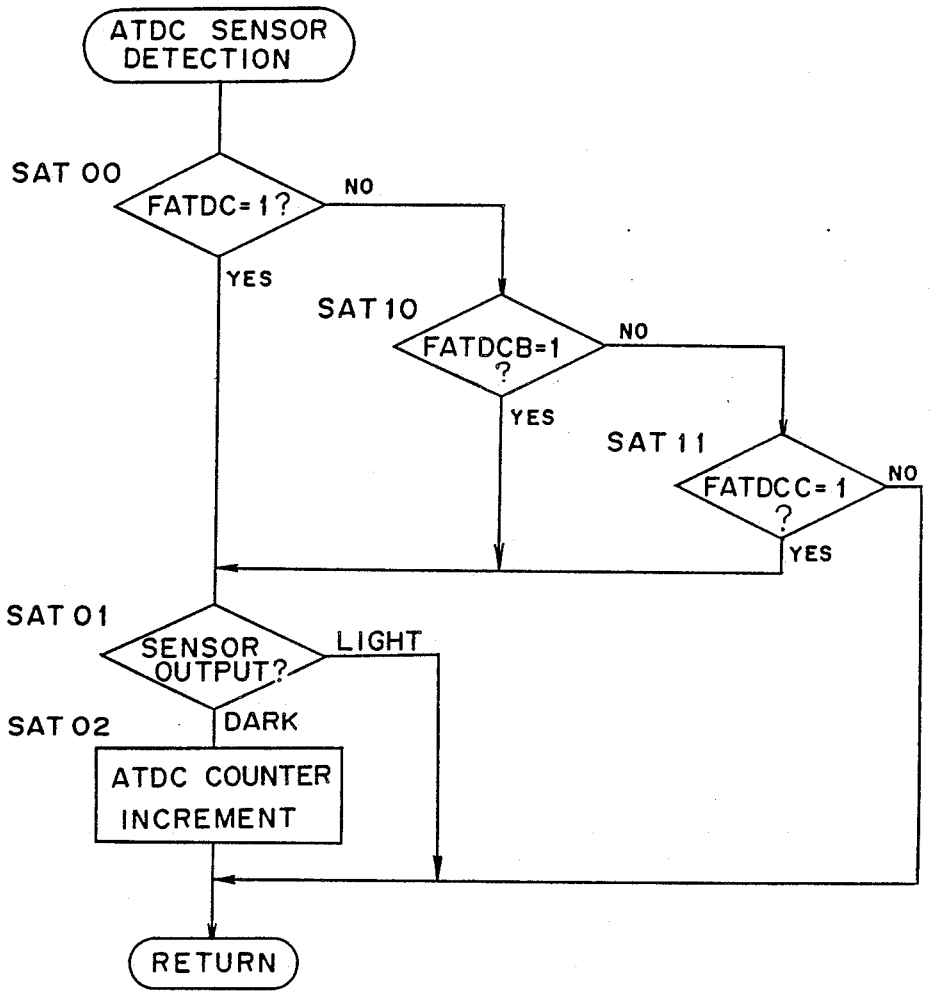
FIG. 43 is a flow chart of a subroutine for detecting by ATDC sensors in the copying apparatus of FIG. 1.

Hereinbelow, the ATDC sensor detection subroutine is described with reference to FIG. 43. This subroutine is provided for detecting the toner density Tc on the basis of a signal inputted, during the preset time periods T-A, T-B, T-C of the timers Tat-A, Tat-F, Tat-G, from either one of the ATDC sensors AS1 and AS2 in a corresponding one of the first and second developing devices 5 and 6 in use.

At step SAT00, a decision is made as to whether or not the ATDC detection timing flag FATDC is 1, namely the above timers Tat-A Tat-B, Tat-C are, respectively, counting the preset time period. In the case of "YES" at step SAT00, a decision is made at step SAT01 as to whether or not the output voltage of the ATDC sensor AS1 or AS2 is higher than a predetermined reference voltage. In the case of "YES" at step SAT01, count of the ATDC counter is increased.

More specifically, for example, the timer Tat-A has the preset time period of 330 msec. and a time period for executing one routine of this subroutine is set to 30 msec. Thus, during the preset time period of the timer Tat-A, 11 data are sampled and compared with the reference level respectively. When the counts of the ATDC counter etc. in the case where the toner density is higher than the reference level are 6 or more, it is judged that the each toner density Tc is higher than the reference density To.

Meanwhile, if, at step SAT00, it is judged that the ATDC detection timing flag FATDC is 0, a decision is made at step SAT10 as to whether or not the FATDCB flag for controlling special black toner replenishment is 1. If the case of "YES" at step SAT00, program flow proceeds to step SCA01. If the case of "NO" at step SAT11, a decision is made as to whether or not the FATDCC flag for controlling special color toner replenishment is 1. If the case of "YES" at step SAT11, program flow proceeds to step SAT01. If the case of "NO" at step SAT11, program flow returns.

(E) Paper feed and transport control subroutine

Hereinbelow, the paper feed and transport control subroutine is described with reference to FIGS. 44 to 47. This subroutine is provided for controlling feed of the copy paper sheet from the paper feeding mechanism 30 such that the leading edge of the copy paper sheet coincides with the front edge of the electrostatic latent image formed on the photosensitive drum 2 and corresponding to the image of the original document, for controlling ejection of the copy paper sheet having the toner image transferred and fixed thereon to the paper discharge portion 42 and for proceeding to suspend the copying operation so that the paper feed is stopped during the special toner replenishment. Hereinbelow, the subroutine thereof is described.

In this subroutine, initially at step SPT00, a paper state No. PSN is judged. On the basis of a value of the paper state No. PSN, the program flow proceeds to one of steps SPA00 to SPA0n for paper states 0 to n, respectively.

Meanwhile, at the time when the power source of the copying apparatus 1 has been turned on, the paper state No. PSN is set to 0 in the initialization subroutine of the main routine.

Figure 45:
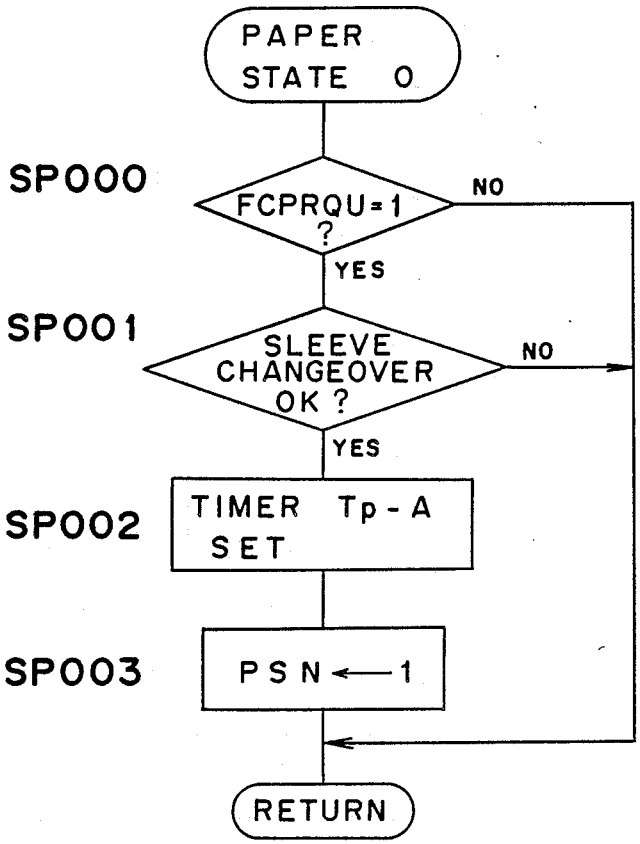
FIGS. 45 to 47 are flow charts showing paper states in the copying apparatus of FIG. 1.

Paper state 0 (FIG. 45)

In the paper state 0, if it is found at step SP000 that copying has been started upon depression of the print switch 102, etc., namely, a flag FCPRQU for indicating copying start timing is 1, a decision is made at step SP001 as to whether or not changeover of the developing sleeve can be performed. If the case of "YES" at step SP001, program flow proceeds to the following steps. Subsequently, a timer Tp-A is set at step SP002 and the paper state No. PSN is set to 1 at step SP003 and then, the program flow returns.

Figure 46:
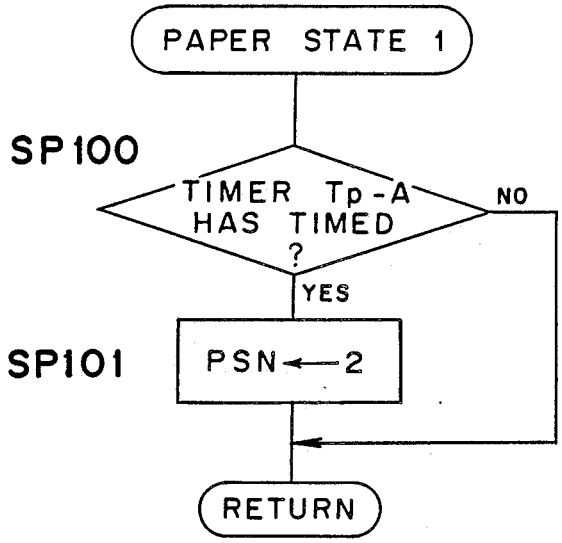

Paper state 1 (FIG. 46)

In the paper state 1, it is judged at step SP100 whether or not the above described timer Tp-A has timed. The program flow remains in a waiting state until the timer Tp-A has timed. When the timer Tp-A has timed, the paper state No. PSN is set to 2 at step SP101 and the program flow returns.

Figure 47:
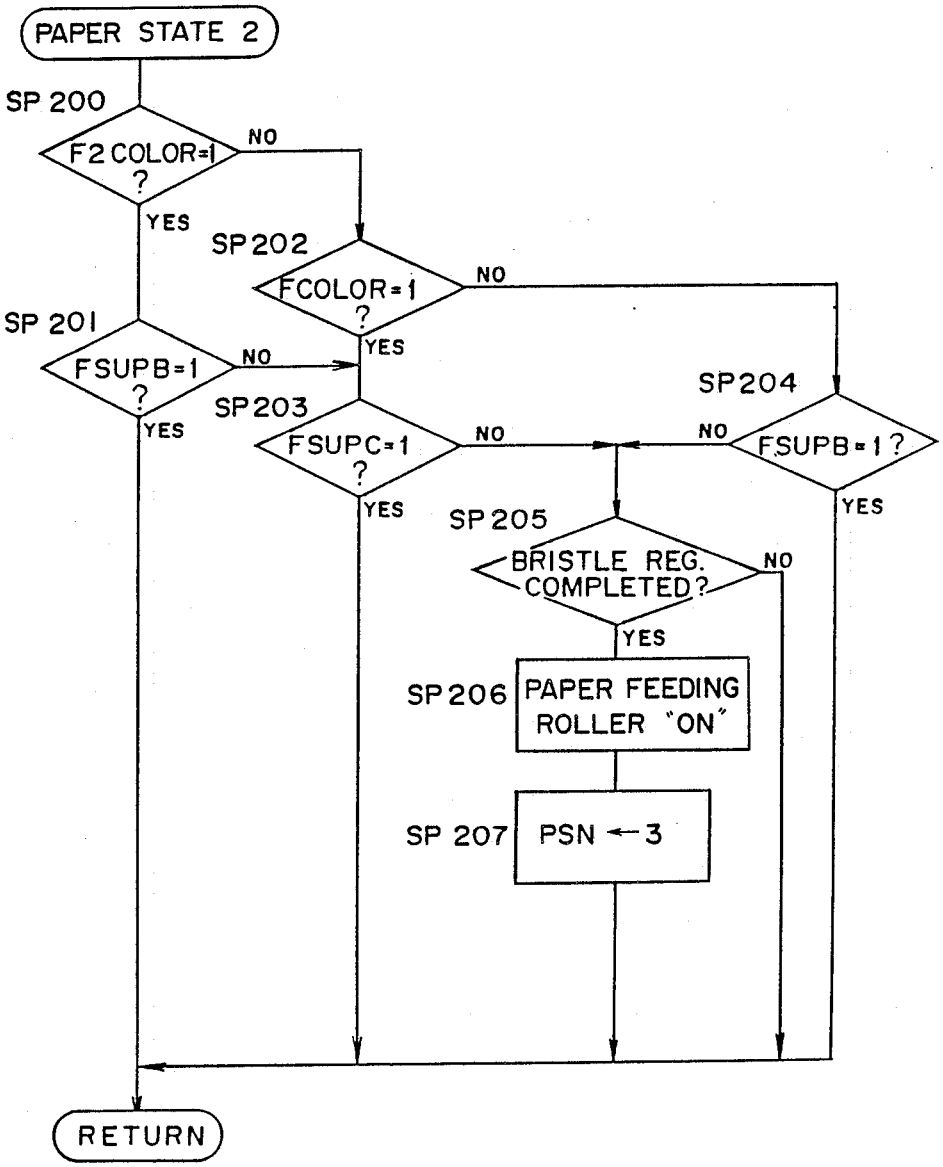
Figure 48:
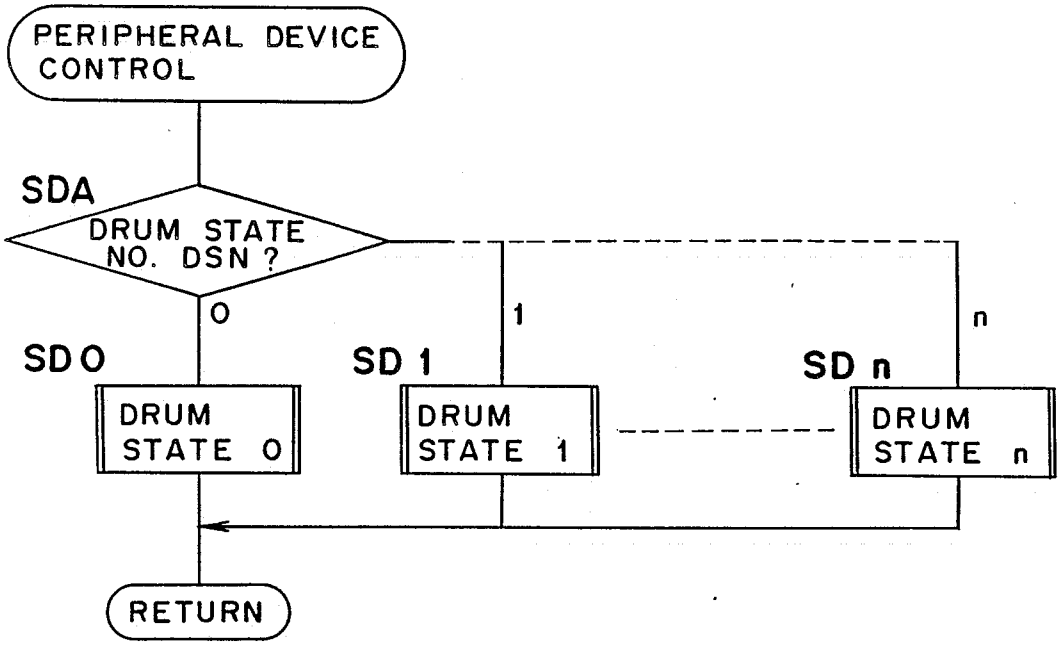
FIG. 48 is a flow chart of a subroutine for control elements provided around a photosensitive drum in the copying apparatus of FIG. 1.

Paper state 2 (FIG. 47)

This paper state 2 is provided for judging whether or not one of the first and second developing devices 5 and 6 is in the special toner replenishment state, so that the paper feed is performed in the only case where the devices are not in the replenishment state. At steps SP200 and SP202, the copying mode is judged. Then, a decision is made at steps SP201 and SP204 as to whether or not it is in the special black toner replenishment state. On the other hand, a decision is made at step SP203 as to whether or not it is in the special color toner replenishment state. Then, if the case of "YES" at the above steps SP201, SP204 and SP203, program flow returns so as to stop feeding the copy paper sheet during that time period.

Meanwhile, if the case of "NO" at steps SP204 and SP203, it is judged at step SP205 whether or not bristle regulation has been completed prior to copying so as to remove the developer from the surface of the developing sleeve 61 of the second (black) developing device 6. In the case of "YES" at step SP205, drive of the paper feeding roller 32*b* or 33*b* is started at step SP206 so as to permit copying operation and the paper state No. PSN is set to 3 at step SP207 and then, the program flow returns.

(F) Peripheral device control subroutine

Hereinbelow, the peripheral device control subroutine is described with reference to FIGS. 48 to 53. This subroutine is provided for controlling the peripheral devices of the photosensitive drum 2, i.e. the corona charger 3, the developing bias voltages of the first and second developing sleeve 51 and 61, the exposure lamp 11 of the optical system 0, etc. Initially, at step SDA, a drum state No. DSN is judged. On the basis of values of the drum state No. DSN, the program flow proceeds to steps SD0 to SDn for drum states 0 to n, respectively.

Figure 49:
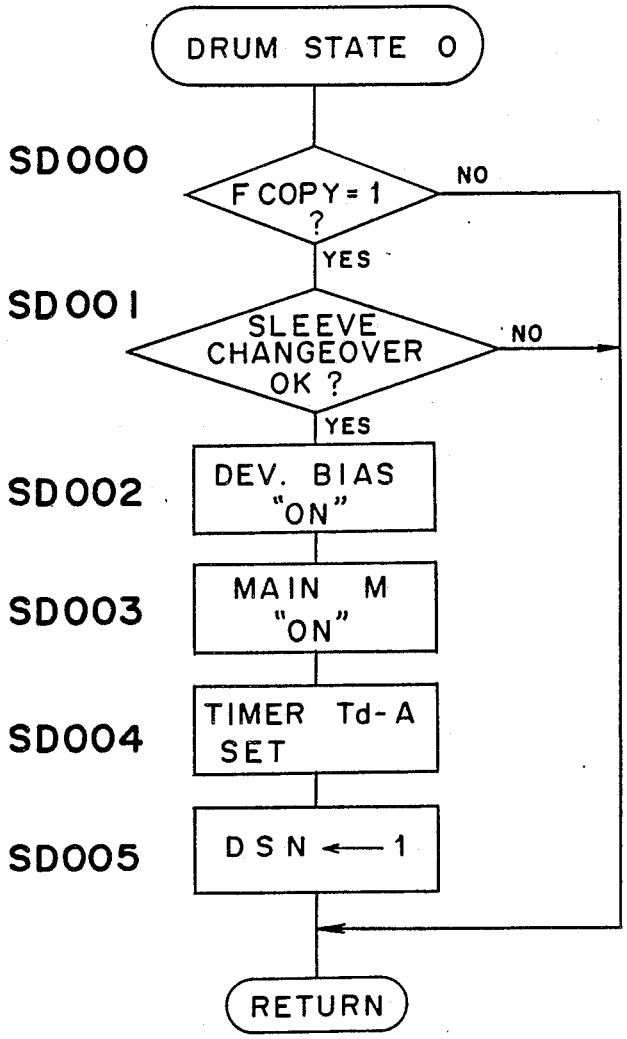
FIGS. 49 to 53 are flow charts showing drum states in the copying apparatus of FIG. 1.

Drum state 0 (FIG. 49)

In the drum state 0, it is initially judged at step SD000 whether or not the copy flag FCOPY is 1 upon depression of the print switch 102. Then, at step SD001, it is judged whether or not drive of the main motor has been changed over to the second (black) developing device 6. In the case of "YES" at not only step SD000 but step SD001, steps SD002 to SD005 are executed. On the other hand, in the case of "NO" at one of steps SD000 and SD001, the program flow returns so as to remain in a waiting state. At step SD002, the developing bias voltage is turned on and at step SD003, the main motor is turned on. Subsequently, at step SD004, a timer Td-A for delaying actuation of the transfer charger 7 is set and the drum state No. DSN is set to 1 at step SD005.

Figure 50:
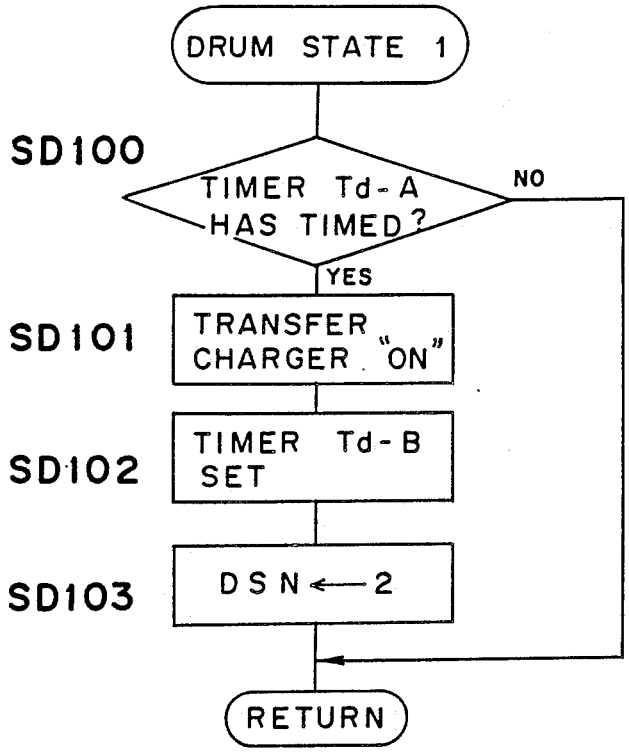

Drum state 1 (FIG. 50)

In the drum state 1, it is judged at step SD100 whether or not the timer Td-A has timed. In the case of "NO" at step SD100, the program flow returns so as to remain in a waiting state. Meanwhile, in the case of "YES" at step SD100, the transfer charger 7 is turned on at step SD101, a timer Td-B for delaying start of exposure is set at step SD102, the drum state No. DSN is set to 2 at step SD103 and the program flow returns.

Figure 51:
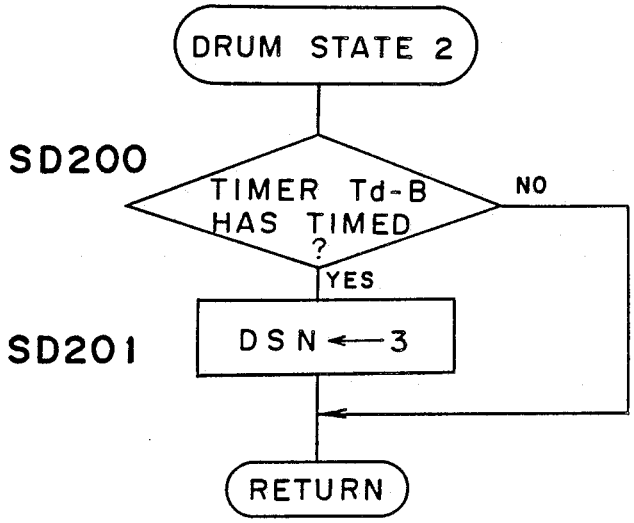

Drum state 2 (FIG. 51)

In the drum state 2, it is judged at step SD200 whether or not the above described timer Td-B has timed. In the case of "NO" at step SD200, the program flow returns so as to remain in a waiting state. In the case of "YES" at step SD200, the drum state No. DSN is set to 3 at step SD201.

Figure 52:
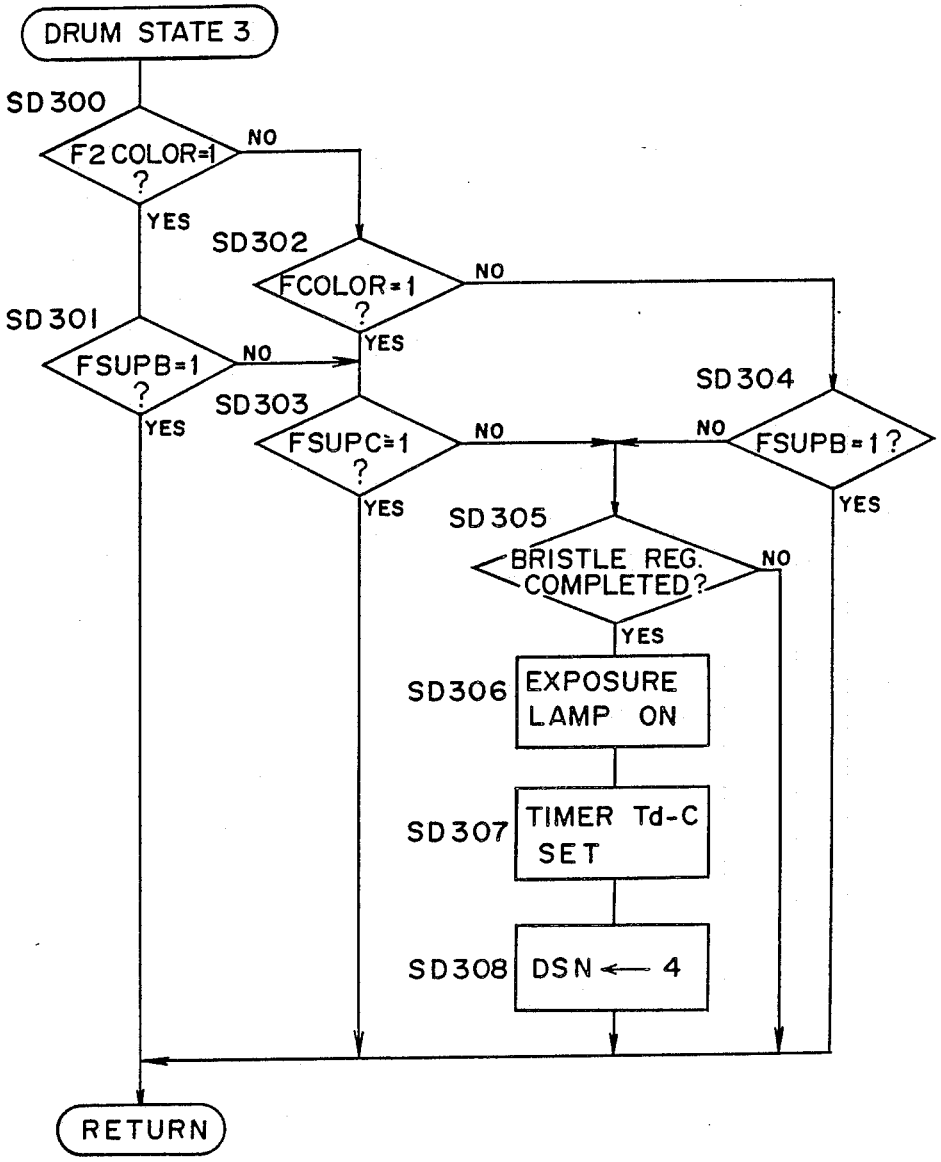

Drum state 3 (FIG. 52)

This paper state 3 is provided for judging whether or not one of the first and second developing devices 5 and 6 is in the special toner replenishment state, so that the exposure lamp 11 is turned on in the only case where the devices are not in the replenishment state. At steps SD300 and SD302, the copying mode is judged. Then, a decision is made at steps SD301 and SD304 as to whether or not it is in the special black toner replenishment state. On the other hand, a decision is made at step SD303 as to whether or not it is in the special color toner replenishment state. Then, if the case of "YES" at the above steps SD301, SD304 and SD303, program flow returns so as to remain in a waiting state.

Meanwhile, if the case of "NO" at steps SD304 and SD303, it is judged at step SD305 whether or not bristle regulation on the surface of the second developing sleeve 61 has been completed prior to copying so as to remove the developer from the surface of the developing sleeve 61 of the second (black) developing device 6. In the case of "NO" at step SD305, the program flow returns so as to remain in a waiting state. In the case of "YES" at step SD305, the exposure lamp 11 of the optical system 0 is turned on at step SD306 so as to start copying operation and a timer Td-C for delaying actuation of the corona charger 3 is set at step SD307. Then, the drum state No. DSN is set to 4 at step SD308 and the program flow returns.

Figure 53:
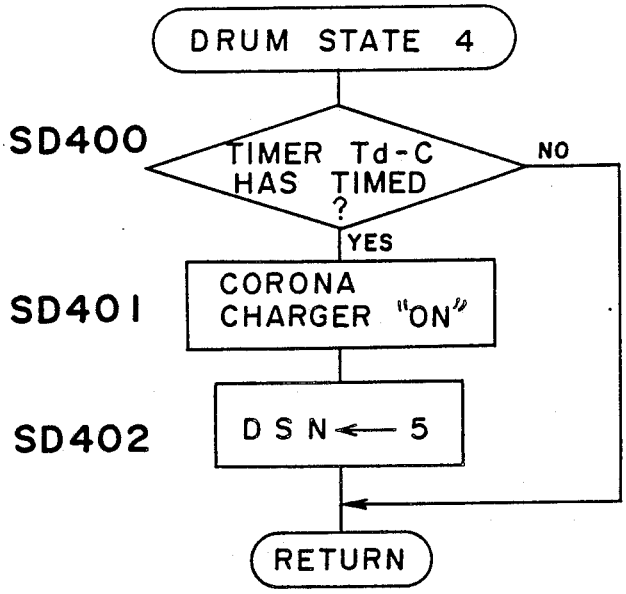

Drum state 4 (FIG. 53)

In the drum state 4, it is judged at step SD400 whether or not the above described timer Td-C has timed. In the case of "NO" at step SD400, the program flow returns so as to remain in a waiting state. In the case of "YES" at step SD400, the corona charger 3 is turned on at step SD401 and the drum state No. DSN is set to 5 at step SD402 and the program flow returns.

Figure 54:
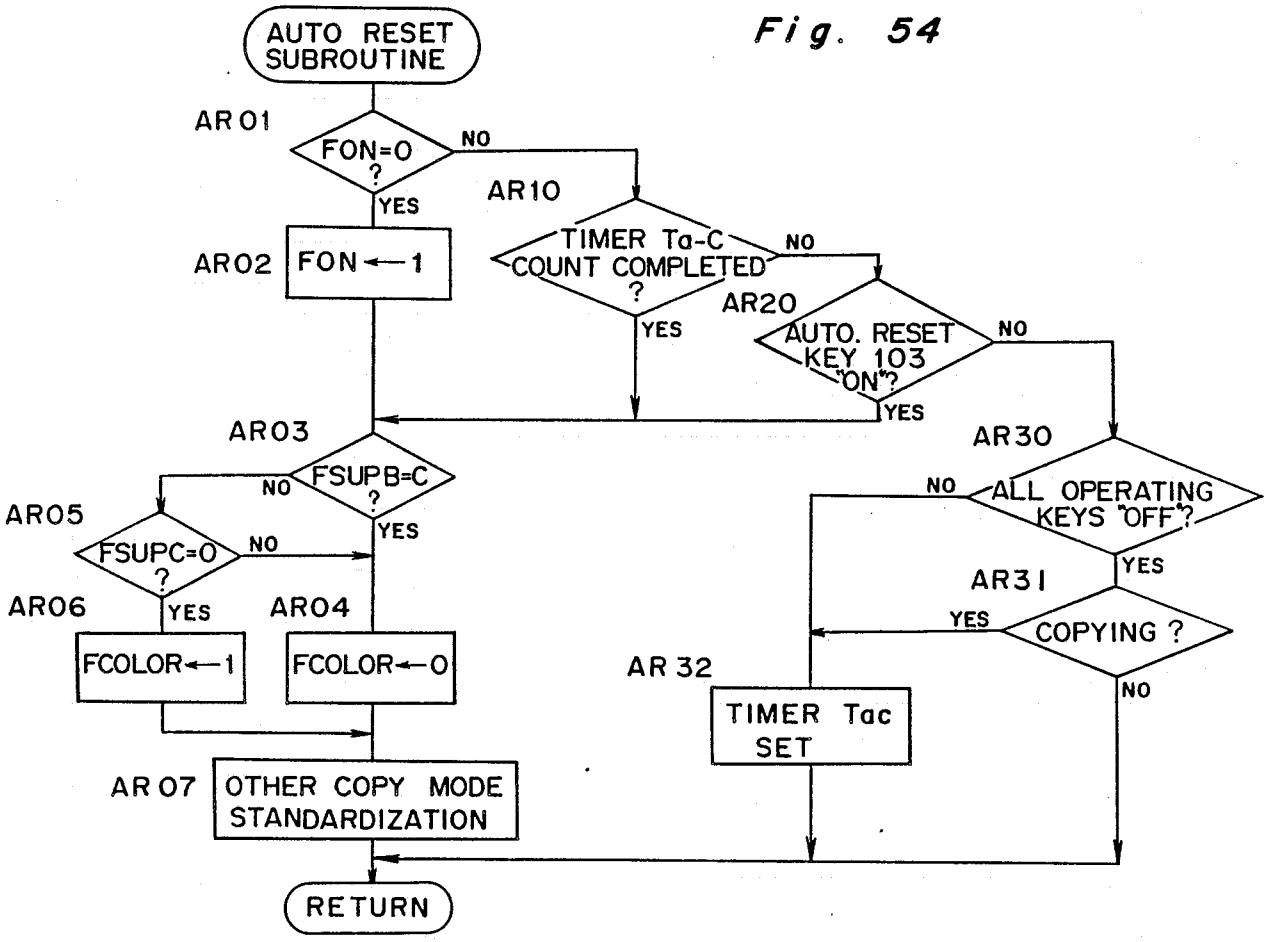
FIG. 54 is a flow chart of a subroutine for automatic reset in the copying apparatus of FIG. 1.

(G) Auto reset subroutine (FIG. 54)

This subroutine is provided for changing over a copy number set mode and an exposure mode to a standard state, namely, for example, executing such a process that the copy number is set to 1 and a copy mode is changed over to a standard copy mode after canceling a special copy mode, in turning on of the power source of the copying apparatus, non-operation of various switches and keys on the operating panel 100 during a predetermined time period, non-operation of copying during a predetermined time period or turning on of the automatic reset key 103 on the operating panel 100.

At step AR01, it is judged whether or not a FON flag is 1. If the case of "YES" at step AR01, program flow proceeds to step AR02. If the case of "NO" at step AR01, program flow proceeds to step AR10. The FON flag is provided for setting to 0 in turning on of the power source of the copying apparatus. Therefore, the program flow proceeds to step AR02 in the only case where the power switch of the copying apparatus is turned on. Then, the program flow proceeds to step AR10 in other case.

Subsequently, at step AR02, the FON flag is set to 1 and at step AR03, a decision is made as to whether or not the special black toner replenishment flag FSUPB is 0, namely, the special black toner replenishment mode is selected. If the case of "YES" at step AR03, the copying mode flag FCOLOR is reset to 0 at step AR04. If the case of "NO" at step AR03, a decision is made at step AR05 as to whether or not the special color toner replenishment mode is selected. If the case of "NO" at step AR05, namely, when the special color toner replenishment is selected, program flow proceeds to step AR04. IF the case of "YES" at step AR05, the copying mode flag FCOLOR is set to 1. Namely, if the special (black or color) toner replenishment mode is selected, the copying mode flag FCOLOR is reset to 0 at step AR04 and if the special toner replenishment mode is not selected, the copying mode flag FCOLOR is set to 1 at step AR06.

After predetermined procedures have been completed at steps AR04 and AR06, respectively, other copying modes, that is, the copy number mode, the exposure mode and the special copying mode (for example, book separation copying mode) are reset to standard states, respectively.

According to the above-described description, if neither the first nor second developing devices 5, 6 is in the special toner replenishment state, the second developing device 6 having a priority over the first developing device 5 is initially selected in the case of turning on of the power source of copying apparatus and in the case where the timer Tac has timed in non-copying operation. Then, if the second developing device 6 is in the special toner replenishment state, the first developing device 5 is automatically selected.

Meanwhile, if it is judged that the FON flag is 1 at step AR01, a decision is made at step AR10 as to whether or not a timer Tac set at step AR32 to be described later has timed. If the case of "YES" at step AR10, program flow proceeds to step AR0. If the case of "NO" at step AR10, or if the timer Tac is not set, program flow proceeds to step AR20 at which a decision is made as to whether or not the auto reset key 103 on the operating panel 100 has been turned on. If the case of "YES" at step AR20, program flow proceeds to step AR03. If the case of "NO" at step AR20, a decision is made at step AR30 as to whether or not all keys on the operating panel 100 have been turned off. If the case of "YES" at step AR30, a decision is made at step AR31 as to whether or not copying is being performed. If the case of "NO" at step AR30, program flow proceeds to step AR32 at which the timer Tac is set. Then, program flow returns. If the case of "YES" at step AR31, program flow proceeds to step AR32. If the case of "NO" at step AR31, program flow returns.

Figure 55:
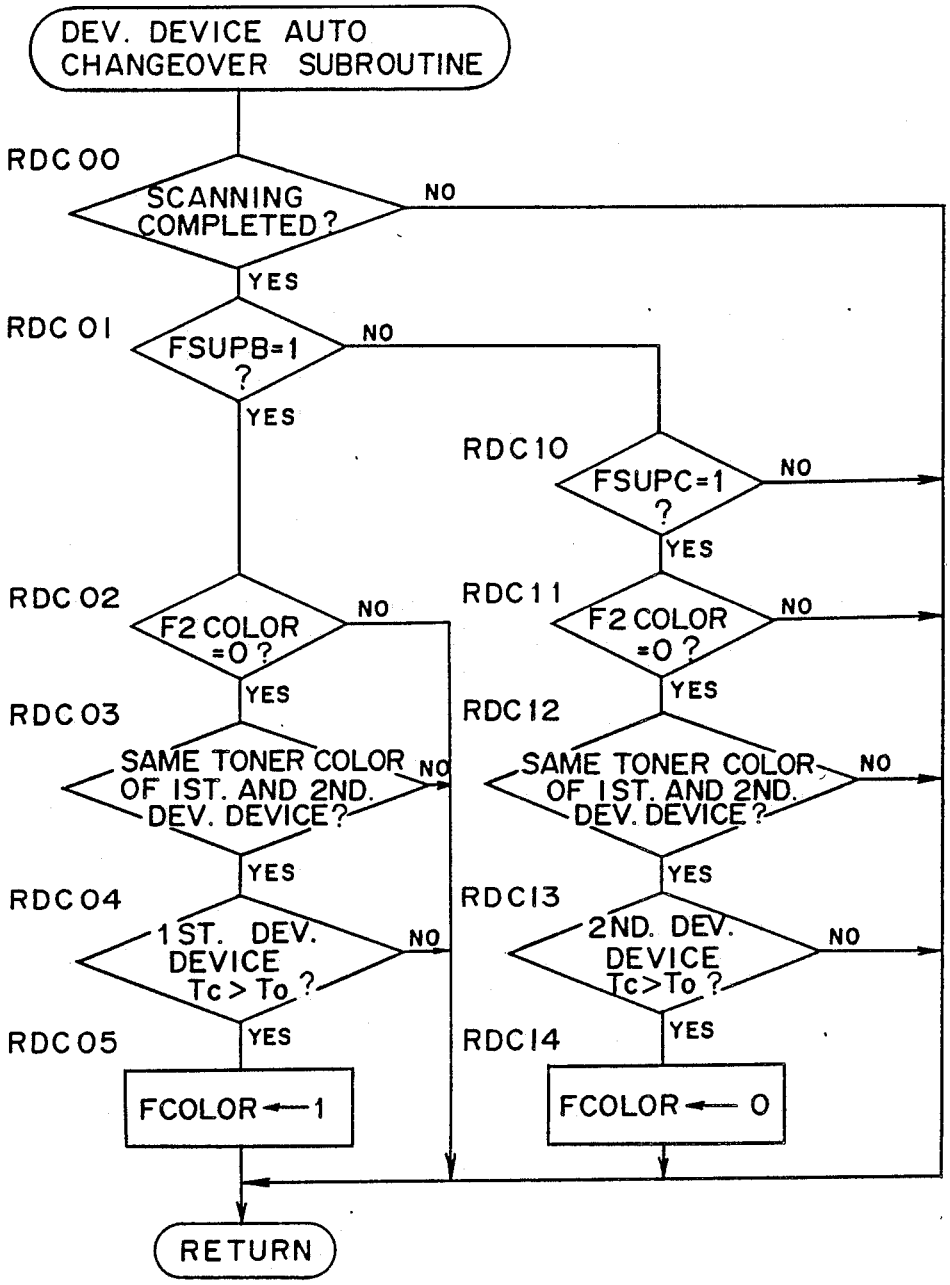
FIG. 55 is a flow chart of a subroutine for automatic changeover of developing devices in the copying apparatus of FIG. 1.

(H) Developing automatic changeover subroutine (FIG. 55)

The developing automatic changeover subroutine is provided for changing over the developing device to be used to other developing device to continue copying operation in the case where it is judged that toner replenishment can not perform by usual toner replenishment since toner consumption is unusually and extremely large in the ATDC states 1, 4 and 7 of the above ATDC control subroutine.

If it is judged that scanning of the copying apparatus has been completed at step RDC00, a decision is made at step RDC01 as to whether or not the special black toner replenishment mode is selected and a decision is made at step RDC10 as to whether or not the special color toner replenishment mode is selected. If the special black toner replenishment mode is selected, program flow proceeds to step RDC02. If the special color toner replenishment mode is selected, program flow proceeds to step RDC11. If neither the special black toner replenishment mode nor the special color toner replenishment mode is selected, program flow returns.

If the special black toner replenishment mode is selected, decisions are made at steps RDC02, RDC03 and RDC04 as to whether or not the simultaneous copying mode is selected, the toner color accommodated into the first developing device 5 is same as that accommodated into the second developing device 6, and the density Tc of toner into the first developing device 5 is higher than the reference level To, respectively. If the case of "YES" at steps RDC02, RDC03 and RDC04, the copying mode flag FCOLOR is set to 1 at step RDC05. Namely, the copying mode is changed over to a copying state where the first developing device 5 is used. If the case of "NO" at one of steps RDC02, RDC03 and RDC04, program flow proceeds returns.

Similarly, if the special color toner replenishment mode is selected, decisions are made at steps RDC11, RDC12 and RDC13 as to whether or not the simultaneous copying mode is selected, the toner color accommodated into the first developing device 5 is same as that accommodated into the second developing device 6, and the density Tc of toner into the second developing device 6 is higher than the reference level To, respectively. If the case of "YES" at steps RDC11, RDC12 and RDC13, the copying mode flag FCOLOR is set to 1 at step RDC14. Namely, the copying mode is changed over to a copying state where the second developing device 6 is used. If the case of "NO" at one of steps RDCll, RDC12 and RDC13, program flow proceeds returns.

Therefore, when other copying mode than the simultaneous copying mode is selected, if the density of toner into the first or second developing device is not higher than the reference level in spite of replenishment of toner to the first or second developing device, the developing device in using is changed over to other developing device.

It should be noted here that, in the above-described description, if the color toner is accommodated into the first developing device 5 and the black toner is accommodated into the second developing device 6, even if the developing device is in the special toner replenishment state, the developing device in using is not changed over to other device. If the color of toner accommodated into the first and second developing devices 5 and 6 is same, even if the density of toner into either one of the both developing devices 5 and 6 is lower than the reference level, the other developing device whose toner density is not lower can use to continue copying operation.

As is seen from the above description, according to the embodiment of the present invention, in the case where documents having images with much solid portion are continuously copied, even if density of toner accommodated into the developing device in using is lower than the determined reference level, the images is continuously developed by the other developing device having the same color toner as the toner in the developing device using. Therefore, in the apparatus, waiting time period is less than before and many documents can be copied in a short time while keeping images of copied papers in good quality.

Furthermore, when the plurality of developing devices have an order of priority respectively and the developing device having higher order of priority is in an unsuitable state for development, the device to be used is changed over from the developing device in using to other developing device having lower order of priority. Therefore, a copied image in good quality is continuously obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

It is to be noted here that, for example, in the copying apparatus, although it is described that ATDC sensors AS1 and AS2 are, respectively, provided for the first and second developing devices 5 and 6 to detect the density of toner into the developing devices in the above embodiment, this invention can be applied to such system that a reference latent image formed on the surface of the photosensitive drum 2 is developed into a visible image by the developing devices 5 and 6, so as to detect the toner density thereof. Such system is called an automatic image density control (AIDC). If the system is applied in the copying apparatus and the apparatus is constructed such that one toner density detection is performed in one copying operation, it becomes possible to prevent from unnecessary drop of toner density by application of the present invention.

Furthermore, it is to be noted that if the above-described copying apparatus has means for including such function that copying operation is resumed when the print switch 102 is turned on during the special toner replenishment mode and during stop of copying, copied image on the copying paper sheet is quickly obtained in spite of lower density of toner.

It is also to be noted that, according to the present invention, the copying apparatus can be constructed such that even if number counted drop of toner density reaches a predetermined value, in the case where the remain number in the number of documents to be successively copied is lower than a specified value, or where the replenishment has been performed longer than at least a specified time period, at that time, copying operation can be started.

It is further to be noted that, in the copying apparatus, the copying apparatus has a selection key for selecting the special toner replenishment and an operator can be depressed the key so as to replenish toner by his judgment when the toner density of a copied image on a copied paper drops.

It is to be noted that in the copying apparatus, when toner density in developer does not reach the predetermined value in spite of sufficient rotation of the toner replenishment motor, it can be judged that the toner replenishment bottles 81 and 91 are empty. Therefore, the copying apparatus can be constructed such that, in such case, toner replenishment is stopped and toner empty state is displayed.

What is claimed is:

1. An image forming apparatus in which an electrostatic latent image formed on a photosensitive member is developed by a developer incorporating toner and carrier and subsequently transferred to a paper, the apparatus comprising:

first and second developing means selectively operable for developing the electrostatic latent image by first and second developers, respectively;

toner accommodating means for accommodating toner to be replenished to each of the developers;

detecting means for detecting toner density in each of the developers;

judging means for judging whether the first and second developers have same color;

selecting means responsive to said detecting means and judging means for automatically selecting said second developing means in the case where the toner density in the first developer is less than a specified value and where the toner density in the second developer is not less than the specified value under the judgment by said judging means that the first and second developers have same color;

replenishing means for replenishing toner to each of the first and second developers; and means for activating said replenishing means so as to continuously replenish toner to the first developer until the toner density therein reaches the specified value in the case where both of the toner density in the first and second developers are less than the specified value even if the first and second developers have same color, while prohibiting an image forming operation.

2. A image forming apparatus as claimed in claim 1, wherein each of said first and second developing means is detachably provided in a main body of the apparatus.

3. An image forming apparatus as claimed in claim 1, wherein said detecting means detects the toner density in each of the first and second developers every image forming operation.

4. An image forming apparatus as claimed in claim 1, wherein each of said first and second developing means is provided with said detecting means.

5. An image forming apparatus as claimed in claim 2, wherein said judging means includes color representing means provided in said developing means for representing color of the developer accommodated thereinto and means provided in the main body for detecting the color represented by said color representing means.

6. An image forming apparatus in which an electrostatic latent image formed on a photosensitive member is developed by a developer incorporating toner and carrier and subsequently transferred to a paper, the apparatus comprising:

first and second developing means selectively operable for developing the electrostatic latent image by first and second developers, respectively;

toner accommodating means for accommodating toner to be replenished to each of the developers;

detecting means for detecting toner density in each of the developers every image forming operation;

first replenishing means responsive to said detecting means for replenishing a predetermined amount of toner from said respective toner accommodating means to the respective developer when the toner density detected by said detecting means is less than the specified value;

means for counting the continuous number of replenishment by said first replenishing means;

second replenishing means responsive to said counting means for continuously replenishing toner from said toner accommodating means to the respective developer until the toner density reaches the specified value when the continuous number of replenishment by said second replenishing means becomes a predetermined number; and means for prohibiting an image forming operation during replenishment by said second replenishing means.

7. An image forming apparatus as claimed in claim 6, wherein each of said first and second developing means is provided with said detecting means.

8. An image forming apparatus as claimed in claim 6, wherein said judging means includes color representing means provided in said developing means for representing color of the developer accommodated thereinto and means provided in the main body for detecting the color represented by said color representing means.

9. An image forming apparatus in which an electrostatic latent image formed on a photosensitive member is developed by a developer incorporating toner and carrier and subsequently transferred to a paper, the apparatus comprising:

first and second developing means selectively operable for developing the electrostatic latent image by first and second developers, respectively;

toner accommodating means for accommodating toner to be replenished to each of the developers;

detecting means for detecting toner density in each of the developers every image forming operation;

first replenishing means for replenishing a first predetermined amount of toner to the respective developer when the toner density detected by said detecting means is not less than a specified value;

second replenishing means responsive to said detecting means for replenishing a second predetermined amount of toner more than said first one to the respective developer when the toner density detected by said detecting means is less than the specified value;

means for counting the continuous number of replenishment by said second replenishing means;

third replenishing means responsive to said counting means for continuously replenishing toner to the respective developer until the toner density reaches the specified value when the continuous number of replenishment by said second replenishing means becomes a predetermined number;

judging means for judging whether the first and second developers have same color;

selecting means responsive to said detecting means, counting means and judging means for automatically selecting said second developing means in the case where the continuous number of replenishment to the first developer by said second replenishing means becomes the predetermined number and where the toner density in the second developer is not less than the specified value under the judgment by said judging means that the first and second developers have same color; and means responsive to said detecting means, counting means and judging means or prohibiting an image forming operation during replenishment to the first developer by said third replenishing means in the case where the continuous number of replenishment to the first developer by said second replenishing means becomes the predetermined number and where the toner density in the second developer is not less than the specified value even if the first and second developers have same color.

10. An image forming apparatus as claimed in claim 9, wherein each of said first and second developing means is provided with said detecting means.

11. An image forming apparatus as claimed in claim 9, wherein said judging means includes color representing means provided in said developing means for representing color of the developer accommodated thereinto and means provided in the main body for detecting the color represented by said color representing means.

* * * * *